US009361765B2

(12) United States Patent
Smalley

(10) Patent No.: US 9,361,765 B2
(45) Date of Patent: Jun. 7, 2016

(54) GAMING SYSTEM AND METHOD PROVIDING A BATTLING SYMBOL GENERATORS GAME

(71) Applicant: IGT, Las Vegas, NV (US)

(72) Inventor: Jason R. Smalley, Las Vegas, NV (US)

(73) Assignee: IGT, Las Vegas, NV (US)

( * ) Notice: Subject to any disclaimer, the term of this patent is extended or adjusted under 35 U.S.C. 154(b) by 325 days.

(21) Appl. No.: 14/027,946

(22) Filed: Sep. 16, 2013

(65) Prior Publication Data

US 2015/0080088 A1 Mar. 19, 2015

(51) Int. Cl.
*G07F 17/34* (2006.01)

(52) U.S. Cl.
CPC ..... *G07F 17/34* (2013.01)

(58) Field of Classification Search
CPC ..... G07F 17/32; G07F 17/34
USPC ..... 463/20
See application file for complete search history.

(56) References Cited

U.S. PATENT DOCUMENTS

| | | | |
|---|---|---|---|
| 5,722,891 | A | 3/1998 | Inoue |
| 5,769,716 | A | 6/1998 | Saffari et al. |
| 5,833,537 | A | 11/1998 | Barrie |
| 5,947,820 | A | 9/1999 | Morro et al. |
| 6,328,649 | B1 | 12/2001 | Randall et al. |
| 6,346,043 | B1 | 2/2002 | Colin et al. |
| 6,406,369 | B1 | 6/2002 | Baerlocher et al. |
| 6,425,824 | B1 | 7/2002 | Baerlocher et al. |
| 6,464,582 | B1 | 10/2002 | Baerlocher et al. |
| 6,602,135 | B1 | 8/2003 | Gerrard |
| 6,609,974 | B2 | 8/2003 | Mead et al. |
| 6,669,559 | B1 | 12/2003 | Baerlocher et al. |
| 6,726,563 | B1 | 4/2004 | Baerlocher et al. |
| 6,749,502 | B2 | 6/2004 | Baerlocher |
| 6,837,793 | B2 | 1/2005 | McClintic |
| 6,840,856 | B2 | 1/2005 | Stern |
| 6,840,858 | B2 | 1/2005 | Adams |
| 6,902,478 | B2 | 6/2005 | McClintic |
| 7,040,983 | B2 | 5/2006 | Dolloff et al. |
| 7,077,744 | B2 | 7/2006 | Cannon |
| 7,192,344 | B2 | 3/2007 | Baerlocher |
| 7,201,657 | B2 | 4/2007 | Baerlocher et al. |
| 7,229,350 | B2 | 6/2007 | Baerlocher et al. |
| 7,314,408 | B2 | 1/2008 | Cannon |
| 7,338,371 | B2 | 3/2008 | Cheng et al. |
| 7,351,144 | B2 | 4/2008 | Daly |
| 7,361,087 | B2 | 4/2008 | Baerlocher et al. |
| 7,588,494 | B2 | 9/2009 | Hughs-Baird et al. |
| 7,601,062 | B2 | 10/2009 | Cole et al. |

(Continued)

*Primary Examiner* — Jason Skaarup
(74) *Attorney, Agent, or Firm* — Neal, Gerber & Eisenberg LLP

(57) ABSTRACT

Various embodiments of the present disclosure provide a gaming system and method providing a battling symbol generators game. In various embodiments, each symbol generator of a set of symbol generators employed for the battling symbol generators game is associated with one of a plurality of different characteristics. During play of the battling symbol generators game, the gaming system modifies the set of symbol generators upon the occurrence of various symbol generator set modification events such that more symbol generators of the set are associated with a particular characteristic and/or such that fewer symbol generators of the set are associated with another characteristic. The gaming system provides a bonus when a designated quantity of the symbol generators of the set are each associated with a particular characteristic.

28 Claims, 43 Drawing Sheets

(56) References Cited

U.S. PATENT DOCUMENTS

| | | | | |
|---|---|---|---|---|
| 7,611,406 | B2 * | 11/2009 | Fuller | G07F 17/34 463/16 |
| 7,674,180 | B2 | 3/2010 | Graham et al. | |
| 7,789,755 | B2 | 9/2010 | Davis et al. | |
| 7,794,320 | B2 | 9/2010 | Baerlocher et al. | |
| 7,862,430 | B2 | 1/2011 | Baerlocher et al. | |
| 7,883,403 | B2 | 2/2011 | Low et al. | |
| 7,914,376 | B2 | 3/2011 | Walker et al. | |
| 7,927,204 | B2 | 4/2011 | Debrabander, Jr. et al. | |
| 7,950,994 | B2 | 5/2011 | Berman et al. | |
| 7,985,133 | B2 | 7/2011 | Baerlocher et al. | |
| 8,002,620 | B2 | 8/2011 | Nicely et al. | |
| 8,033,912 | B2 | 10/2011 | Cannon | |
| 8,092,302 | B2 | 1/2012 | Cuddy et al. | |
| 8,142,280 | B2 | 3/2012 | Walker et al. | |
| 8,152,630 | B2 | 4/2012 | Cohen | |
| 8,257,164 | B2 | 9/2012 | Bigelow et al. | |
| 8,292,720 | B2 | 10/2012 | Davis et al. | |
| 8,313,368 | B2 | 11/2012 | Filipour et al. | |
| 8,342,947 | B2 | 1/2013 | Baerlocher et al. | |
| 8,376,836 | B2 | 2/2013 | Baerlocher et al. | |
| 8,382,572 | B2 | 2/2013 | Hoffman et al. | |
| 8,414,379 | B2 | 4/2013 | Nicely et al. | |
| 8,425,303 | B2 | 4/2013 | Kennedy et al. | |
| 8,449,375 | B2 | 5/2013 | Oberberger | |
| 8,608,543 | B2 | 12/2013 | Cuddy et al. | |
| 2002/0032050 | A1 * | 3/2002 | Baerlocher | G07F 17/34 463/20 |
| 2003/0125103 | A1 | 7/2003 | Tessmer et al. | |
| 2005/0159208 | A1 * | 7/2005 | Pacey | G07F 17/34 463/20 |
| 2008/0076542 | A1 | 3/2008 | Iddings et al. | |
| 2008/0096648 | A1 * | 4/2008 | Webb | G07F 17/3267 463/25 |
| 2010/0081497 | A1 | 4/2010 | Wolf et al. | |
| 2010/0113122 | A1 | 5/2010 | Walker et al. | |
| 2010/0137056 | A1 | 6/2010 | Hoffman et al. | |
| 2011/0003627 | A1 | 1/2011 | Nicely et al. | |
| 2012/0034967 | A1 * | 2/2012 | Owen | G07F 17/34 463/20 |
| 2012/0202599 | A1 | 8/2012 | Cohen | |
| 2012/0214580 | A1 | 8/2012 | Hoffman et al. | |
| 2013/0065669 | A1 | 3/2013 | Michaelson et al. | |
| 2013/0079076 | A1 | 3/2013 | Filipour et al. | |
| 2013/0079123 | A1 | 3/2013 | Nicely et al. | |
| 2013/0084961 | A1 | 4/2013 | Radisich et al. | |
| 2013/0084962 | A1 | 4/2013 | Radisich et al. | |
| 2013/0084994 | A1 | 4/2013 | Farrar | |
| 2013/0102375 | A1 * | 4/2013 | Aoki | G07F 17/32 463/20 |
| 2014/0087844 | A1 | 3/2014 | Gilliland et al. | |
| 2014/0256402 | A1 * | 9/2014 | Caputo | G07F 17/34 463/20 |

* cited by examiner

GAMING SYSTEM AND METHOD PROVIDING A BATTLING SYMBOL GENERATORS GAME

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure provide a gaming system and method providing a battling symbol generators game. In various embodiments, each symbol generator of a set of symbol generators employed for the battling symbol generators game is associated with one of a plurality of different characteristics. During play of the battling symbol generators game, the gaming system modifies the set of symbol generators upon the occurrence of various symbol generator set modification events such that more symbol generators of the set are associated with a particular characteristic and/or such that fewer symbol generators of the set are associated with another characteristic. The gaming system provides a bonus when a designated quantity of the symbol generators of the set are each associated with a particular characteristic.

In operation of one embodiment, the gaming system displays a play of a game associated with a set of a plurality of symbol generators (such as reels). In this embodiment: (a) a first quantity of one or more of the symbol generators of the set are each associated with a first characteristic, and (b) a second quantity of one or more of the symbol generators of the set are each associated with a second different characteristic. If a first symbol generator set modification event occurs in association with said play of the game, the gaming system modifies the set of symbol generators such that a third quantity of the symbol generators of the set are each associated with the first characteristic, the third quantity being greater than the first quantity.

If, on the other hand, a second different symbol generator set modification event occurs in association with the play of the game, the gaming system modifies the set of symbol generators such that a fourth quantity of the symbol generators of the set are associated with the second characteristic, the fourth quantity being greater than the second quantity. If each of the symbol generators of the set are associated with the first characteristic, the gaming system provides a bonus associated with the first characteristic. If each of the symbol generators of the set are associated with the second characteristic, the gaming system provides a bonus associated with the second characteristic.

In operation of another embodiment, the gaming system displays a play of a game associated with a set of a plurality of symbol generators (such as reels). In this embodiment: (a) a first quantity of one or more of the symbol generators of the set are each associated with a first characteristic, and (b) a second quantity of one or more of the symbol generators of the set are each associated with a second different characteristic. If a symbol generator set modification event occurs in association with said play of the game, the gaming system modifies the set of symbol generators such that one of: (a) a third quantity of the symbol generators of the set are each associated with the first characteristic, the third quantity being greater than the first quantity; and (b) a fourth quantity of the symbol generators of the set are associated with the second characteristic, the fourth quantity being greater than the second quantity. If each of the symbol generators of the set are associated with the first characteristic, the gaming system provides a bonus associated with the first characteristic. If each of the symbol generators of the set are associated with the second characteristic, the gaming system provides a bonus associated with the second characteristic.

It should thus be appreciated that the gaming system and method of the present disclosure provide a new game to increase player engagement, enjoyment, entertainment, and excitement.

Additional features and advantages are described herein, and will be apparent from, the following Detailed Description and the Figures.

DETAILED DESCRIPTION

Battling Symbol Generators Game

Various embodiments of the present disclosure provide a gaming system and method providing a battling symbol generators game. While the battling symbol generators game is implemented as a primary wagering game in the certain of the embodiments described herein and as a bonus game in other of the embodiments described herein, it should be appreciated that any embodiment of the battling symbol generators game of the present disclosure may be implemented as a primary game and/or a bonus or secondary game. Further, while any credit balances, any wagers, and any awards are displayed as amounts of monetary currency or credits, one or more of such credit balances, such wagers, and such awards may be for any suitable non-monetary credits or currency, promotional credits, and/or player tracking points or credits.

Figure 1:
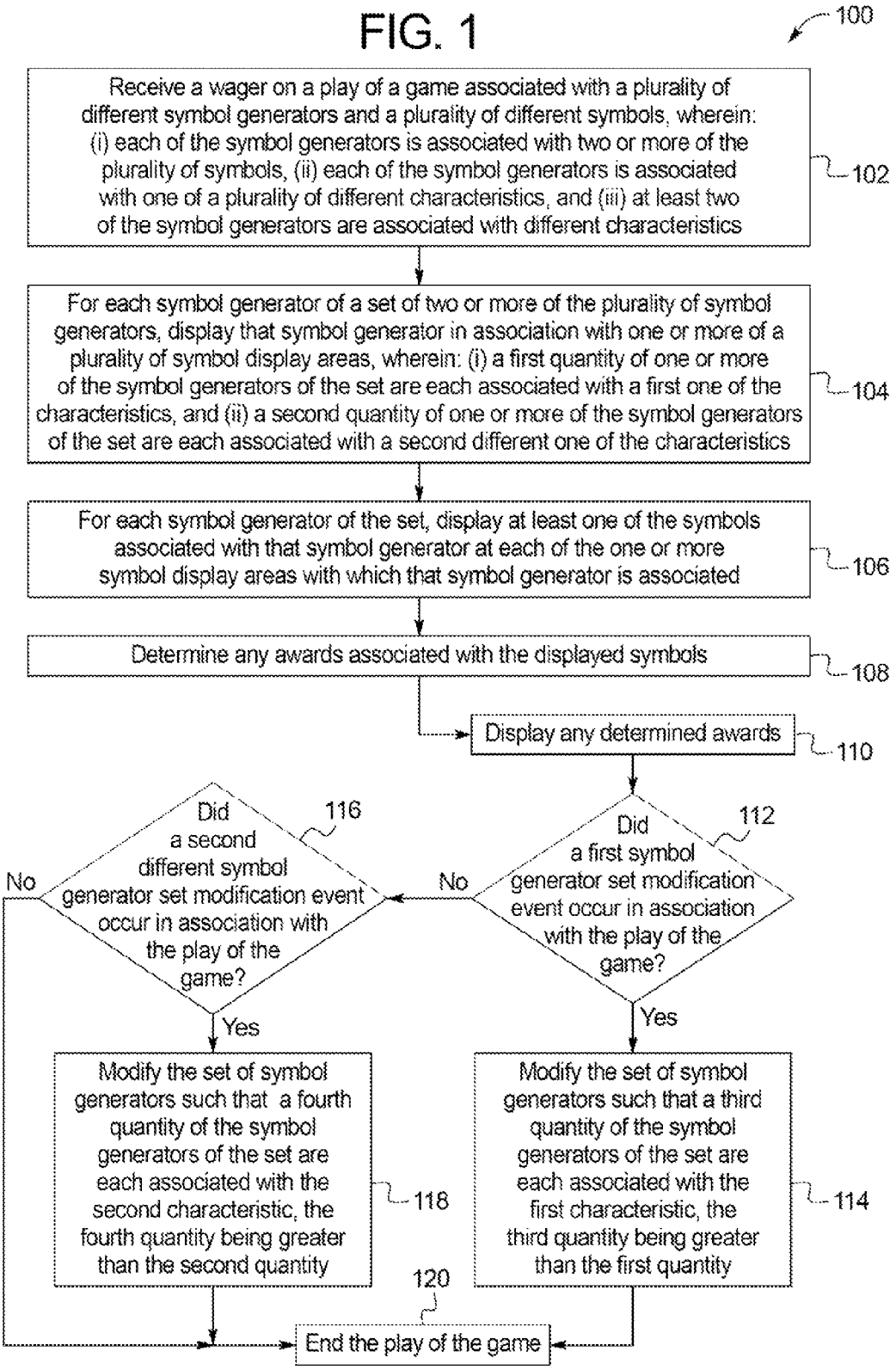
FIG. 1 is a flowchart illustrating an example method of operating one embodiment of the gaming system of the present disclosure.

FIG. 1 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system receives a wager on a play of a battling symbol generators game (sometimes referred to herein as the "game") associated with a plurality of different symbol generators and a plurality of different symbols, as indicated by block 102. In this example embodiment: (a) each of the symbol generators is associated with two or more of the symbols, (b) each of the symbol generators is associated with one of a plurality of different characteristics, and (c) at least two of the symbol generators are associated with different characteristics. For the play of the game, for each symbol generator of a set of two or more of the plurality of symbol generators, the gaming system displays that symbol generator in association with one or more of a plurality of symbol display areas, as indicated by block 104. In this example embodiment, a first quantity of one or more of the symbol generators of the set are each associated with a first one of the characteristics, and a second quantity of one or more of the symbol generators of the set are each associated with a second different one of the characteristics.

For each symbol generator of the set, the gaming system displays at least one of the symbols associated with that symbol generator at each of the one or more symbol display areas with which that symbol generator is associated, as indicated by block 106. The gaming system determines any awards associated with the displayed symbols, as indicated by block 108, and displays any determined awards, as indicated by block 110. The gaming system determines whether a first symbol generator set modification event occurred in association with the play of the game, as indicated by diamond 112.

If the gaming system determines that the first symbol generator set modification event occurred in association with the play of the game, the gaming system modifies the set of symbol generators such that a third quantity of the symbol generators of the set are each associated with the first characteristic, as indicated by block 114. In this example embodiment, the third quantity is greater than the first quantity. The gaming system ends the play of the game, as indicated by block 120. If, on the other hand, the gaming system determines that the first symbol generator set modification event did not occur in association with the play of the game, the gaming system determines whether a second different symbol generator set modification event occurred in association with the play of the game, as indicated by diamond 116.

If the gaming system determines that the second symbol generator set modification event occurred in association with the play of the game, the gaming system modifies the set of symbol generators such that a fourth quantity of the symbol generators of the set are each associated the second characteristic, as indicated by block 118. In this example embodiment, the fourth quantity is greater than the second quantity.

The gaming system ends the play of the game, as indicated by block 120. If, on the other hand, the gaming system determines that the second symbol generator set modification event did not occur in association with the play of the game, the gaming system ends the play of the game, as indicated by block 120.

Battling Symbol Generators Game with Symbol Generator Replacement

In various embodiments, the symbol generators are reels. In certain such embodiments, if the gaming system determines that the first reel set modification event occurs in association with a play of the game, the gaming system modifies the set of reels such that a third quantity of the reels of the set are each associated with the first characteristic, wherein the third quantity is greater than the first quantity. In certain embodiments, the gaming system does so by: (a) removing at least one of the reels that is not associated with the first characteristic from the set, and (b) replacing the removed at least one reel with at least one reel that is associated with the first characteristic.

As also noted above, in various embodiments, if the gaming system determines that the second reel set modification event occurs in association with a play of the game, the gaming system modifies the set of reels such that a fourth quantity of the reels of the set are each associated with the second characteristic, wherein the fourth quantity is greater than the second quantity. In certain embodiments, the gaming system does so by: (a) removing at least one of the reels that is not associated with the second characteristic from the set, and (b) replacing the removed at least one reel with at least one reel that is associated with the second characteristic.

FIGS. 2A, 2B, 2C, 2D, 2E, 2F, 2G, 2H, and 2I illustrate screen shots of one example embodiment of the gaming system of the present disclosure providing a plurality of plays of one example embodiment of the battling reels game of the present disclosure. The battling reels game is a primary wagering game in this example embodiment. The gaming system displays, such as on display device 1116 or 1118 (described below), a plurality of symbol display areas 210*a*. 210*b*, 210*c*, 210*d*, 210*e*, 210*f*, 210*g*, 210*h*, 210*i*, 210*j*, 210*k*, 210*l*, 210*m*, 210*n*, and 210*o* arranged in a 3×5 grid or matrix. The gaming system displays a plurality of paylines, each of which is associated with a different plurality of the symbol display areas. In this example embodiment: (a) payline 215*a* is associated with symbol display areas 210*a*, 210*b*, 210*c*, 210*d*, and 210*e*; (b) payline 215*b* is associated with symbol display areas 210*f*, 210*g*. 210*h*, 210*i*, and 210*j*; and (c) payline 215*c* is associated with symbol display areas 210*k*, 210*l*, 210*m*, 210*n*, and 210*o*.

The gaming system also displays: (a) a message box 260 in which the gaming system displays a variety of messages or indications before, during, or after play of the game; (b) a plurality of meters including: (i) a credit meter 270 in which the gaming system displays the player's credit balance (in credit or currency form), (ii) a wager or bet meter 280 that displays any wager or bet placed on a play of the game (in credit or currency form), and (iii) an award meter 290 that displays any awards won for the play of the game (in credit or currency form); and (c) a Spin button 294 that, when actuated by the player, causes the gaming system to initiate a play of the game. While in this illustrated example embodiment the gaming system indicates the player's credit balance, any wagers, and any awards in the form of amounts of currency, it should be appreciated that such indications may alternatively or additionally be made in the form of amounts of credits.

In this example embodiment, the game is associated with a plurality of symbols and a plurality of reels (i.e., symbol generators in this example embodiment). Here: (a) each of the plurality of reels is associated with two or more of the plurality of symbols; (b) each reel is associated with or has one of a plurality of different themes (i.e., characteristics in this example embodiment) and includes a background associated with that theme; and (c) at least three of the reels are associated with different themes. In this example embodiment, the themes (and their associated backgrounds) include: (a) a first alien theme (associated with a hatched background), (b) a second pirate theme (associated with a dotted background), and (c) a third neutral theme (associated with a blank background). It should be appreciated that the gaming system may distinguish reels having different themes (i.e., reels that are associated with different characteristics) in any suitable manner instead of or in addition to displaying different backgrounds for the reels. Additionally, in this example embodiment, for each reel, one or more of the symbols associated with that reel also have the theme of that reel. For instance, one or more of the symbols on a reel having the alien theme also have the alien theme.

In this example embodiment, for each play of the game, the gaming system employs a set of the plurality of reels including two or more of, but fewer than all of, the plurality of reels. Here, the gaming system initially employs an initial set of the reels including reels 205*a*, 205*b*, 205*c*, 205*d*, and 205*e* for the game. The gaming system displays the reels 205*a*, 205*b*, 205*c*, 205*d*, and 205*e* from left to right in association with the plurality of symbol display areas such that each reel is configured to display symbols at one or more of the symbol display areas. More specifically, the gaming system displays: (a) the reel 205*a* in association with the symbol display areas 210*a*, 210*f*, and 210*k*; (b) the reel 205*b* in association with the symbol display areas, 210*b*, 210*g*, and 210*l*; (c) the reel 205*c* in association with the symbol display areas 210*c*, 210*h*, and 210*m*; (d) the reel 205*d* in association with the symbol display areas 210*d*, 210*i*, and 210*n*; and (e) the reel 205*e* in association with the symbol display areas 210*e*, 210*j*, and 210*o*.

In this example embodiment, the gaming system determines any awards associated with a play of the game based on the symbols displayed at the symbol display areas by determining: (a) whether any winning combinations of the symbols included in a paytable (not shown) associated with the game are displayed from left to right along any wagered-on paylines, and (b) whether any winning combinations of the symbols are displayed from right to left along any wagered-on paylines. It should be appreciated that, in this example embodiment, symbols of the same level may form winning symbol combinations regardless of the theme of those symbols. For instance, the symbols A1-N1-P1 form a winning symbol combination because they are all of the same level (i.e., "1"), even though each symbol has with a different theme. In other embodiments, winning symbol combinations may only be formed from symbols having the same theme.

In this example embodiment, with respect to the initial set of reels: (a) the leftmost reels 205*a* and 205*b* of the set each have the alien theme and, therefore, each display the hatched background associated with the alien theme; (b) the middle reel 205*c* of the set has the neutral theme and, therefore, displays the blank background associated with the neutral theme; and (c) the rightmost reels 205*d* and 205*e* of the set each have the pirate theme and, therefore, each display the dotted background associated with the pirate theme. During game play in this example embodiment, the gaming system: (a) removes and replaces one or more reels having with the neutral or pirate themes with one or more reels having the alien theme upon an occurrence of a first reel set modification event, and (b) removes and replaces one or more reels having the neutral or alien themes with one or more reels having the pirate theme upon an occurrence of a second different reel set modification event.

More specifically, in this example embodiment, the gaming system determines that the first reel set modification event occurs in association with a play of the game when: (a) a sum of any awards associated with any winning combinations of symbols displayed from left to right along any wagered-on paylines is greater than a sum of any awards associated with any winning combinations of symbols displayed from right to left along any wagered-on paylines, and (b) at least one of the reels of the set does not have the alien theme. The gaming system determines that the second reel set modification event occurs in association with a play of the game when: (a) a sum of any awards associated with any winning combinations of symbols displayed from right to left along any wagered-on paylines is greater than a sum of any awards associated with any winning combinations of symbols displayed from left to right along any wagered-on paylines, and (b) at least one of the reels of the set does not have the pirate theme.

In this example embodiment, upon an occurrence of the first reel set modification event, the gaming system modifies the set of reels by removing the reel that is adjacent to the rightmost reel having the alien theme and replacing it with another reel that has the alien theme such that the modified set of reels includes one more reel having the alien theme than it did before being modified. Similarly, upon an occurrence of the second reel set modification event, the gaming system modifies the set of reels by removing the reel that is adjacent to the leftmost reel having the pirate theme and replacing it with another reel that has the pirate theme such that the modified set of reels includes one more reel having the pirate theme than it did before being modified.

The gaming system is configured to provide a plurality of different bonuses in this example embodiment. Specifically, the gaming system is configured to provide an alien-themed bonus and a pirate-themed bonus. Here, the gaming system provides the alien-themed bonus upon an occurrence of an alien bonus triggering event, which occurs when the gaming system modifies the set of reels such that a designated quantity of each of the reels in the set of reels has the alien theme. The gaming system provides the pirate-themed bonus upon an occurrence of a pirate bonus triggering event, which occurs when the gaming system modifies the set of reels such that the designated quantity of each of the reels in the set of reels has the pirate theme. It should be appreciated that the designated quantity may be any suitable quantity of the reels. In other embodiments, the gaming system is configured to provide one bonus game and provides that bonus game upon the occurrence of either the first or the second bonus triggering event.

In this example embodiment, after providing the alien bonus upon the occurrence of the alien bonus triggering event or the pirate bonus upon the occurrence of the pirate bonus triggering event, the gaming system resets the set of reels to the initial set of reels.

Figure 2A:
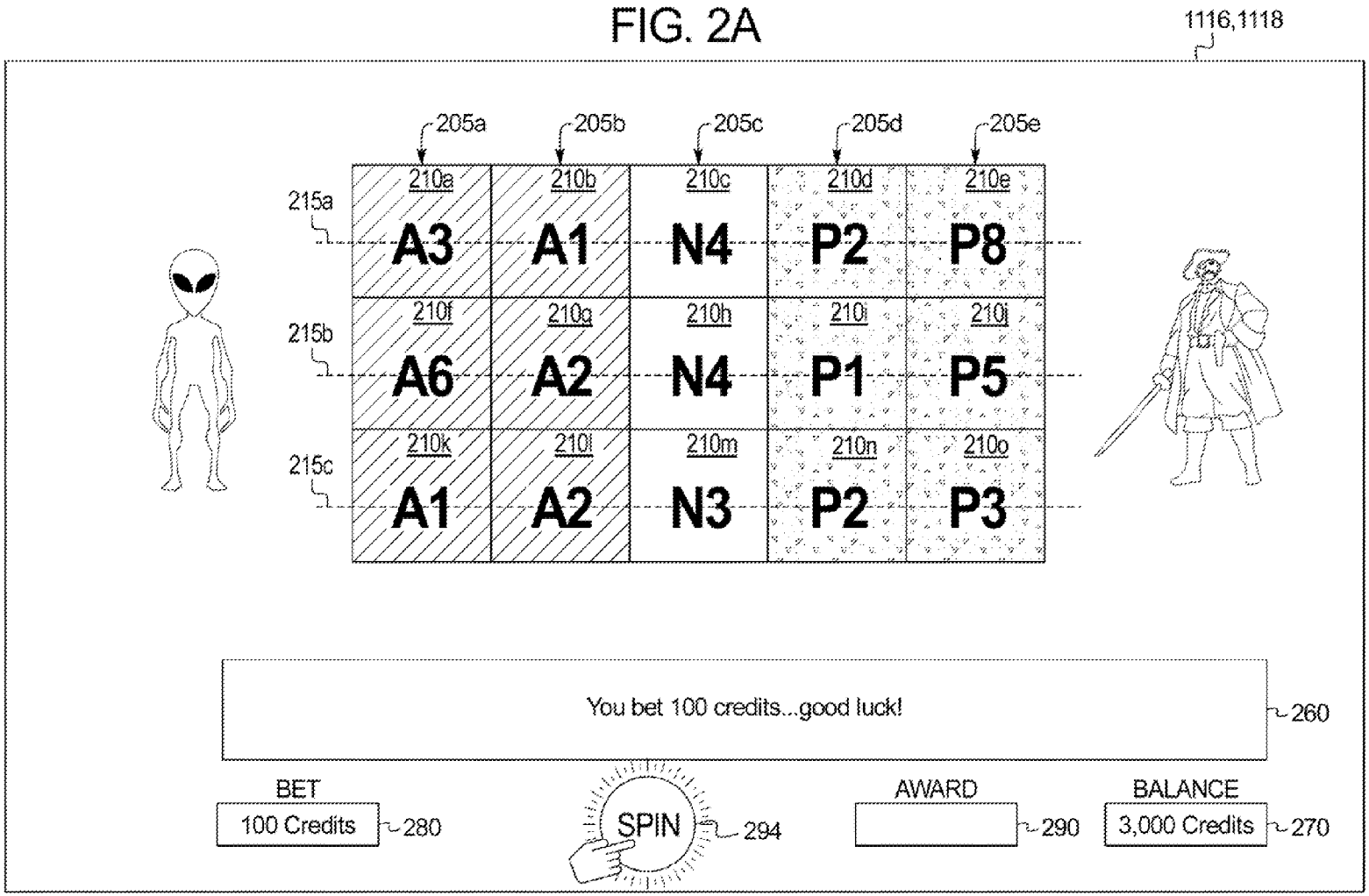
FIGS. 2A, 2B, 2C, 2D, 2E, 2F, 2G, 2H, and 2I illustrate screen shots of one example embodiment of the gaming system of the present disclosure providing a plurality of plays of one example embodiment of the game of the present disclosure.
Figure 2B:
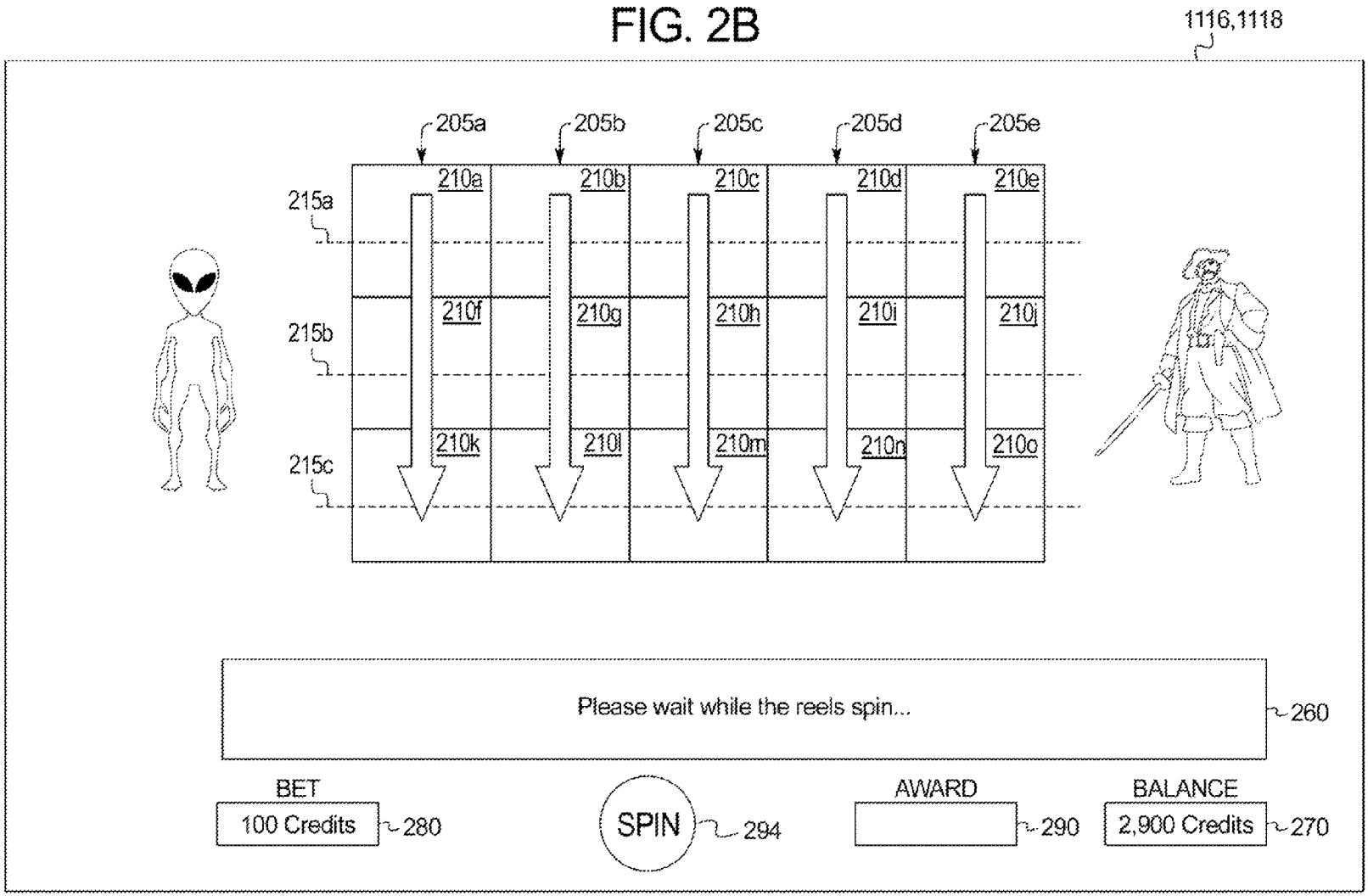

Turning to FIG. 2A, the gaming system receives a wager of 100 credits (as shown in the bet meter 280) and an actuation of the Spin button 294 from the player. Accordingly, the gaming system initiates a play of the game and spins the reels 205*a*, 205*b*, 205*c*, 205*d*, and 205*e*. The gaming system displays the following message in the message box 260: "YOU BET 100 CREDITS . . . GOOD LUCK!" As illustrated in FIG. 2B, the gaming system reduces the player's credit balance by the 100 credit wager (as shown in the credit meter 270) and displays the reels 205*a*, 205*b*, 205*c*, 205*d*, and 205*e* spinning. The gaming system displays the following message in the message box 260: "PLEASE WAIT WHILE THE REELS SPIN . . . "

Figure 2C:
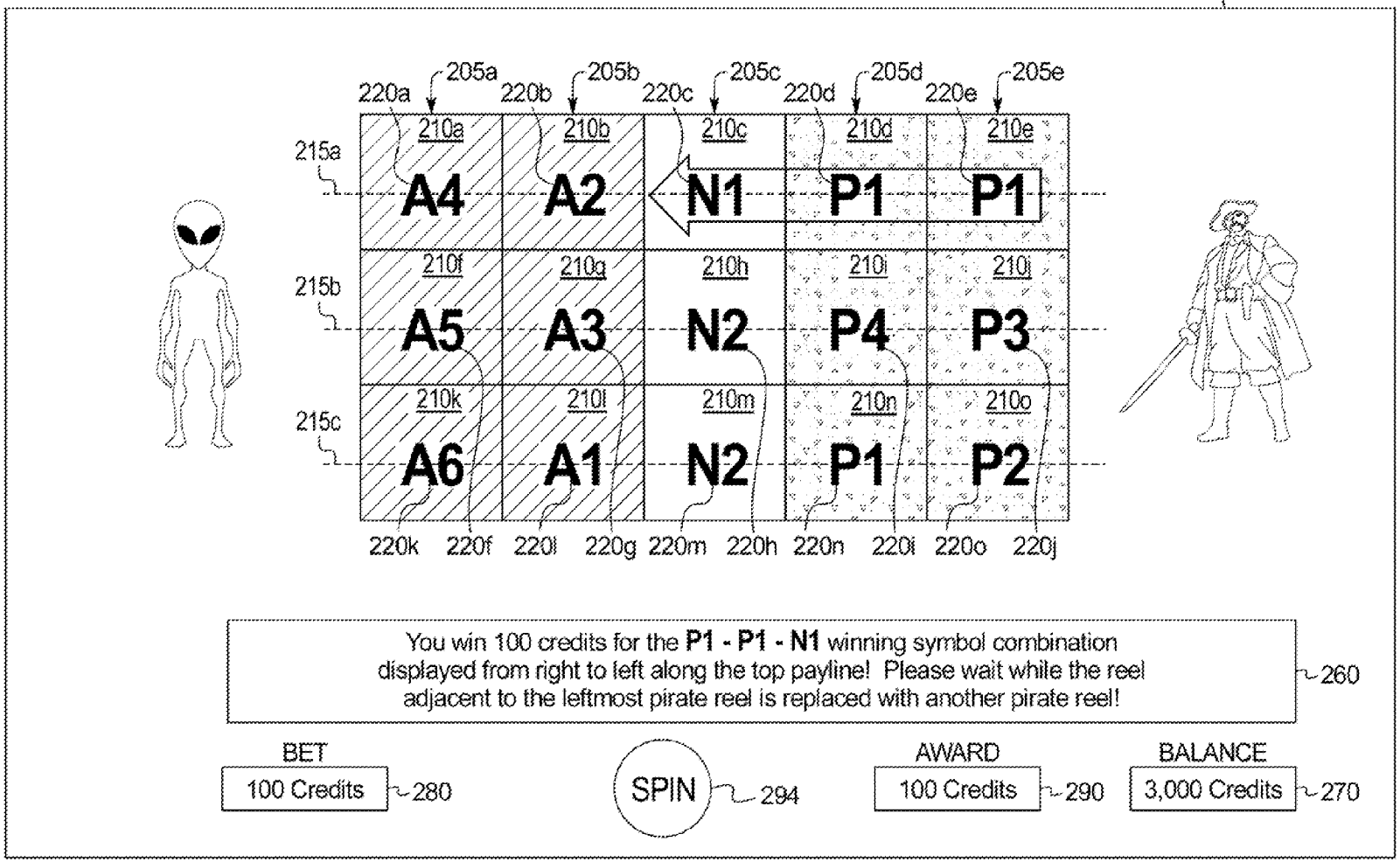

As illustrated in FIG. 2C, the gaming system stops the reels 205*a*, 205*b*. 205*c*, 205*d*, and 205*e* such that: (a) A4 symbol 220*a* is displayed at the symbol display area 210*a*, (b) A2 symbol 220*b* is displayed at the symbol display area 210*b*, (c) N1 symbol 220*c* is displayed at the symbol display area 210*c*, (d) P1 symbol 220*d* is displayed at the symbol display area 210*d*, (e) P1 symbol 220*e* is displayed at the symbol display area 210*e*, (f) A5 symbol 220*f* is displayed at the symbol display area 210*f*, (9) A3 symbol 220*g* is displayed at the symbol display area 210*g*, (h) N2 symbol 220*h* is displayed at the symbol display area 210*h*, (i) P4 symbol 220*i* is displayed at the symbol display area 210*i*, (j) P3 symbol 220*j* is displayed at the symbol display area 210*j*, (k) A6 symbol 220*k* is displayed at the symbol display area 210*k*, (l) A1 symbol 220*l* is displayed at the symbol display area 210*l*, (m) N2 symbol 220*m* is displayed at the symbol display area 210*m*, (n) P1 symbol 220*n* is displayed at the symbol display area 210*n*, and (o) P2 symbol 220*o* is displayed at the symbol display area 210*o*.

As noted above, the gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P1 220*e*, P1 220*d*, and N1 220*c* displayed from right to left along the payline 215*a* form one of the winning symbol combinations. The gaming system determines an award of 100 credits associated with the displayed P1-P1-N1 winning symbol combination, displays the 100 credit award in the award meter 290, and updates the player's credit balance to reflect the 100 credit award.

The gaming system determines whether the first reel set modification event occurred in association with the play of the game, as described above. Here, the gaming system determines that the first reel set modification event did not occur in association with the play of the game because the sum of awards (0 credits) associated with any winning combinations of symbols displayed from left to right along any wagered-on paylines (no winning symbol combinations) is not greater than the sum of awards (100 credits) associated with any winning combinations of symbols displayed from right to left along any wagered-on paylines (the P1-P1-N1 winning symbol combination).

The gaming system determines whether the second reel set modification event occurred in association with the play of the game, as described above. Here, the gaming system determines that the second reel set modification event occurred in association with the play of the game because: (a) the sum of awards (100 credits) associated with any winning combinations of symbols displayed from right to left along any wagered-on paylines (the P1-P1-N1 winning symbol combination) is greater than the sum of awards (0 credits) associated with any winning combinations of symbols displayed from left to right along any wagered-on paylines (no winning symbol combinations); and (b) the reels 205*a*, 205*b*, and 205*c* do not have the pirate theme.

As noted above, upon an occurrence of the second reel set modification event in this example embodiment, the gaming system modifies the set of reels by removing the reel that is adjacent to the leftmost reel having the pirate theme and replacing it with another reel that has the pirate theme. Thus, the modified set of reels includes one more reel having the pirate theme than it did before being modified. The gaming system displays the following message in the message box 260: "YOU WIN 100 CREDITS FOR THE P1-P1-N1 WINNING SYMBOL COMBINATION DISPLAYED FROM RIGHT TO LEFT ALONG THE TOP PAYLINE! PLEASE WAIT WHILE THE REEL ADJACENT TO THE LEFTMOST PIRATE REEL IS REPLACED WITH ANOTHER PIRATE REEL!"

Figure 2D:
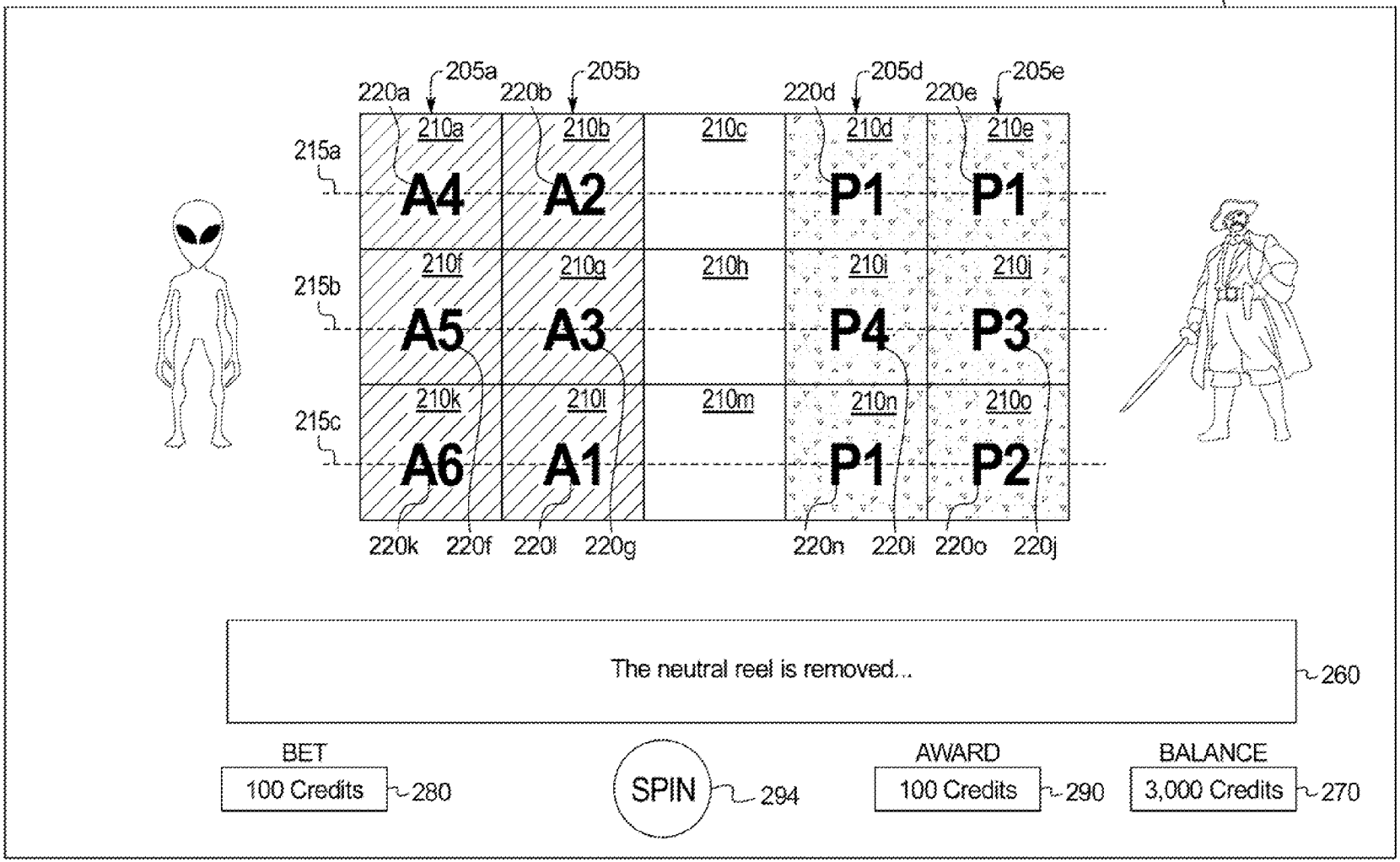
Figure 2E:
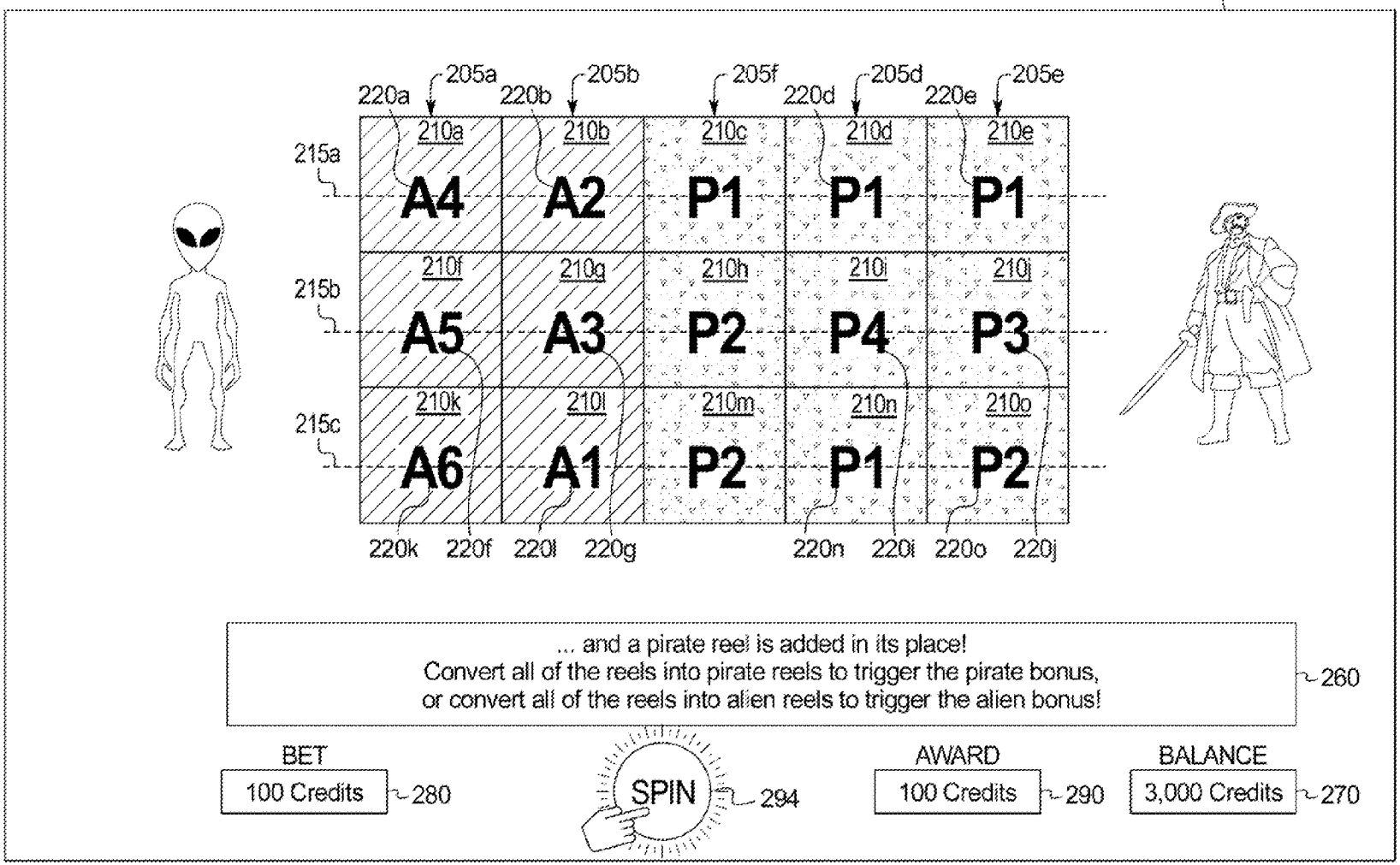

As illustrated in FIG. 2D, in this instance the leftmost reel that has the pirate theme is the reel 205*d*, and the reel that is adjacent to the reel 205*d* is the reel 205*c* (which has the neutral theme). Accordingly, the gaming system removes the reel 205*c*. The gaming system displays the following message in the message box 260: "THE NEUTRAL REEL IS REMOVED . . . " As illustrated in FIG. 2E, the gaming system replaces the removed reel 205*c* with reel 205*f*, which has the pirate theme, such that the reel 205*f* is associated with and configured to display symbols at the symbol display areas 210*c*, 210*h*, and 210*m*. The gaming system displays the following message in the message box 260: " . . . AND A PIRATE REEL IS ADDED IN ITS PLACE! CONVERT ALL OF THE REELS INTO PIRATE REELS TO TRIGGER THE PIRATE BONUS, OR CONVERT ALL OF THE REELS INTO ALIEN REELS TO TRIGGER THE ALIEN BONUS!"

Figure 2F:
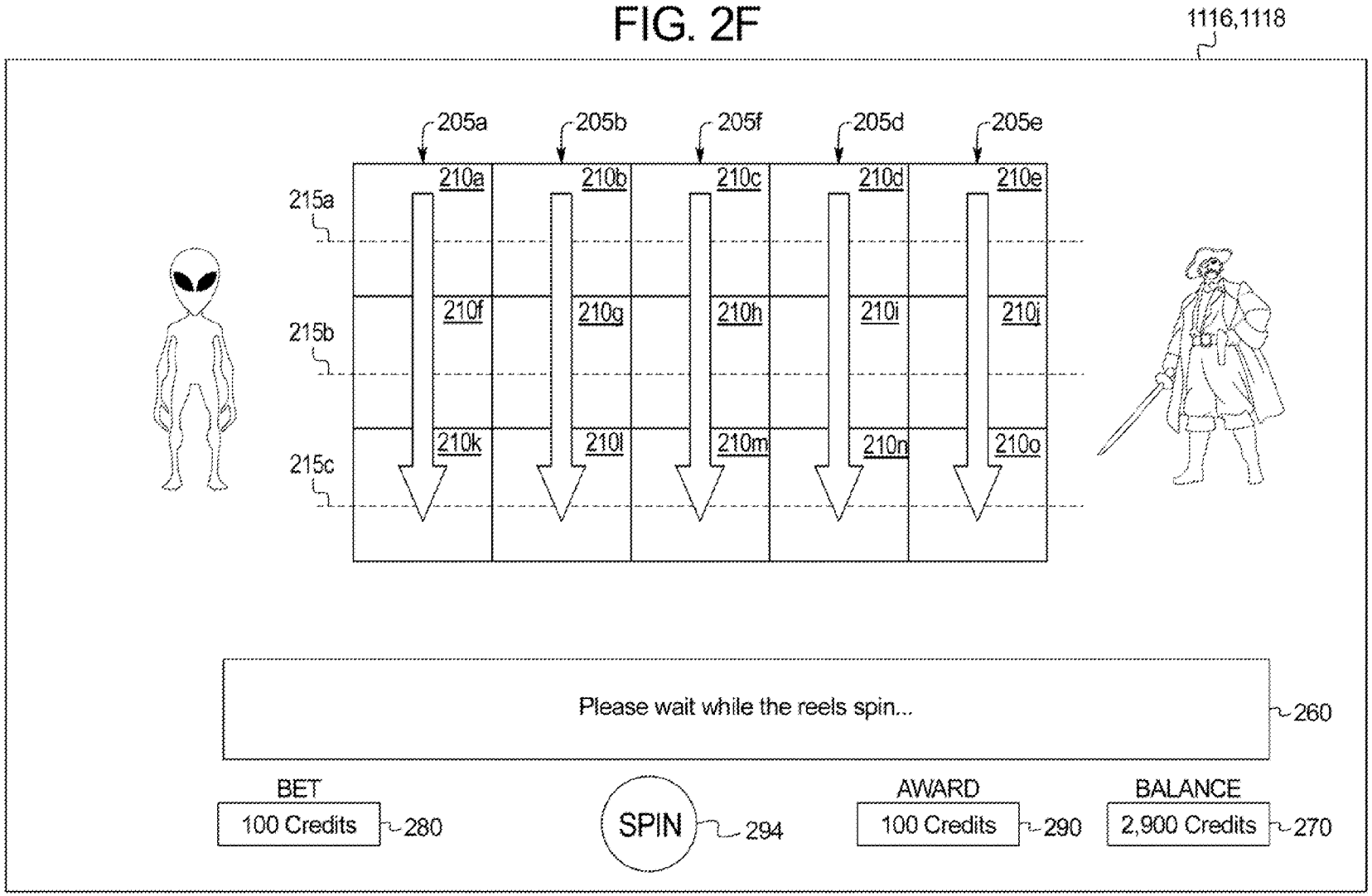

As also illustrated in FIG. 2E, the gaming system receives another actuation of the Spin button 294 from the player. Accordingly, the gaming system initiates another play of the game and spins the reels 205*a*, 205*b*, 205*c*, 205*d*, and 205*e*. As illustrated in FIG. 2F, the gaming system reduces the player's credit balance by the 100 credit wager (as shown in the credit meter 270) and displays the reels 205*a*, 205*b*, 205*c*, 205*d*, and 205*e* spinning. The gaming system displays the following message in the message box 260: "PLEASE WAIT WHILE THE REELS SPIN . . . "

Figure 2G:
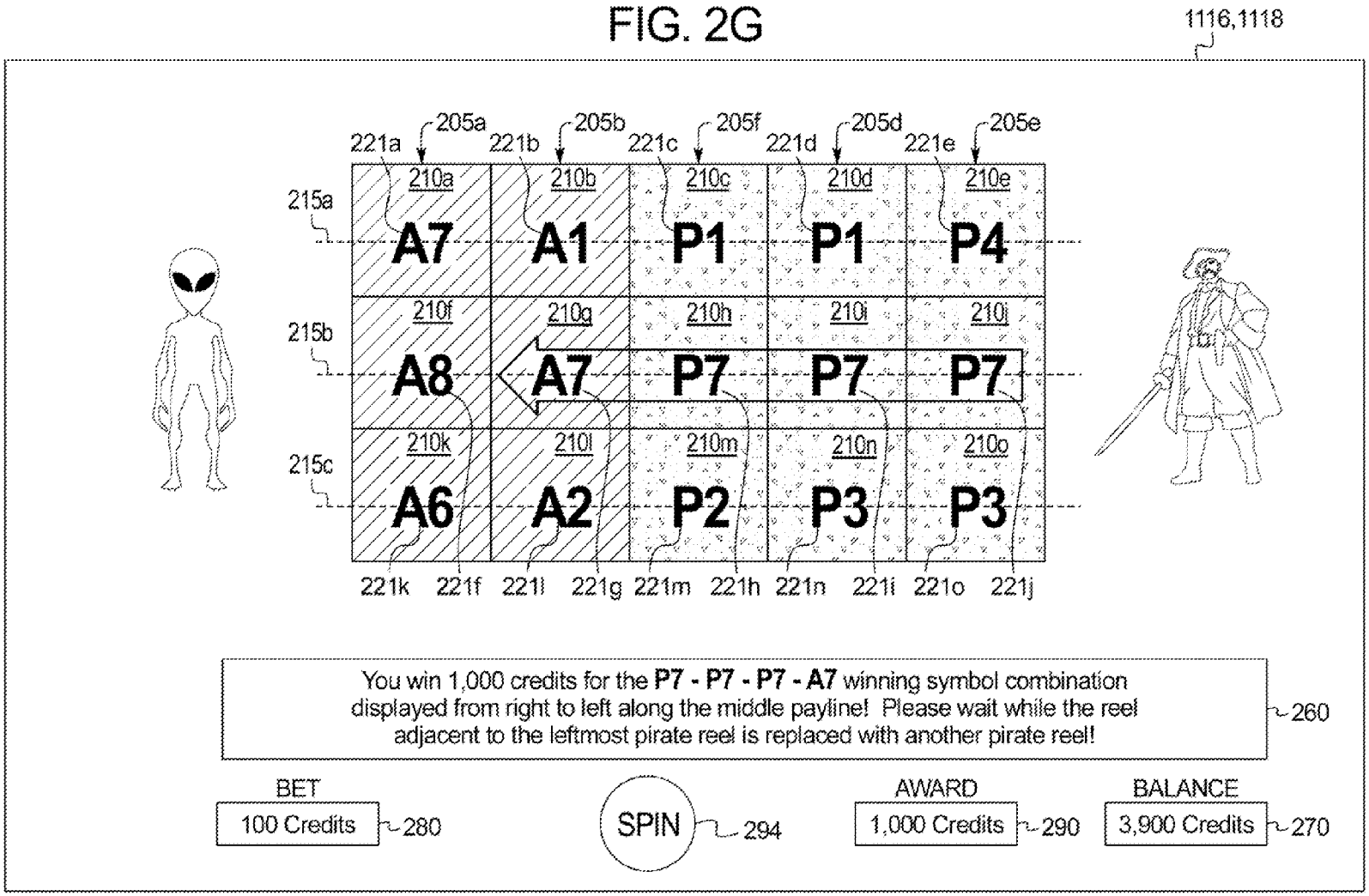

As illustrated in FIG. 2G, the gaming system stops the reels 205*a*, 205*b*. 205*c*, 205*d*, and 205*e* such that: (a) A7 symbol 221*a* is displayed at the symbol display area 210*a*, (b) A1 symbol 221*b* is displayed at the symbol display area 210*b*, (c) P1 symbol 221*c* is displayed at the symbol display area 210*c*, (d) P1 symbol 221*d* is displayed at the symbol display area 210*d*, (e) P4 symbol 221*e* is displayed at the symbol display area 210*e*, (f) A8 symbol 221*f* is displayed at the symbol display area 210*f*, (g) A7 symbol 221*g* is displayed at the symbol display area 210*g*, (h) P7 symbol 221*h* is displayed at the symbol display area 210*h*, (i) P7 symbol 221*i* is displayed at the symbol display area 210*i*, (j) P7 symbol 221*j* is displayed at the symbol display area 210*j*, (k) A6 symbol 221*k* is displayed at the symbol display area 210*k*, (l) A2 symbol 221*l* is displayed at the symbol display area 210*l*, (m) P2 symbol 221*m* is displayed at the symbol display area 210*m*, (n) P3 symbol 221*n* is displayed at the symbol display area 210*n*, and (o) P3 symbol 221*o* is displayed at the symbol display area 210*o*.

As noted above, the gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P7 221*j*, P7 221*i*, P7 221*h*, and A7 221*g* displayed from right to left along the payline 215*b* form one of the winning symbol combinations. The gaming system determines an award of 1,000 credits associated with the displayed P7-P7-P7-A7 winning symbol combination; displays the 1,000 credit award in the award meter 290; and updates the player's credit balance to reflect the 1,000 credit award.

The gaming system determines whether the first reel set modification event occurred in association with the play of the game, as described above. Here, the gaming system determines that the first reel set modification event did not occur in association with the play of the game because the sum of awards (0 credits) associated with any winning combinations of symbols displayed from left to right along any wagered-on paylines (no winning symbol combinations) is not greater than the sum of awards (1,000 credits) associated with any winning combinations of symbols displayed from right to left along any wagered-on paylines (the P7-P7-P7-A7 winning symbol combination).

The gaming system determines whether the second reel set modification event occurred in association with the play of the game, as described above. Here, the gaming system determines that the second reel set modification event occurred in association with the play of the game because: (a) the sum of awards (1,000 credits) associated with any winning combinations of symbols displayed from right to left along any wagered-on paylines (the P7-P7-P7-A7 winning symbol combination) is greater than the sum of awards (0 credits) associated with any winning combinations of symbols displayed from left to right along any wagered-on paylines (no winning symbol combinations); and (b) the reels 205*a* and 205*b* do not have the pirate theme.

As noted above, upon an occurrence of the second reel set modification event in this example embodiment, the gaming system modifies the set of reels by removing the reel that is adjacent to the leftmost reel having the pirate theme and replacing it with another reel that has the pirate theme. Thus, the modified set of reels includes one more reel having the pirate theme than it did before being modified. The gaming system displays the following message in the message box 260: "YOU WIN 1,000 CREDITS FOR THE P7-P7-P7-A7 WINNING SYMBOL COMBINATION DISPLAYED FROM RIGHT TO LEFT ALONG THE MIDDLE PAYLINE! PLEASE WAIT WHILE THE REEL ADJACENT TO THE LEFTMOST PIRATE REEL IS REPLACED WITH ANOTHER PIRATE REEL!"

Figure 2H:
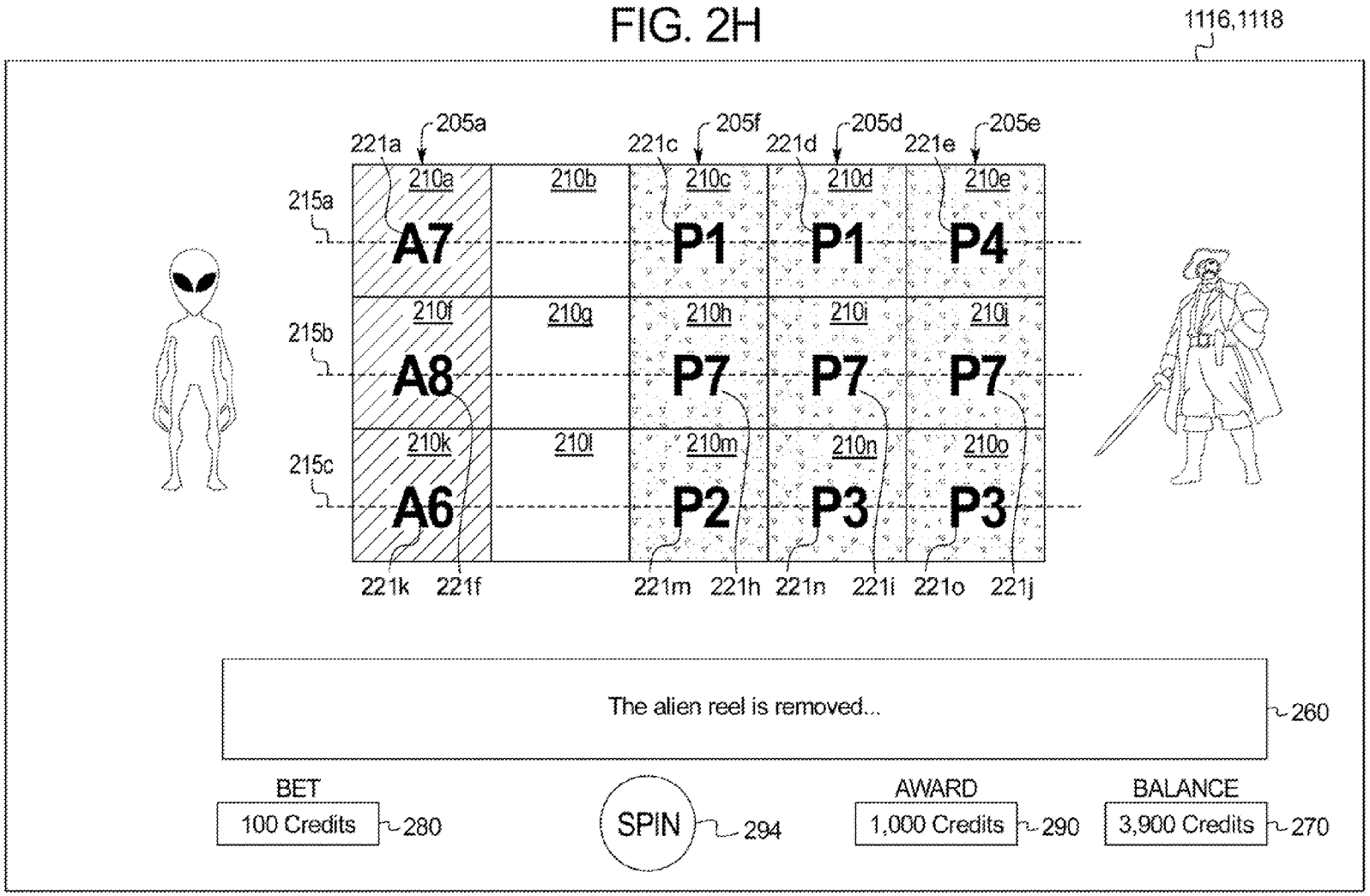
Figure 2I:
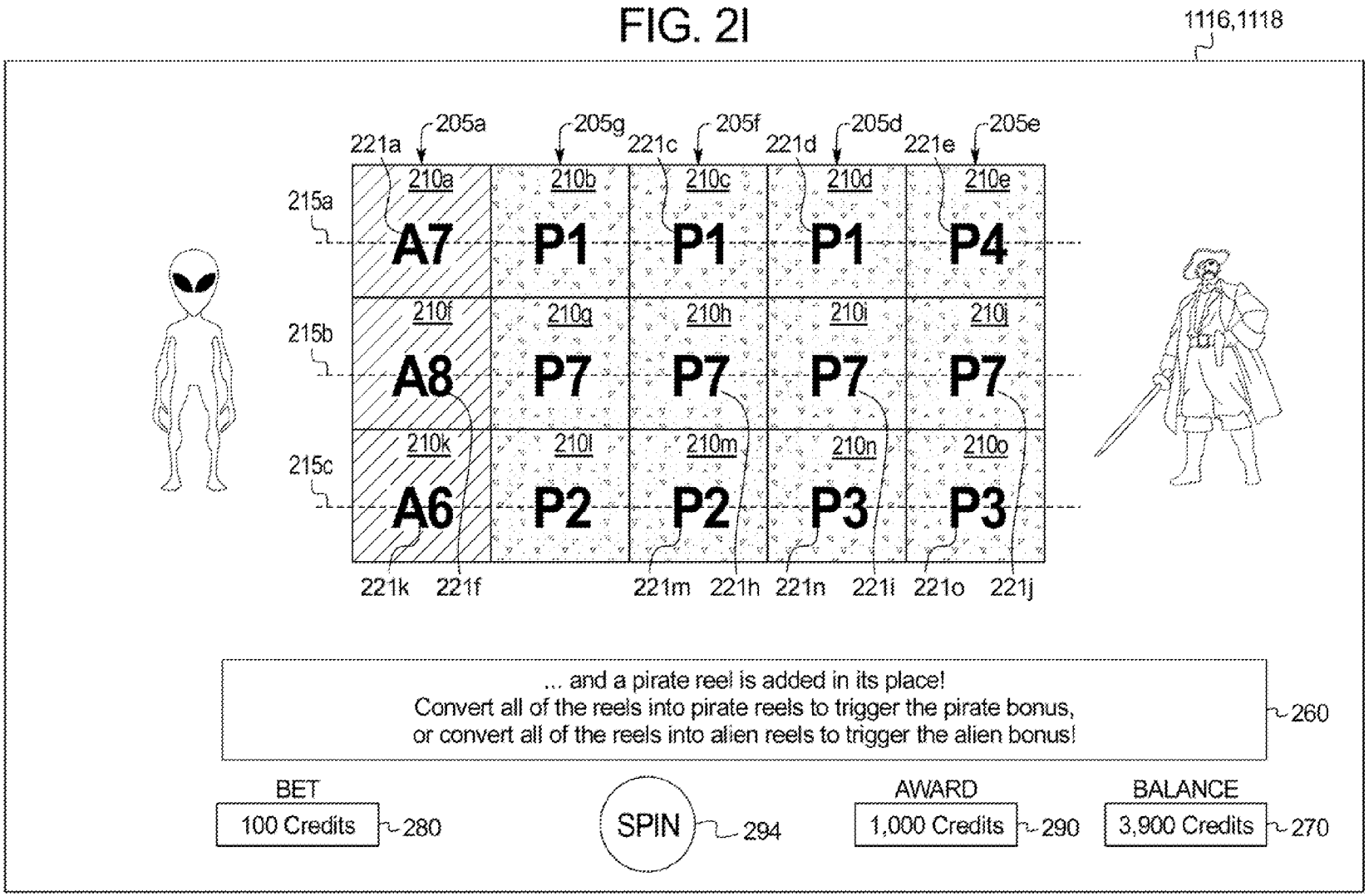

As illustrated in FIG. 2H, in this instance the leftmost reel that has the pirate theme is the reel 205*f*, and the reel that is adjacent to the reel 205*f* is the reel 205*b* (which has the alien theme). Accordingly, the gaming system removes the reel 205*b*. The gaming system displays the following message in the message box 260: "THE ALIEN REEL IS REMOVED . . . " As illustrated in FIG. 2I, the gaming system replaces the removed reel 205*b* with reel 205*g*, which has the pirate theme, such that the reel 205*g* is associated with and configured to display symbols at the symbol display areas 210*b*, 210*g*, and 210*l*. The gaming system displays the following message in the message box 260: " . . . AND A PIRATE REEL IS ADDED IN ITS PLACE! CONVERT ALL OF THE REELS INTO PIRATE REELS TO TRIGGER THE PIRATE BONUS, OR CONVERT ALL OF THE REELS INTO ALIEN REELS TO TRIGGER THE ALIEN BONUS!"

It should be appreciated that, in certain embodiments, neither reel set modification event occurs and the gaming system does not replace any reels of the set when the sum of any awards associated with any winning combinations of symbols displayed from left to right along any wagered-on paylines is equal to the sum of any awards associated with any winning combinations of symbols displayed from right to left along any wagered-on paylines. For instance, if the sum of the awards associated with the winning symbol combinations displayed from left to right along the wagered-on paylines is 250 credits and the sum of the awards associated with the winning symbol combinations displayed from right to left along the wagered-on paylines is 250 credits, the gaming system does not replace any reels of the set.

In certain embodiments, the gaming system displays a designated animation when the sum of any awards associated with any winning combinations of symbols displayed from left to right along any wagered-on paylines is equal to the sum of any awards associated with any winning combinations of symbols displayed from right to left along any wagered-on paylines.

In other embodiments, the gaming system determines that the first reel set modification event occurs in association with a play of the game when: (i) a quantity of winning combinations of symbols (if any) displayed from left to right along any wagered-on paylines is greater than a quantity of winning combinations of symbols (if any) displayed from right to left along any wagered-on paylines, and (ii) at least one of the reels of the set is not associated with the alien theme. Additionally, in these embodiments, the gaming system determines that the second reel set modification event occurs in association with a play of the game when: (i) a quantity of winning combinations of symbols (if any) displayed from right to left along any wagered-on paylines is greater than a quantity of winning combinations of symbols (if any) displayed from left to right along any wagered-on paylines, and (ii) at least one of the reels of the set is not associated with the pirate theme.

In various embodiments, the gaming system employs a single reel modification event. In these embodiments, upon an occurrence of the single reel modification event, the gaming system determines whether to: (a) replace a reel having the neutral theme or the pirate theme with a reel having the alien theme, or (b) replace a reel having the neutral theme or the alien theme with a reel having the pirate theme. It should be appreciated that the gaming system may determine which of (a) and (b) to provide in any suitable manner, such as randomly.

In another embodiment, instead of removing a reel having a characteristic other than the first characteristic and replacing that reel with a reel having the first characteristic upon the occurrence of the first reel set modification event, the gaming system changes the characteristic of one of the reels (and any of the symbols on that reel) having a characteristic other than first characteristic to the first characteristic (e.g., the gaming system changes a reel having the pirate theme into a reel having the alien theme). Put differently, the gaming system maintains the symbols associated with that reel and changes the characteristic with which that reel and those symbols are associated to the first characteristic. Similarly, in this embodiment, instead of removing a reel having a characteristic other than the second characteristic and replacing that reel with a reel having the second characteristic upon the occurrence of the second reel set modification event, the gaming system changes the characteristic of one of the reels (and any of the symbols on that reel) having a characteristic other than second characteristic to the second characteristic (e.g., the gaming system changes a reel having the alien theme into a reel having the pirate theme). Put differently, the gaming system maintains the symbols associated with that reel and changes the characteristic with which that reel and those symbols are associated to the second characteristic.

Battling Symbol Generators Game with Symbol Generator Removal, Repositioning, and Addition In various embodiments, the symbol generators are reels. In certain such embodiments, as noted above, if the gaming system determines that the first reel set modification event occurs in association with a play of the game, the gaming system modifies the set of reels such that a third quantity of the reels of the set are each associated with the first characteristic, wherein the third quantity is greater than the first quantity. In certain embodiments, the gaming system does so by: (a) removing at least one of the reels that is not associated with the first characteristic from the set, (b) repositioning at least one of the reels in the set, and (c) adding at least one reel that is associated with the first characteristic to the set.

As also noted above, in various embodiments, if the gaming system determines that the second reel set modification event occurs in association with a play of the game, the gaming system modifies the set of reels such that a fourth quantity of the reels of the set are each associated with the second characteristic, wherein the fourth quantity is greater than the second quantity. In certain embodiments, the gaming system does so by: (a) removing at least one of the reels that is not associated with the second characteristic from the set, (b) repositioning at least one of the reels in the set, and (c) adding at least one reel that is associated with the second characteristic to the set.

FIGS. 3A, 3B, 3C, 3D, 3E, 3F, 3G. 3H, and 3I illustrate screen shots of one example embodiment of the gaming system of the present disclosure providing a plurality of plays of another example embodiment of the battling reels game of the present disclosure. The battling reels game is a primary wagering game in this example embodiment. The gaming system displays a plurality of symbol display areas 310*a*, 310*b*, 310*c*, 310*d*, 310*e*, 310*f*, 310*g*, 310*h*, 310*i*, 310*j*, 310*k*, 310*l*, 310*m*, 310*n*, and 310*o* arranged in a 3×5 grid or matrix. The gaming system displays a plurality of paylines, each of which is associated with a different plurality of the symbol display areas. In this example embodiment: (a) payline 315*a* is associated with symbol display areas 310*a*, 310*b*, 310*c*, 310*d*, and 310*e*; (b) payline 315*b* is associated with symbol display areas 310*f*, 310*g*, 310*h*, 310*i*, and 310*j*; and (c) payline 315*c* is associated with symbol display areas 310*k*, 310*l*, 310*m*, 310*n*, and 310*o*.

The gaming system also displays: (a) a message box 360 (described above); (b) a plurality of meters including: (i) a credit meter 370 (described above), (ii) a wager or bet meter 380 (described above), and (iii) an award meter 390 (described above); and (c) a Spin button 394 (described above).

In this example embodiment, the game is associated with a plurality of symbols and a plurality of reels (i.e., symbol generators in this example embodiment). Here: (a) each of the plurality of reels is associated with two or more of the plurality of symbols; (b) each reel is associated with or has one of a plurality of different themes (i.e., characteristics in this example embodiment) and includes a background associated with that theme; and (c) at least three of the reels are associated with different themes. In this example embodiment, the themes (and their associated backgrounds) include: (a) a first alien theme (associated with a hatched background), (b) a second pirate theme (associated with a dotted background), and (c) a third neutral theme (associated with a blank background). Additionally, in this example embodiment, for each reel, one or more of the symbols associated with that reel also have the theme of that reel. For instance, one or more of the symbols associated with a reel having the alien theme also have the alien theme.

In this example embodiment, for each play of the game, the gaming system employs a set of the plurality of reels including two or more of, but fewer than all of, the plurality of reels. Here, the gaming system initially employs an initial set of the reels including reels 305*a*, 305*b*, 305*c*, 305*d*, and 305*e* for the game. The gaming system displays the reels 305*a*, 305*b*, 305*c*, 305*d*, and 305*e* from left to right in association with the plurality of symbol display areas such that each reel is configured to display symbols at one or more of the symbol display areas. More specifically, the gaming system displays: (a) the reel 305*a* in association with the symbol display areas 310*a*, 310*f*, and 310*k*; (b) the reel 305*b* in association with the symbol display areas, 310*b*, 310*g*, and 310*l*; (c) the reel 305*c* in association with the symbol display areas 310*c*, 310*h*, and 310*m*; (d) the reel 305*d* in association with the symbol display areas 310*d*. 310*i*, and 310*n*; and (e) the reel 305*e* in association with the symbol display areas 310*e*, 310*j*, and 310*o*.

In this example embodiment, the gaming system determines any awards associated with a play of the game based on the symbols displayed at the symbol display areas by determining: (a) whether any winning combinations of the symbols included in a paytable (not shown) associated with the game are displayed from left to right along any wagered-on paylines, and (b) whether any winning combinations of the symbols are displayed from right to left along any wagered-on paylines.

In this example embodiment, with respect to the initial set of reels: (a) the leftmost reels 305*a* and 305*b* of the set each have the alien theme and, therefore, each display the hatched background associated with the alien theme; (b) the middle reel 305*c* of the set has the neutral theme and, therefore, displays the blank background associated with the neutral theme; and (c) the rightmost reels 305*d* and 305*e* of the set each have the pirate theme and, therefore, each display the dotted background associated with the pirate theme. During game play, the gaming system: (a) removes one or more reels having the neutral or pirate themes, repositions one or more reels having the alien theme, and adds one or more reels having the alien theme upon an occurrence of a first reel set modification event; and (b) removes one or more reels having the neutral or alien themes, repositions one or more reels having the pirate theme, and adds one or more reels having the pirate theme upon an occurrence of a second different reel set modification event.

More specifically, in this example embodiment, the gaming system determines that the first reel set modification event occurs in association with a play of the game when: (a) a sum of any awards associated with any winning combinations of symbols displayed from left to right along any wagered-on paylines is greater than a sum of any awards associated with any winning combinations of symbols displayed from right to left along any wagered-on paylines, and (b) at least one of the reels of the set does not have the alien theme. The gaming system determines that the second reel set modification event occurs in association with a play of the game when: (a) a sum of any awards associated with any winning combinations of symbols displayed from right to left along any wagered-on paylines is greater than a sum of any awards associated with any winning combinations of symbols displayed from left to right along any wagered-on paylines, and (b) at least one of the reels of the set does not have with the pirate theme.

In this example embodiment, upon an occurrence of the first reel set modification event, the gaming system modifies the set of reels by: (a) removing the reel that is adjacent to the rightmost reel having the alien theme, (b) shifting the reels having the alien theme from left to right, and (c) adding another reel that has the alien theme such that the modified set of reels includes one more reel having the alien theme than it did before being modified. Similarly, upon an occurrence of the second reel set modification event, the gaming system modifies the set of reels by: (a) removing the reel that is adjacent to the leftmost reel having the pirate theme, (b) shifting the reels having the pirate theme from right to left, and (c) adding another reel that has the pirate theme such that the modified set of reels includes one more reel having the pirate theme than it did before being modified.

The gaming system is configured to provide a plurality of different bonuses in this example embodiment. Specifically, the gaming system is configured to provide an alien-themed bonus and a pirate-themed bonus. Here, the gaming system provides the alien-themed bonus upon an occurrence of an alien bonus triggering event, which occurs when the gaming system modifies the set of reels such that each of the reels in the set of reels has the alien theme. The gaming system provides the pirate-themed bonus upon an occurrence of a pirate bonus triggering event, which occurs when the gaming system modifies the set of reels such that each of the reels in the set of reels has the pirate theme.

In this example embodiment, after providing the alien bonus upon an occurrence of the alien bonus triggering event or the pirate bonus upon the occurrence of the pirate bonus triggering event, the gaming system resets the set of reels to the initial set of reels.

In this example embodiment, the gaming system performs an additional award evaluation after modifying the set of reels upon the occurrence of the first reel set modification event or the second reel set modification event.

Figure 3A:
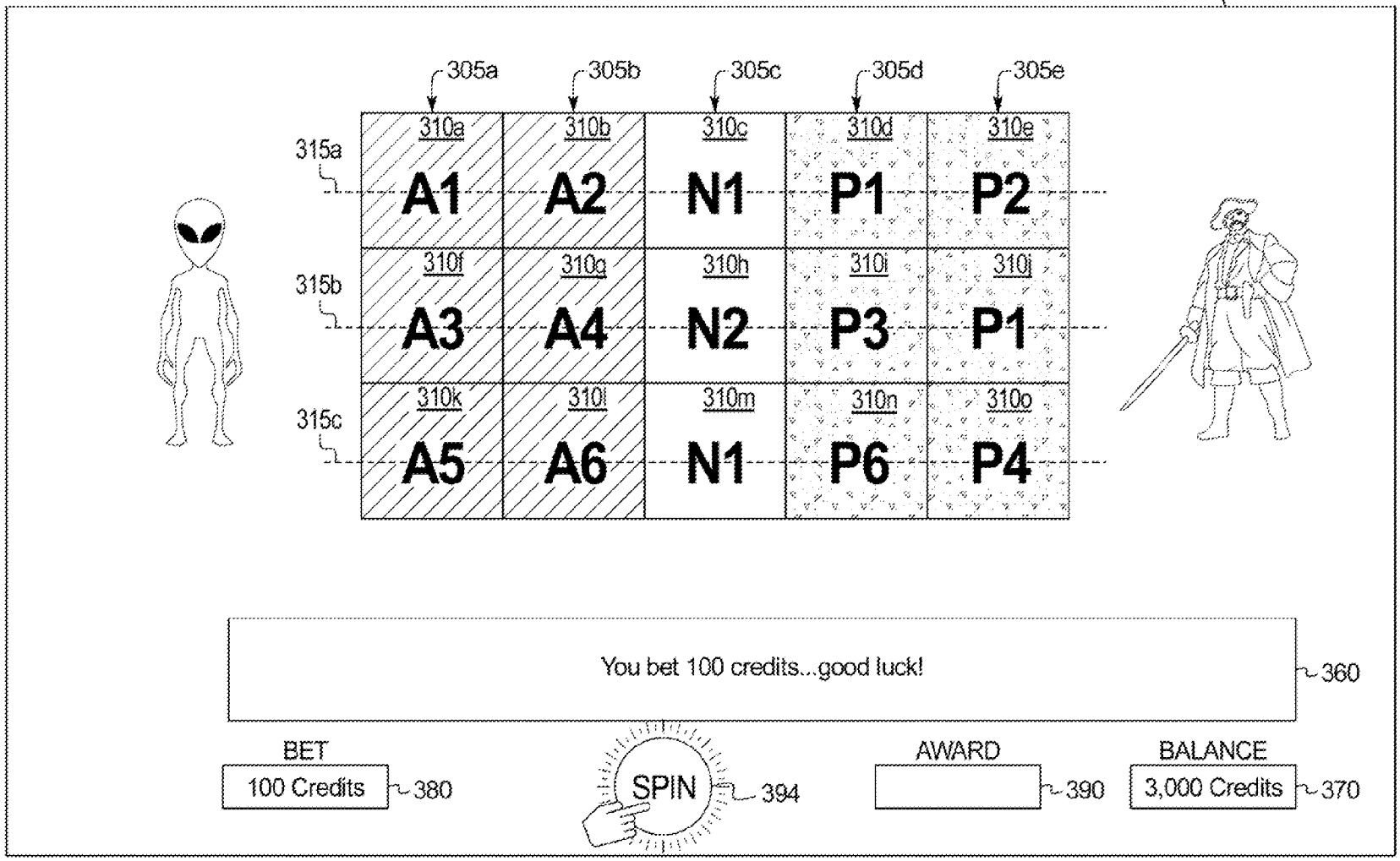
FIGS. 3A, 3B, 3C, 3D, 3E, 3F, 3G, 3H, and 3I illustrate screen shots of another example embodiment of the gaming system of the present disclosure providing a play of another example embodiment of the game of the present disclosure.
Figure 3B:
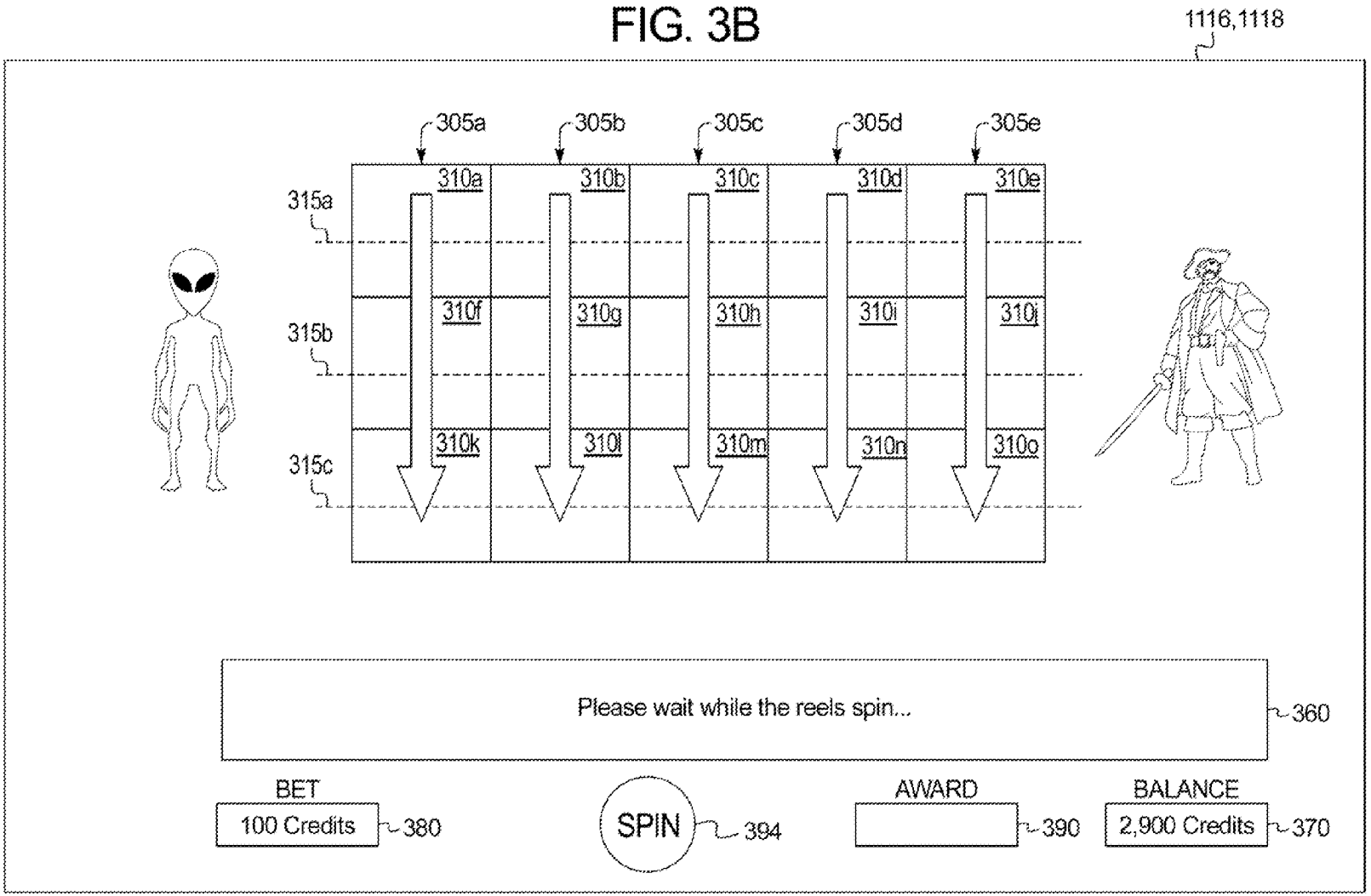

Turning to FIG. 3A, the gaming system receives a wager of 100 credits (as shown in the bet meter 380) and an actuation of the Spin button 394 from the player. Accordingly, the gaming system initiates a play of the game and spins the reels 305*a*, 305*b*, 305*c*, 305*d*, and 305*e*. The gaming system displays the following message in the message box 360: "YOU BET 100 CREDITS . . . GOOD LUCK!" As illustrated in FIG. 3B, the gaming system reduces the player's credit balance by the 100 credit wager (as shown in the credit meter 370) and displays the reels 305*a*, 305*b*, 305*c*, 305*d*, and 305*e* spinning. The gaming system displays the following message in the message box 360: "PLEASE WAIT WHILE THE REELS SPIN . . . "

Figure 3C:
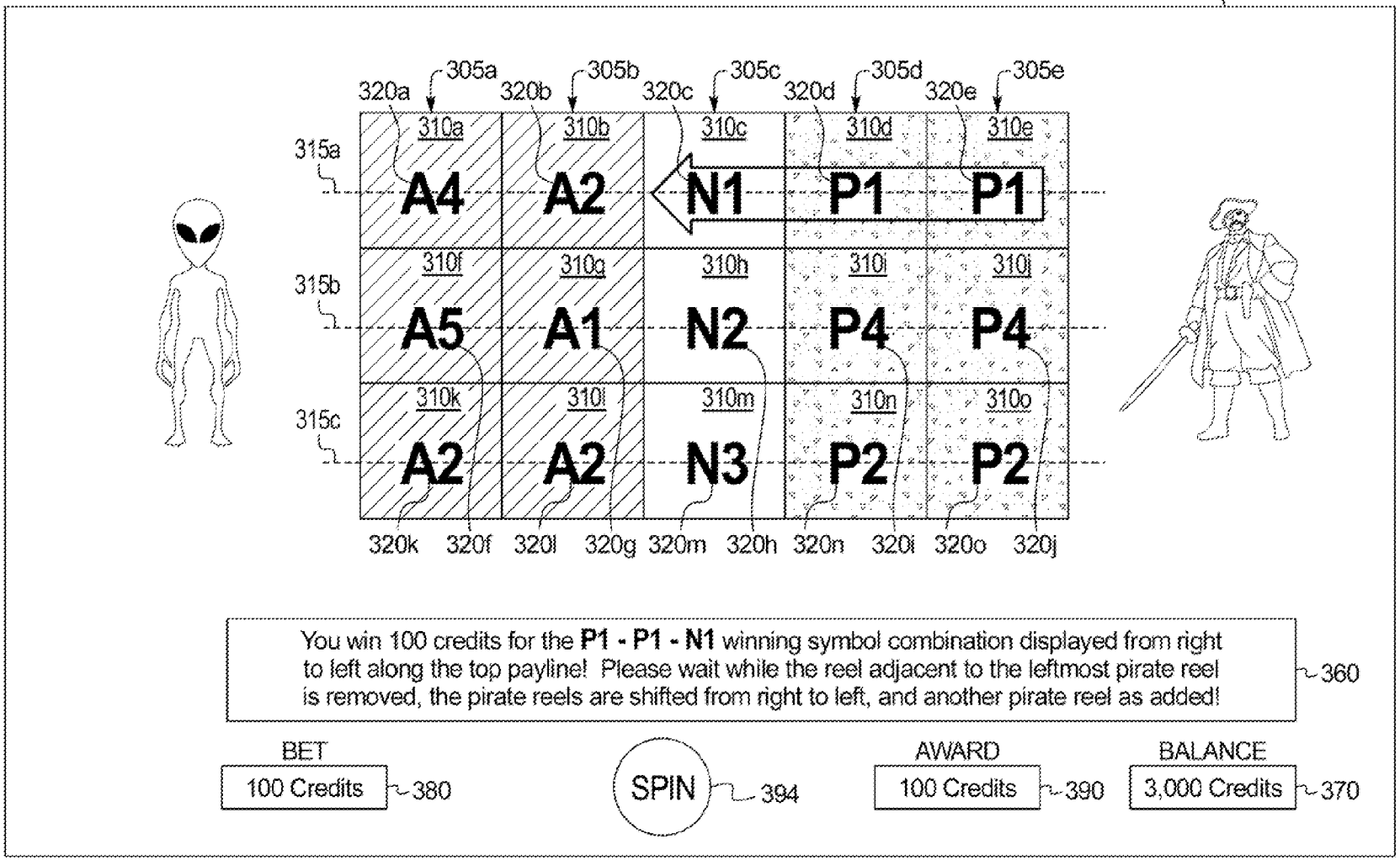

As illustrated in FIG. 3C, the gaming system stops the reels 305*a*, 305*b*, 305*c*. 305*d*, and 305*e* such that: (a) A4 symbol 320*a* is displayed at the symbol display area 310*a*, (b) A2 symbol 320*b* is displayed at the symbol display area 310*b*, (c) N1 symbol 320*c* is displayed at the symbol display area 310*c*, (d) P1 symbol 320*d* is displayed at the symbol display area 310*d*, (e) P1 symbol 320*e* is displayed at the symbol display area 310*e*, (f) A5 symbol 320*f* is displayed at the symbol display area 310*f*, (g) A1 symbol 320*g* is displayed at the symbol display area 310*g*, (h) N2 symbol 320*h* is displayed at the symbol display area 310*h*, (i) P4 symbol 320*i* is displayed at the symbol display area 310*i*, (j) P4 symbol 320*j* is displayed at the symbol display area 310*j*, (k) A2 symbol 320*k* is displayed at the symbol display area 310*k*, (l) A2 symbol 320*l* is displayed at the symbol display area 310*l*, (m) N3 symbol 320*m* is displayed at the symbol display area 310*m*, (n) P2 symbol 320*n* is displayed at the symbol display area 310*n*, and (o) P2 symbol 320*o* is displayed at the symbol display area 310*o*.

As noted above, the gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P1 320*e*, P1 320*d*, and N1 320*c* displayed from right to left along the payline 315*a* form one of the winning symbol combinations. The gaming system determines an award of 100 credits associated with the displayed P1-P1-N1 winning symbol combination, displays the 100 credit award in the award meter 390, and updates the player's credit balance to reflect the 100 credit award.

The gaming system determines whether the first reel set modification event occurred in association with the play of the game, as described above. Here, the gaming system determines that the first reel set modification event did not occur in association with the play of the game because the sum of awards (0 credits) associated with any winning combinations of symbols displayed from left to right along any wagered-on paylines (no winning symbol combinations) is not greater than the sum of awards (100 credits) associated with any winning combinations of symbols displayed from right to left along any wagered-on paylines (the P1-P1-N1 winning symbol combination).

The gaming system determines whether the second reel set modification event occurred in association with the play of the game, as described above. Here, the gaming system determines that the second reel set modification event occurred in association with the play of the game because: (a) the sum of awards (100 credits) associated with any winning combinations of symbols displayed from right to left along any wagered-on paylines (the P1-P1-N1 winning symbol combination) is greater than the sum of awards (0 credits) associated with any winning combinations of symbols displayed from left to right along any wagered-on paylines (no winning symbol combinations); and (b) the reels 305*a*, 305*b*, and 305*c* are not associated with the pirate theme.

As noted above, upon an occurrence of the second reel set modification event in this example embodiment, the gaming system modifies the set of reels by: (a) removing the reel that is adjacent to the leftmost reel having the pirate theme, (b) shifting the reels having the pirate theme from right to left, and (c) adding another reel that has the pirate theme. Thus, the modified set of reels includes one more reel having the pirate theme than it did before being modified. The gaming system displays the following message in the message box 360: "YOU WIN 100 CREDITS FOR THE P1-P1-N1 WINNING SYMBOL COMBINATION DISPLAYED FROM RIGHT TO LEFT ALONG THE TOP PAYLINE! PLEASE WAIT WHILE THE REEL ADJACENT TO THE LEFTMOST PIRATE REEL IS REMOVED, THE PIRATE REELS ARE SHIFTED FROM RIGHT TO LEFT, AND ANOTHER PIRATE REEL IS ADDED!"

Figure 3D:
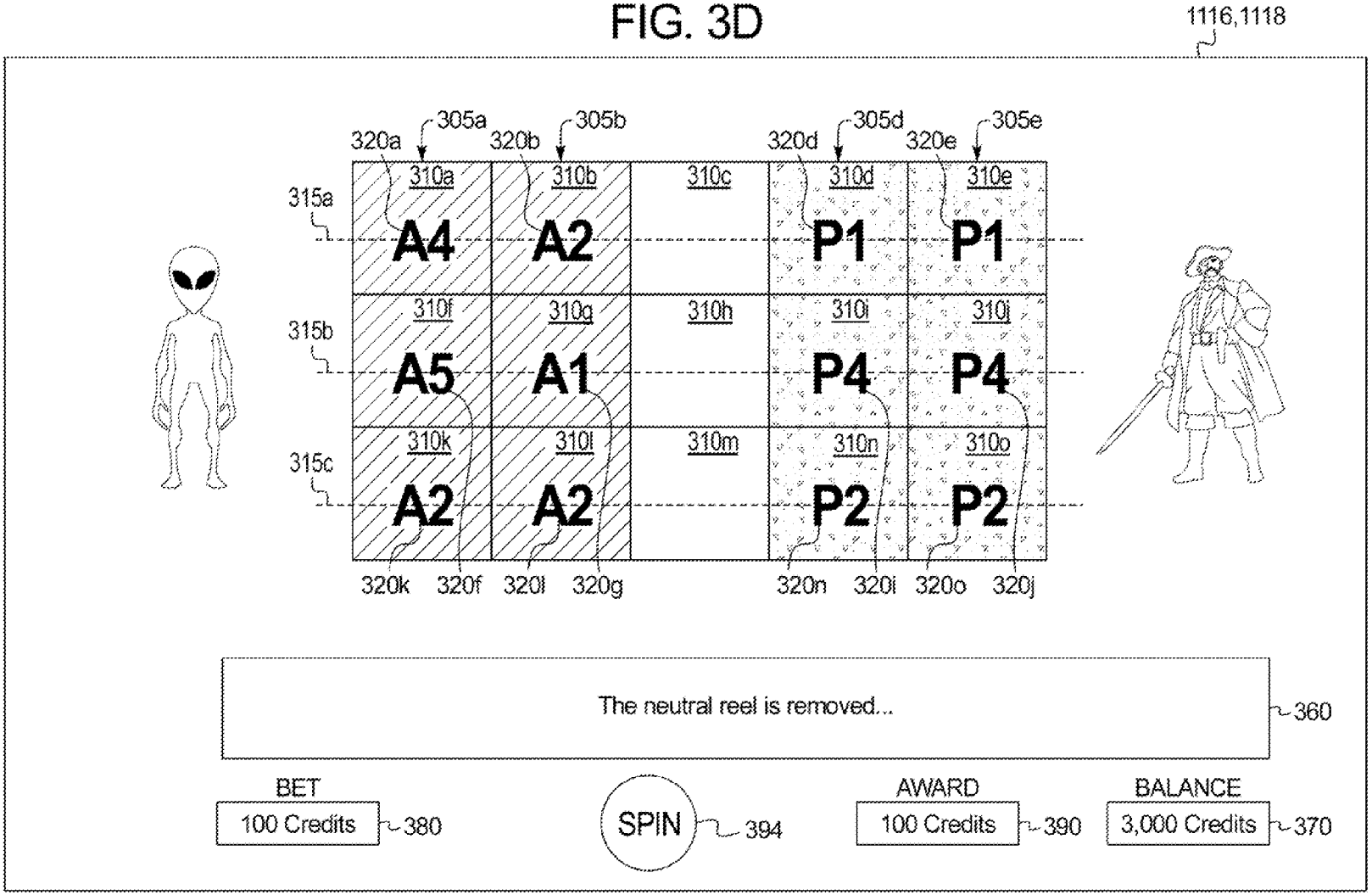
Figure 3E:
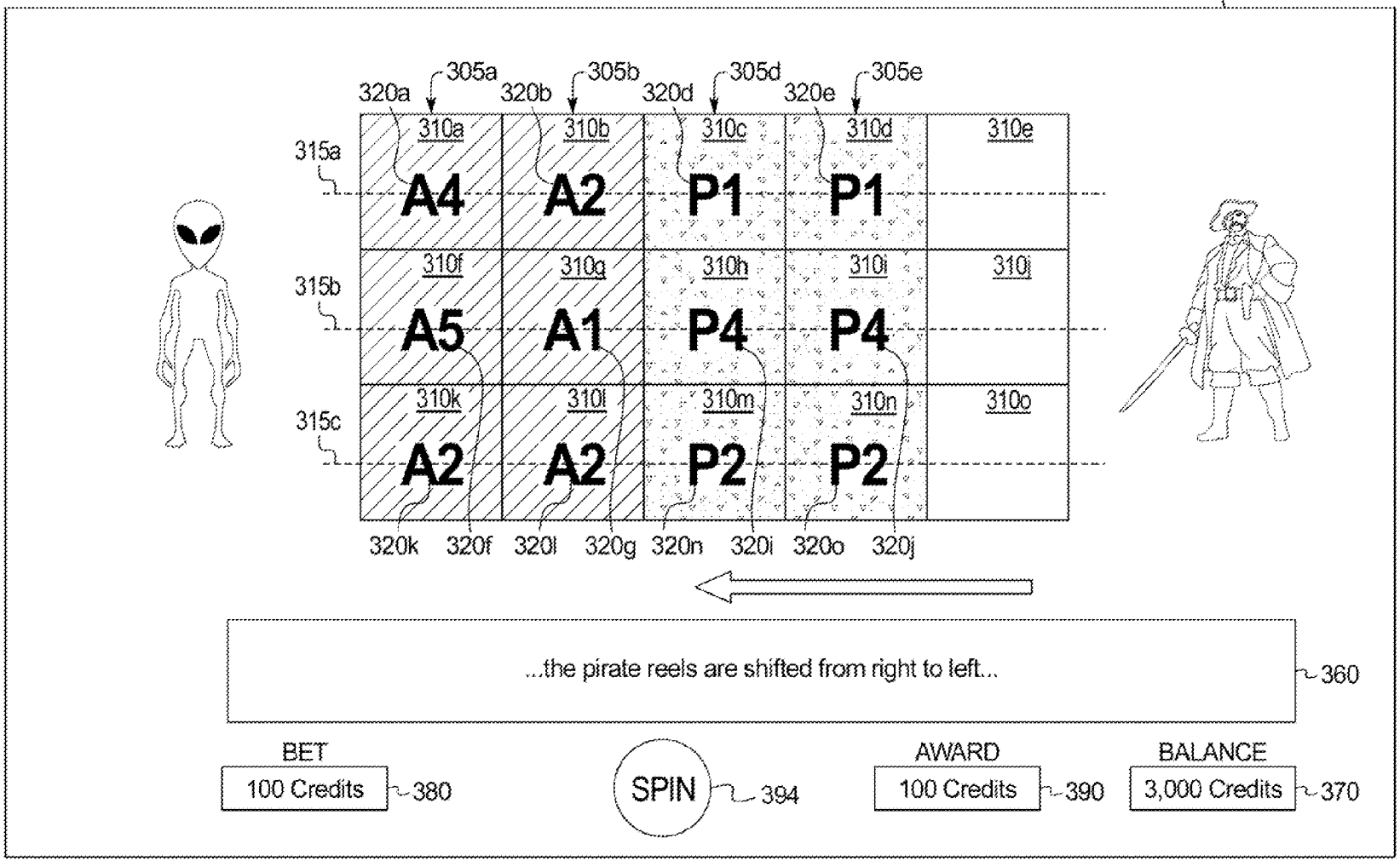

As illustrated in FIG. 3D, in this instance the leftmost reel that is associated with the pirate theme is the reel 305*d*, and the reel that is adjacent to the reel 305*d* is the reel 305*c* (which is associated with the neutral theme). Accordingly, the gaming system removes the reel 305*c*. The gaming system displays the following message in the message box 360: "THE NEUTRAL REEL IS REMOVED . . . " As illustrated in FIG. 3E, the gaming system repositions the reels 305*d* and 305*e*, which are associated with the pirate theme, by shifting those reels from right to left such that: (a) the reel 305*d* is associated with and configured to display symbols at the symbol display areas 310*c*, 310*h*, and 310*m*; and (b) the reel 305*e* is associated with and configured to display symbols at the symbol display areas 310*d*, 310*i*, and 310*n*. After repositioning the reels 305*c* and 305*d*, the P1 symbol 320*d* is displayed at the symbol display area 310*c*, the P1 symbol 320*e* is displayed at the symbol display area 310*d*, the P4 symbol 320*i* is displayed at the symbol display area 310*h*, the P4 symbol 320*j* is displayed at the symbol display area 310*i*, the P2 symbol 320*n* is displayed at the symbol display area 310*n*, and the P2 symbol 320*o* is displayed at the symbol display area 310*n*. The gaming system displays the following message in the message box 360: " . . . THE PIRATE REELS ARE SHIFTED FROM RIGHT TO LEFT . . . "

Figure 3F:
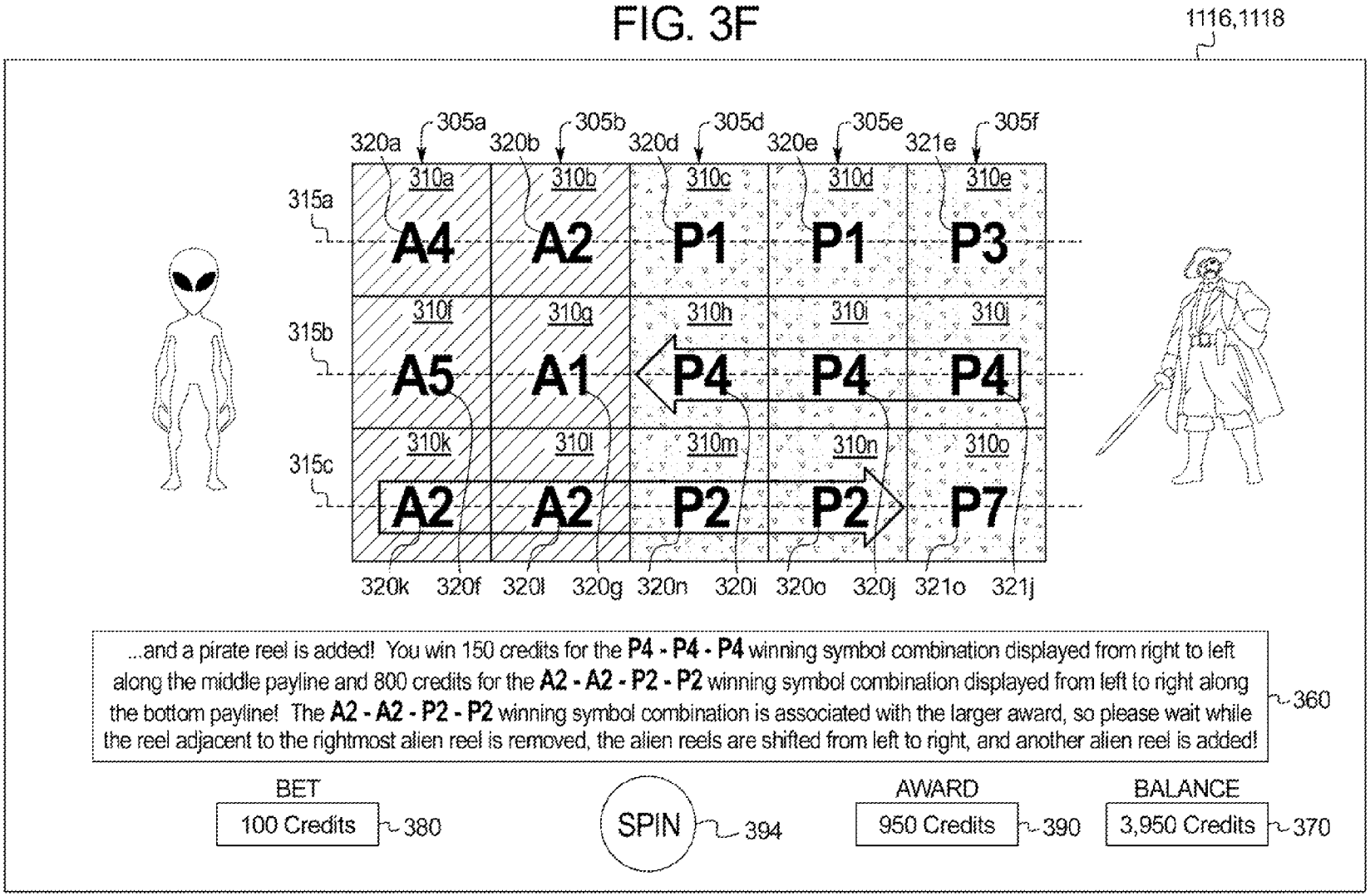

As illustrated in FIG. 3F, the gaming system adds reel 305*f*, which is associated with the pirate theme, to the set such that the reel 305*f* is associated with and configured to display symbols at the symbol display areas 310*e*, 310*j*, and 310*o*. Specifically, the gaming system adds the reel 305*f* to the set such that P3 symbol 321*e* is displayed at the symbol display area 310*e*, P4 symbol 321*j* is displayed at the symbol display area 310*j*, and P7 symbol 321*o* is displayed at the symbol display area 310*o*. In this example embodiment, the gaming system makes another award determination after modifying the set of reels.

As noted above, the gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that: (a) the symbols P4 321*j*, P4 320*j*, and P4 310*i* displayed from right to left along the payline 315*b* form one of the winning symbol combinations; and (b) the symbols A2 320*k*, A2 320*l*, P2 320*n*, and P2 320*o* displayed from left to right along the payline 315*c* form one of the winning symbol combinations. The gaming system determines an award of 150 credits associated with the displayed P4-P4-P4 winning symbol combination and an award of 800 credits associated with the displayed A2-A2-P2-P2 winning symbol combination, displays the total award of 950 credits in the award meter 390, and updates the player's credit balance to reflect the total award of 950 credits.

The gaming system determines whether the first reel set modification event occurred in association with the play of the game, as described above. Here, the gaming system determines that the first reel set modification event occurred in association with the play of the game because: (a) the sum of awards (800 credits) associated with any winning combinations of symbols displayed from left to right along any wagered-on paylines (the A2-A2-P2-P2 winning symbol combination) is greater than the sum of awards (150 credits) associated with any winning combinations of symbols displayed from right to left along any wagered-on paylines (the P4-P4-P4 winning symbol combination); and (b) the reels 305*d*, 305*e*, and 305*f* are not associated with the alien theme.

The gaming system determines whether the second reel set modification event occurred in association with the play of the game, as described above. Here, the gaming system determines that the second reel set modification event did not occur in association with the play of the game because the sum of awards (150 credits) associated with any winning combinations of symbols displayed from right to left along any wagered-on paylines (the P4-P4-P4 winning symbol combination) is not greater than the sum of awards (800 credits) associated with any winning combinations of symbols displayed from left to right along any wagered-on paylines (the A2-A2-P2-P2 winning symbol combination).

As noted above, upon an occurrence of the first reel set modification event in this example embodiment, the gaming system modifies the set of reels by: (a) removing the reel that is adjacent to the rightmost reel having the alien theme, (b) shifting the reels having the alien theme from left to right, and (c) adding another reel that has the alien theme. Thus, the modified set of reels includes one more reel having the alien theme than it did before being modified. The gaming system displays the following message in the message box 360: "... AND A PIRATE REEL IS ADDED! YOU WIN 150 CREDITS FOR THE P4-P4-P4 WINNING SYMBOL COMBINATION DISPLAYED FROM RIGHT TO LEFT ALONG THE MIDDLE PAYLINE AND 800 CREDITS FOR THE A2-A2-P2-P2 WINNING SYMBOL COMBINATION DISPLAYED FROM LEFT TO RIGHT ALONG THE BOTTOM PAYLINE! THE A2-A2-P2-P2 WINNING SYMBOL COMBINATION IS ASSOCIATED WITH THE LARGER AWARD, SO PLEASE WAIT THE REEL ADJACENT TO THE RIGHTMOST ALIEN REEL IS REMOVED, THE ALIEN REELS ARE SHIFTED FROM LEFT TO RIGHT, AND ANOTHER ALIEN REEL IS ADDED!"

Figure 3G:
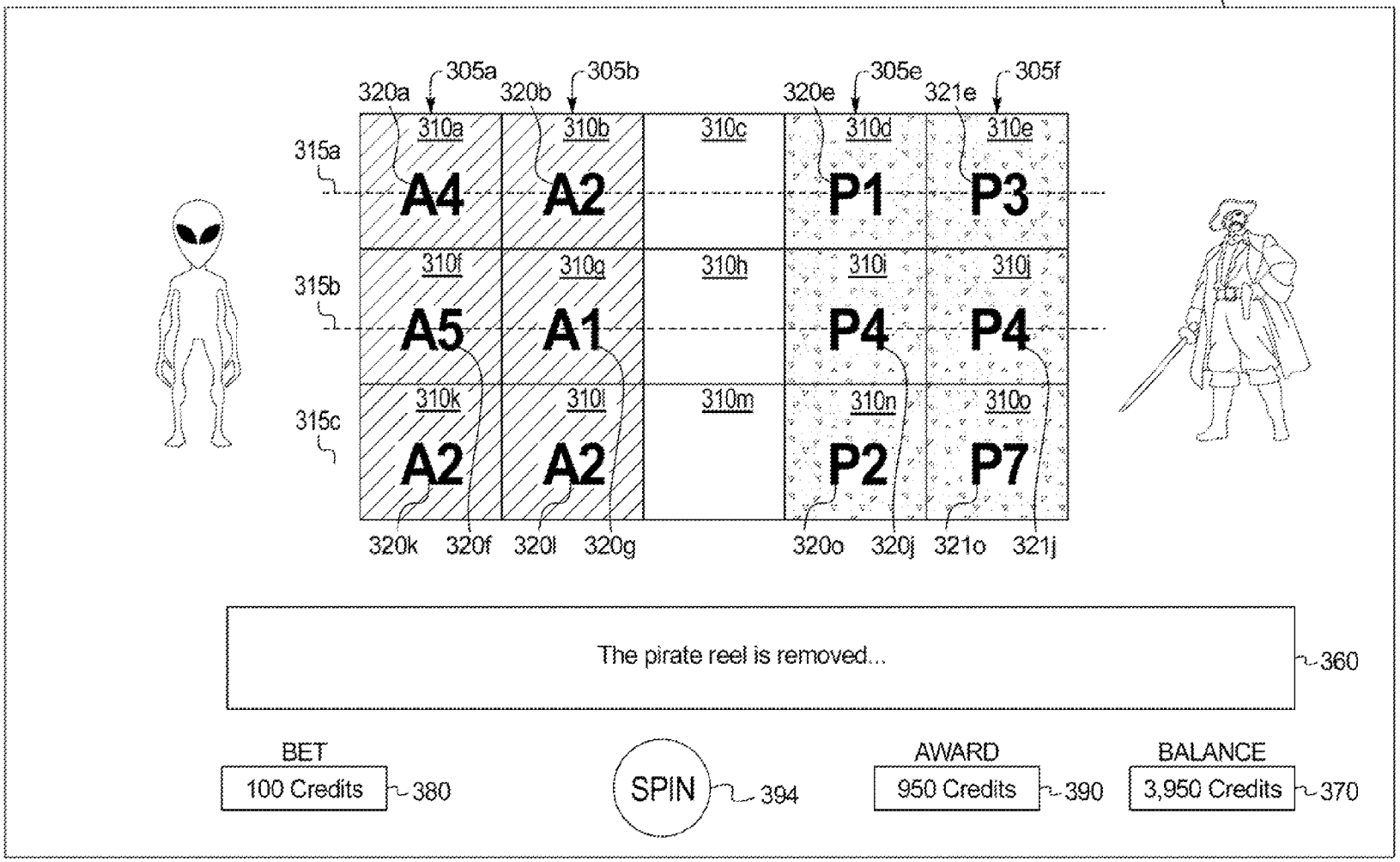
Figure 3H:
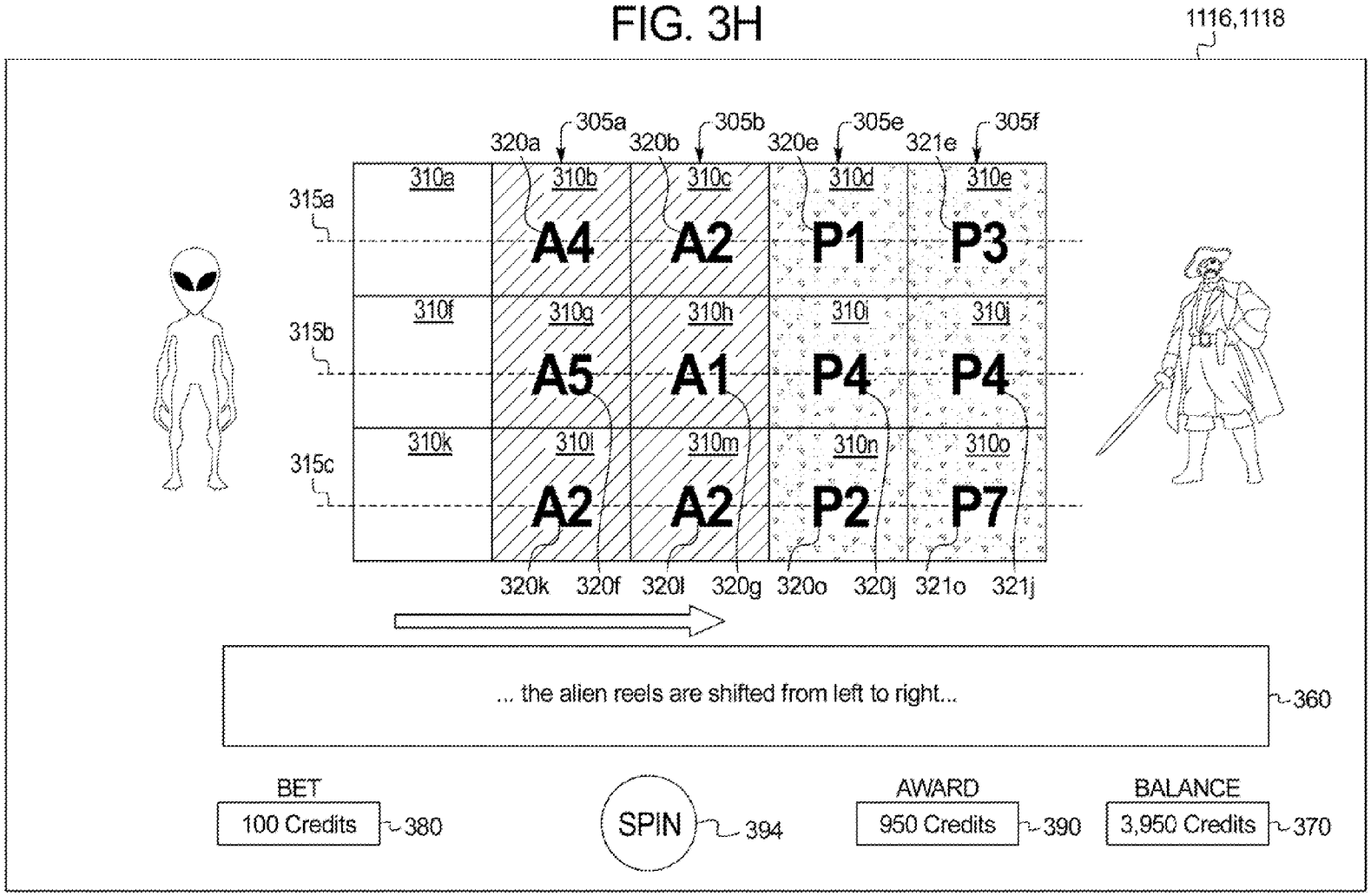

As illustrated in FIG. 3G, in this instance the rightmost reel that has the alien theme is the reel 305*b*, and the reel that is adjacent to the reel 305*b* is the reel 305*d* (which has the pirate theme). Accordingly, the gaming system removes the reel 305*d*. The gaming system displays the following message in the message box 360: "THE PIRATE REEL IS REMOVED . . . " As illustrated in FIG. 3H, the gaming system repositions the reels 305*a* and 305*b*, which have the alien theme, by shifting those reels from left to right such that: (a) the reel 305*a* is associated with and configured to display symbols at the symbol display areas 310*b*, 310*g*, and 310*l*; and (b) the reel 305*b* is associated with and configured to display symbols at the symbol display areas 310*c*, 310*h*, and 310*m*. After repositioning the reels 305*a* and 305*b*, the A4 symbol 320*a* is displayed at the symbol display area 310*b*, the A2 symbol 320*b* is displayed at the symbol display area 310*c*, the A5 symbol 320*f* is displayed at the symbol display area 310*g*, the A1 symbol 320*g* is displayed at the symbol display area 310*h*, the A2 symbol 320*k* is displayed at the symbol display area 310*l*, and the A2 symbol 320*l* is displayed at the symbol display area 310*m*. The gaming system displays the following message in the message box 360: "... THE ALIEN REELS ARE SHIFTED FROM LEFT TO RIGHT . . . "

Figure 3I:
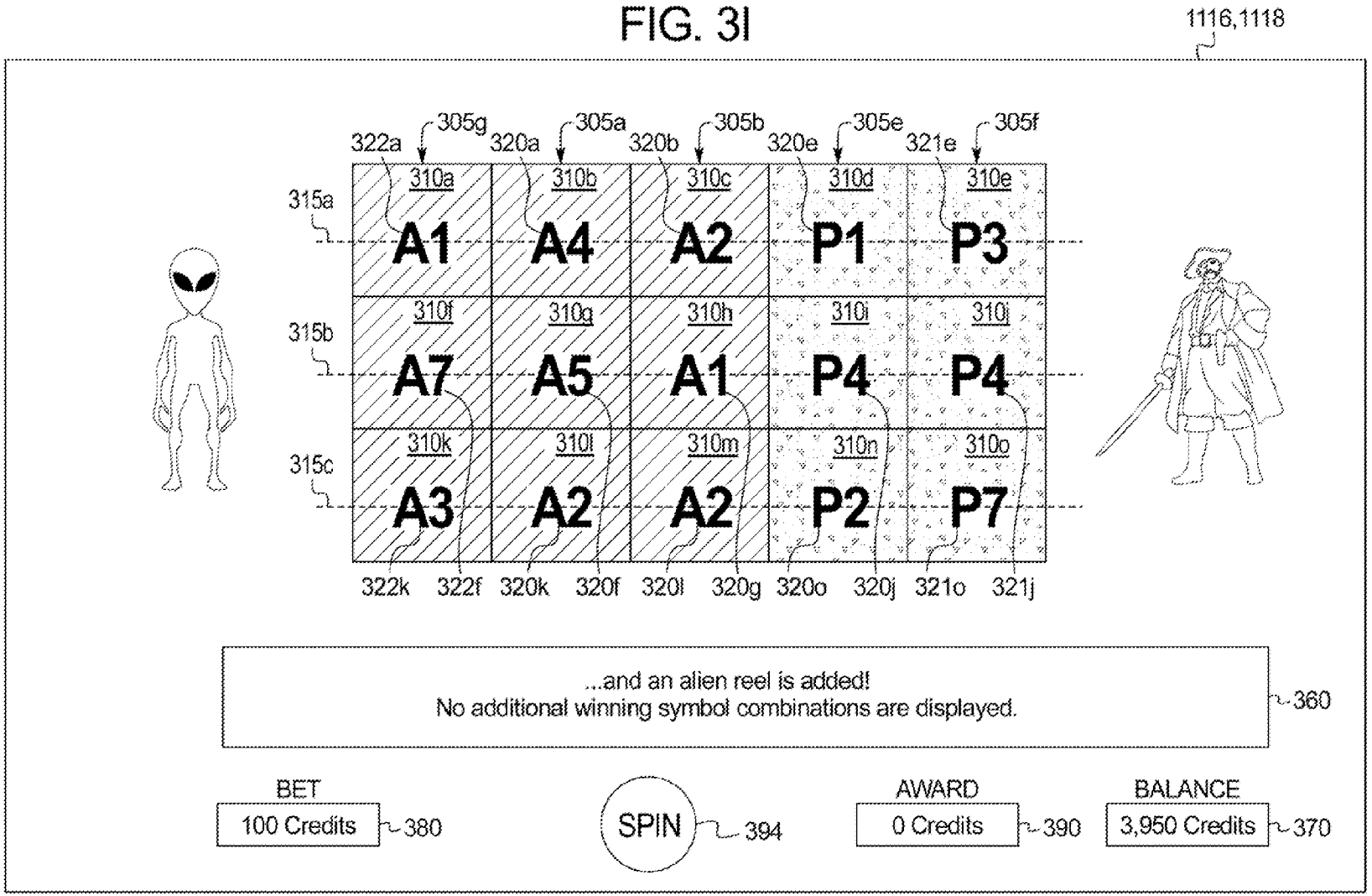

As illustrated in FIG. 3I, the gaming system adds reel 305*g*, which has the alien theme, to the set such that the reel 305*g* is associated with and configured to display symbols at the symbol display areas 310*a*, 310*f*, and 310*k*. Specifically, the gaming system adds the reel 305*g* to the set such that A1 symbol 322*a* is displayed at the symbol display area 310*a*, A7 symbol 322*f* is displayed at the symbol display area 310*f*, and A3 symbol 322*k* is displayed at the symbol display area 310*k*. In this example embodiment, the gaming system makes another award determination after modifying the set of reels.

The gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that none of the winning symbol combinations are displayed along any of the paylines. The gaming system displays the following message in the message box 360: " . . . AND AN ALIEN REEL IS ADDED! NO ADDITIONAL WINNING SYMBOL COMBINATIONS ARE DISPLAYED."

It should be appreciated that, in certain embodiments, neither reel set modification event occurs and the gaming system does not remove any reels from the set, reposition any reels of the set, or add any reels to the set when the sum of any awards associated with any winning combinations of symbols displayed from left to right along any wagered-on paylines is equal to the sum of any awards associated with any winning combinations of symbols displayed from right to left along any wagered-on paylines.

In certain embodiments, the gaming system displays a designated animation when the sum of any awards associated with any winning combinations of symbols displayed from left to right along any wagered-on paylines is equal to the sum of any awards associated with any winning combinations of symbols displayed from right to left along any wagered-on paylines.

In other embodiments, the gaming system determines that the first reel set modification event occurs in association with a play of the game when: (i) a quantity of winning combinations of symbols (if any) displayed from left to right along any wagered-on paylines is greater than a quantity of winning combinations of symbols (if any) displayed from right to left along any wagered-on paylines, and (ii) at least one of the reels of the set is not associated with the alien theme. Additionally, in these embodiments, the gaming system determines that the second reel set modification event occurs in association with a play of the game when: (i) a quantity of winning combinations of symbols (if any) displayed from right to left along any wagered-on paylines is greater than a quantity of winning combinations of symbols (if any) displayed from left to right along any wagered-on paylines, and (ii) at least one of the reels of the set is not associated with the pirate theme.

Battling Symbol Generators Game with Symbol Generator Replacement During a Designated Period FIGS. 4A, 4B, 4C, 4D, 4E, 4F, 4G, 4H, and 4I illustrate screen shots of one example embodiment of the gaming system of the present disclosure providing a plurality of plays of another example embodiment of the battling symbol generators game of the present disclosure. The battling symbol generators game is a primary wagering game in this example embodiment. The gaming system displays a plurality of symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, and 410*o* arranged in a 3×5 grid or matrix. The gaming system displays a plurality of paylines, each of which is associated with a different plurality of the symbol display areas. In this example embodiment: (a) payline 415*a* is associated with symbol display areas 410*a*, 410*b*, 410*c*, 410*d*, and 410*e*; (b) payline 415*b* is associated with symbol display areas 410*f*, 410*g*, 410*h*, 410*i*, and 410*j*; and (c) payline 415*c* is associated with symbol display areas 410*k*, 410*l*, 410*m*, 410*n*, and 410*o*.

The gaming system also displays: (a) a message box 460 (described above); (b) a plurality of meters including: (i) a credit meter 470 (described above), (ii) a wager or bet meter 480 (described above), and (iii) an award meter 490 (described above); and (c) a Spin button 494 (described above).

In this example embodiment, the game is associated with a plurality of symbols and a plurality of reels (i.e., symbol generators in this example embodiment). Here: (a) each of the plurality of reels is associated with two or more of the plurality of symbols; (b) each reel is associated with or has one of a plurality of different themes (i.e., characteristics in this example embodiment) and includes a background associated with that theme; and (c) at least three of the reels are associated with different themes. In this example embodiment, the themes (and their associated backgrounds) include: (a) a first alien theme (associated with a hatched background), (b) a second pirate theme (associated with a dotted background), and (c) a third neutral theme (associated with a blank background). Additionally, in this example embodiment, for each reel, one or more of the symbols associated with that reel also have the theme of that reel. For instance, one or more of the symbols on a reel having the alien theme also have the alien theme.

In this example embodiment, for each play of the game, the gaming system employs a set of the plurality of reels including two or more of, but fewer than all of, the plurality of reels. Here, the gaming system initially selects and employs an initial set of the reels including reels 405*a*, 405*b*, 405*c*, 405*d*, and 405*e* for the game. The gaming system displays the reels 405*a*, 405*b*, 405*c*, 405*d*, and 405*e* from left to right in association with the plurality of symbol display areas such that each reel is configured to display symbols at one or more of the symbol display areas. More specifically, the gaming system displays: (a) the reel 405*a* in association with the symbol display areas 410*a*, 410*f*, and 410*k*; (b) the reel 405*b* in association with the symbol display areas, 410*b*, 410*g*, and 410*l*; (c) the reel 405*c* in association with the symbol display areas 410*c*, 410*h*, and 410*m*; (d) the reel 405*d* in association with the symbol display areas 410*d*, 410*i*, and 410*n*; and (e) the reel 405*e* in association with the symbol display areas 410*e*, 410*j*, and 410*o*.

In this example embodiment, the gaming system determines any awards associated with a play of the game based on the symbols displayed at the symbol display areas by determining: (a) whether any winning combinations of the symbols included in a paytable (not shown) associated with the game are displayed from left to right along any wagered-on paylines, and (b) whether any winning combinations of the symbols are displayed from right to left along any wagered-on paylines.

In this example embodiment, with respect to the initial set of reels: (a) the leftmost reels 405*a* and 405*b* of the initial set each have the alien theme and, therefore, each display the hatched background associated with the alien theme; (b) the middle reel 405*c* of the initial set has the neutral theme and, therefore, displays the blank background associated with the neutral theme; and (c) the rightmost reels 405*d* and 405*e* of the initial set each have the pirate theme and, therefore, each display the dotted background associated with the pirate theme.

In this example embodiment, the gaming system enables the set of reels to be modified during a designated period. The gaming system initiates the designated period upon an occurrence of either an alien timer activation event or a pirate timer activation event. More specifically, when the alien timer initiation event occurs, the gaming system initiates the designated period and enables the set of reels to be modified during the designated period to include more reels associated with the alien theme. When the pirate timer initiation event occurs, the gaming system initiates the designated period and enables the set of reels to be modified during the designated period to include more reels associated with the pirate theme.

In this example embodiment, the alien timer initiation event occurs when: (a) neither the alien timer nor the pirate timer is already active, and (b) a first reel set modification event occurs. In this example embodiment, the first reel set modification event occurs when a sum of any awards associated with any winning combinations of symbols displayed from left to right along any wagered-on paylines is greater than a sum of any awards associated with any winning combinations of symbols displayed from right to left along any wagered-on paylines. When the alien timer initiation event occurs, the gaming system: (a) modifies the set of reels by removing the reel that is adjacent to the rightmost reel associated with the alien theme and replacing it with another reel that is associated with the alien theme such that the modified set of reels includes one more reel associated with the alien theme than it did before being modified, and (b) activates an alien timer associated with the designated period.

In this example embodiment, the pirate timer initiation event occurs when: (a) neither the alien timer nor the pirate timer is already active, and (b) a second reel set modification event occurs. In this example embodiment, the second reel set modification event occurs when a sum of any awards associated with any winning combinations of symbols displayed from right to left along any wagered-on paylines is greater than a sum of any awards associated with any winning combinations of symbols displayed from left to right along any wagered-on paylines. When the pirate timer initiation event occurs, the gaming system: (a) modifies the set of reels by removing the reel that is adjacent to the leftmost reel associated with the pirate theme and replacing it with another reel that is associated with the pirate theme such that the modified set of reels includes one more reel associated with the pirate theme than it did before being modified, and (b) activates a pirate timer associated with the designated period.

In this example embodiment, while the alien timer is active, the gaming system disables the second reel set modification event. In other words, when the alien timer is active for a play of the game, the gaming system does not determine whether the second reel set modification event occurred for that play of the game. Additionally, while the pirate timer is active, the gaming system disables the first reel set modification event. In other words, when the pirate timer is active for a play of the game, the gaming system does not determine whether the first reel set modification event occurred for that play of the game. It should thus be appreciated that, in this example embodiment: (a) while the alien timer is active, the gaming system enables the reel set to be modified by replacing one or more reels associated with the neutral theme or the pirate theme with one or more reels associated with the alien theme and does not enable the reel set to be modified by replacing any reels associated with the neutral theme or the alien theme with any reels associated with the pirate theme, and (b) while the pirate timer is active, the gaming system enables the reel set to be modified by replacing one or more reels associated with the neutral theme or the alien theme with one or more reels associated with the pirate theme and does not enable the reel set to be modified by replacing any reels associated with the neutral theme or the pirate theme with any reels associated with the alien theme.

The gaming system is configured to provide a plurality of different bonuses in this example embodiment. Specifically, the gaming system is configured to provide an alien-themed bonus and a pirate-themed bonus. Here, the gaming system provides the alien-themed bonus upon an occurrence of an alien bonus triggering event, which occurs when the gaming system modifies the set of reels such that each of the reels in the set of reels has the alien theme. The gaming system provides the pirate-themed bonus upon an occurrence of a pirate bonus triggering event, which occurs when the gaming system modifies the set of reels such that each of the reels in the set of reels has the pirate theme.

In this example embodiment, when the designated period expires, the gaming system deactivates whichever timer is active and resets the set of reels to the initial set of reels. Further, in this example embodiment, after providing the alien bonus upon an occurrence of the alien bonus triggering event or the pirate bonus upon an occurrence of the pirate bonus triggering event, the gaming system resets the set of reels to the initial set of reels.

Additionally, in this example embodiment, the gaming system increases the designated period (such as by adding an amount of time or a quantity of plays to the designated period) when a timer increase event occurs. In this example embodiment, when the alien timer is active, the timer increase event occurs when the first reel set modification event occurs. Similarly, when the pirate timer is active, the timer increase event occurs when the second reel set modification event occurs. It should be appreciated that, in other embodiments, the gaming system does not increase the designated period after initiating the designated period.

Figure 4A:
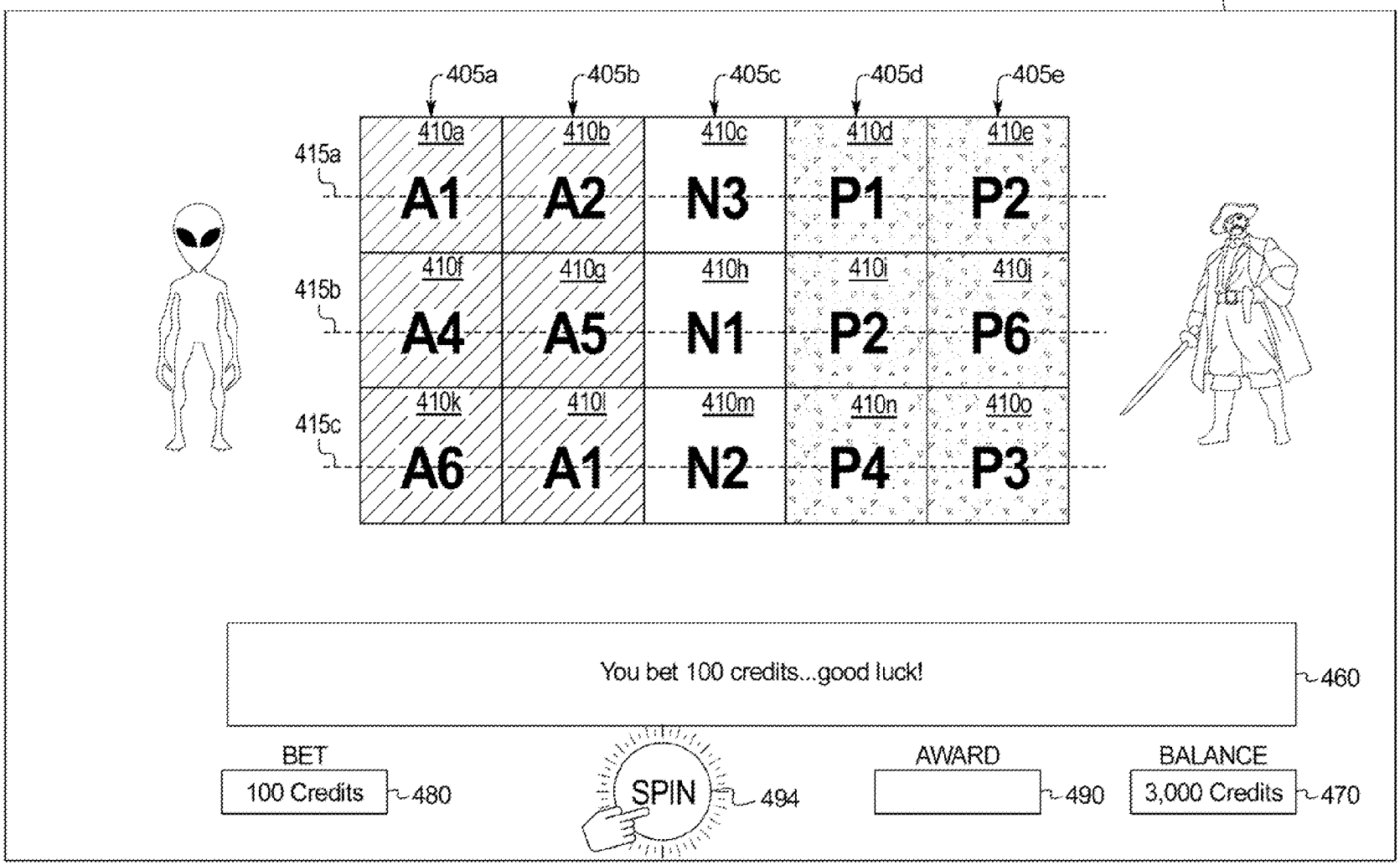
FIGS. 4A, 4B, 4C, 4D, 4E, 4F, 4G, 4H, and 4I illustrate screen shots of another example embodiment of the gaming system of the present disclosure providing a plurality of plays of another example embodiment of the game of the present disclosure.
Figure 4B:
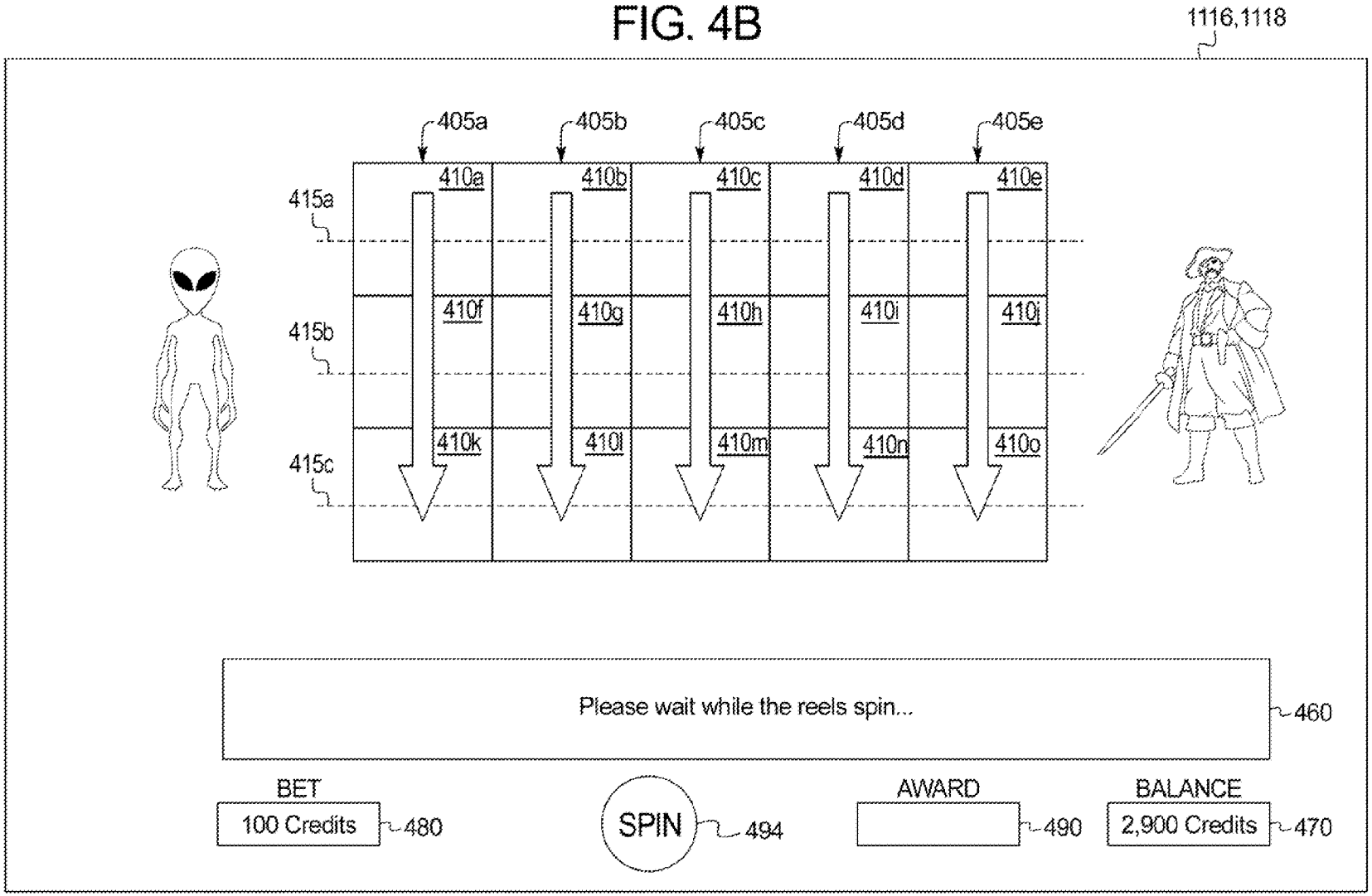

Turning to FIG. 4A, the gaming system receives a wager of 100 credits (as shown in the bet meter 480) and an actuation of the Spin button 494 from the player. Accordingly, the gaming system initiates a play of the game and spins the reels 405*a*, 405*b*, 405*c*, 405*d*, and 405*e*. The gaming system displays the following message in the message box 460: "YOU BET 100 CREDITS . . . GOOD LUCK!" As illustrated in FIG. 4B, the gaming system reduces the player's credit balance by the 100 credit wager (as shown in the credit meter 470) and displays the reels 405*a*, 405*b*, 405*c*, 405*d*, and 405*e* spinning. The gaming system displays the following message in the message box 460: "PLEASE WAIT WHILE THE REELS SPIN . . . "

Figure 4C:
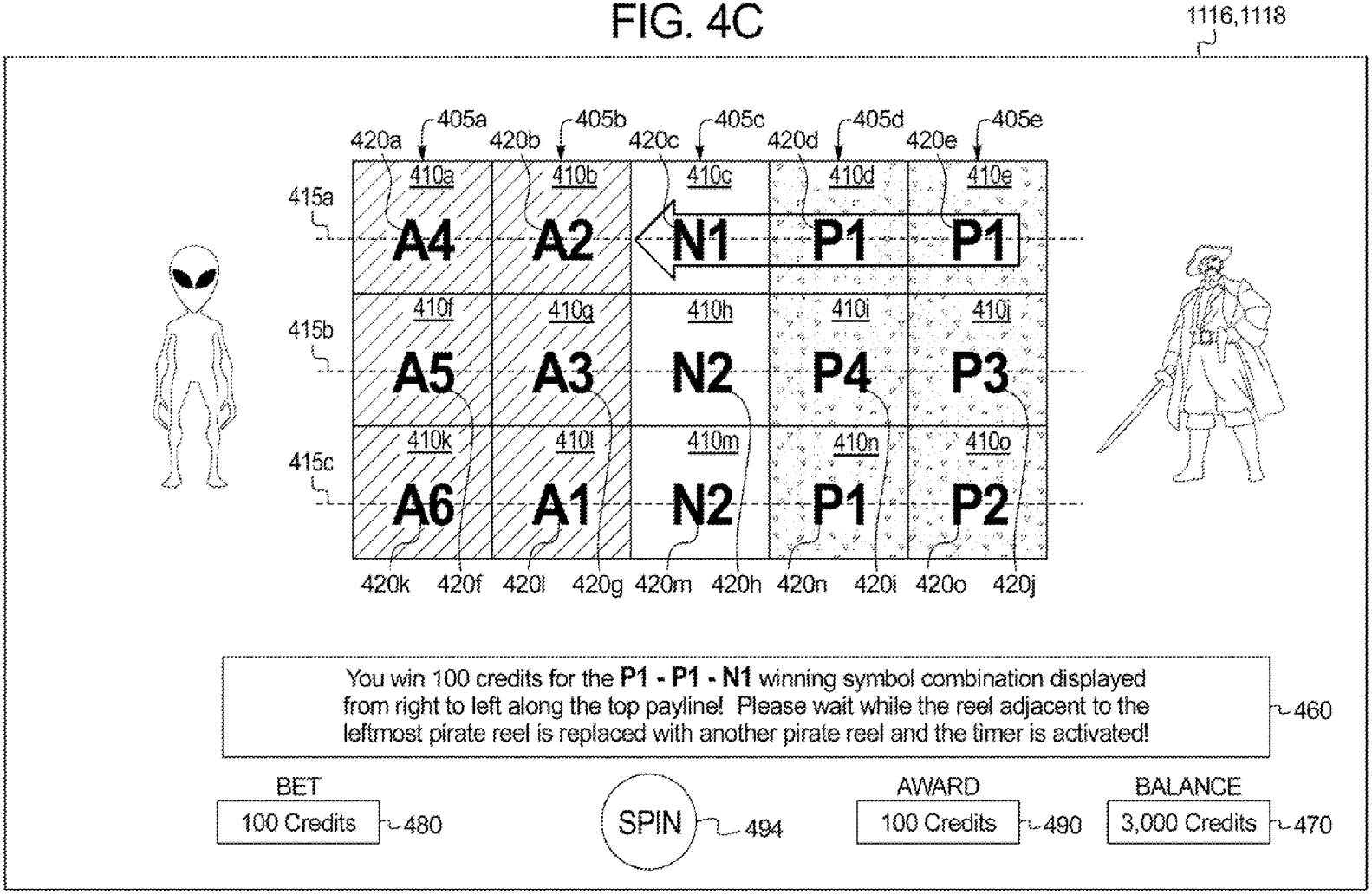

As illustrated in FIG. 4C, the gaming system stops the reels 405*a*, 405*b*, 405*c*, 405*d*, and 405*e* such that: (a) A4 symbol 420*a* is displayed at the symbol display area 410*a*, (b) A2 symbol 420*b* is displayed at the symbol display area 410*b*, (c) N1 symbol 420*c* is displayed at the symbol display area 410*c*, (d) P1 symbol 420*d* is displayed at the symbol display area 410*d*, (e) P1 symbol 420*e* is displayed at the symbol display area 410*e*, (f) A5 symbol 420*f* is displayed at the symbol display area 410, (g) A3 symbol 420*g* is displayed at the symbol display area 410*g*, (h) N2 symbol 420*h* is displayed at the symbol display area 410*h*, (i) P4 symbol 420*i* is displayed at the symbol display area 410*i*, (j) P3 symbol 420*j* is displayed at the symbol display area 410*j*, (k) A6 symbol 420*k* is displayed at the symbol display area 410*k*, (l) A1 symbol 420*l* is displayed at the symbol display area 410*l*, (m) N2 symbol 420*m* is displayed at the symbol display area 410*m*, (n) P1 symbol 420*n* is displayed at the symbol display area 410*n*, and (o) P2 symbol 420*o* is displayed at the symbol display area 410*o*.

As noted above, the gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P1 420*e*, P1 420*d*, and N1 420*c* displayed from right to left along the payline 415*a* form one of the winning symbol combinations. The gaming system determines an award of 100 credits associated with the displayed P1-P1-N1 winning symbol combination, displays the 100 credit award in the award meter 490, and updates the player's credit balance to reflect the 100 credit award.

The gaming system determines whether the alien timer initiation event or the pirate timer initiation event occurred, as described above. Here, the gaming system determines that the pirate timer initiation event occurred because: (a) neither the alien timer nor the pirate timer is already active, and (b) the second reel set modification event occurred (i.e., the sum of awards (100 credits) associated with any winning combinations of symbols displayed from right to left along any wagered-on paylines (the P1-P1-N1 winning symbol combination) is greater than the sum of awards (0 credits) associated with any winning combinations of symbols displayed from left to right along any wagered-on paylines (no winning symbol combinations)).

As noted above, upon an occurrence of the pirate timer initiation event in this example embodiment, the gaming system: (a) modifies the set of reels by removing the reel that is adjacent to the leftmost reel having the pirate theme and replacing it with another reel that has the pirate theme, and (b) activates a pirate timer associated with a designated period of one minute. The gaming system displays the following message in the message box 460: "YOU WIN 100 CREDITS FOR THE P1-P1-N1 WINNING SYMBOL COMBINATION DISPLAYED FROM RIGHT TO LEFT ALONG THE TOP PAYLINE! PLEASE WAIT WHILE THE REEL ADJACENT TO THE LEFTMOST PIRATE REEL IS REPLACED WITH ANOTHER PIRATE REEL AND THE TIMER IS ACTIVATED!"

Figure 4D:
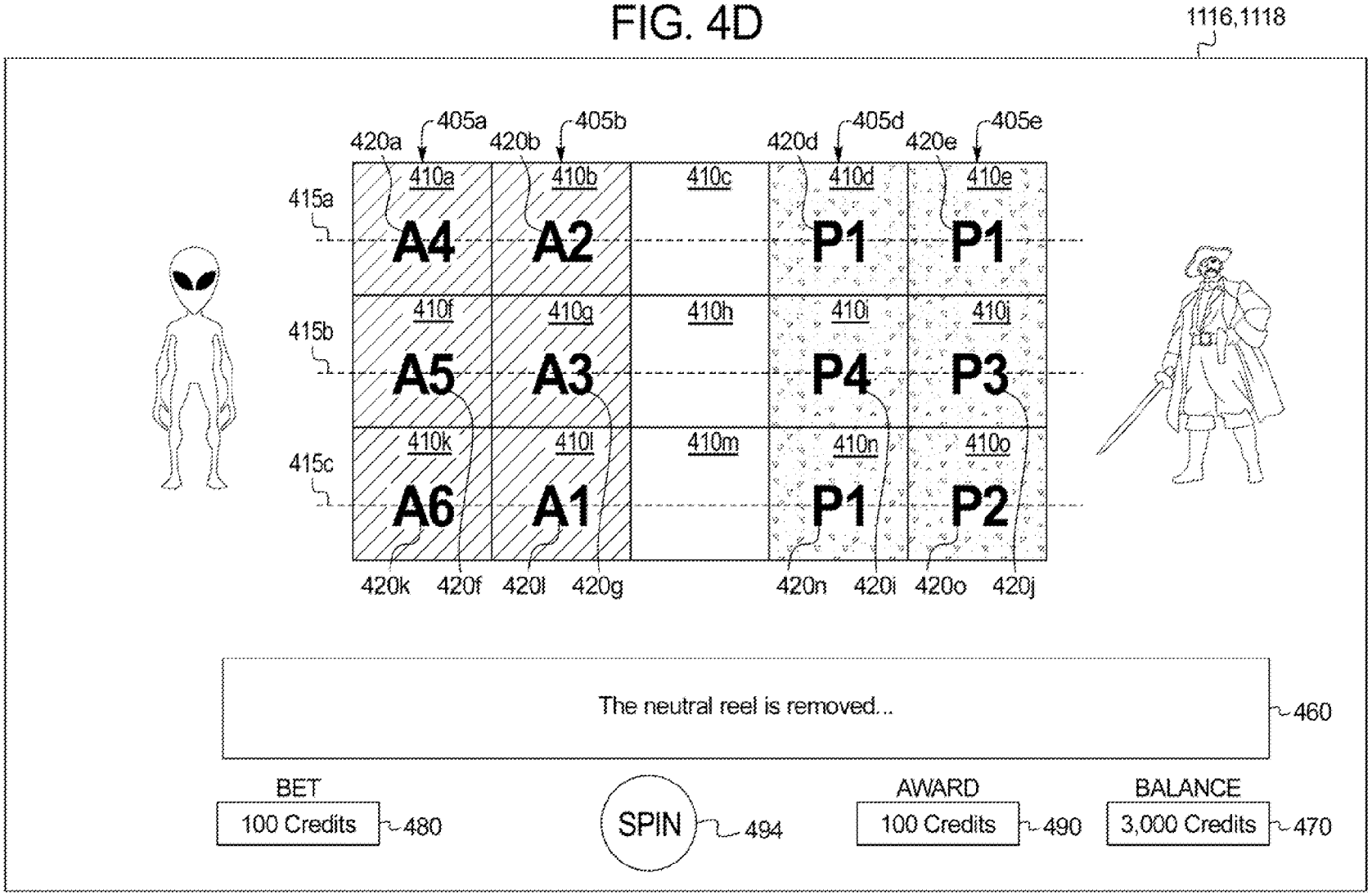
Figure 4E:
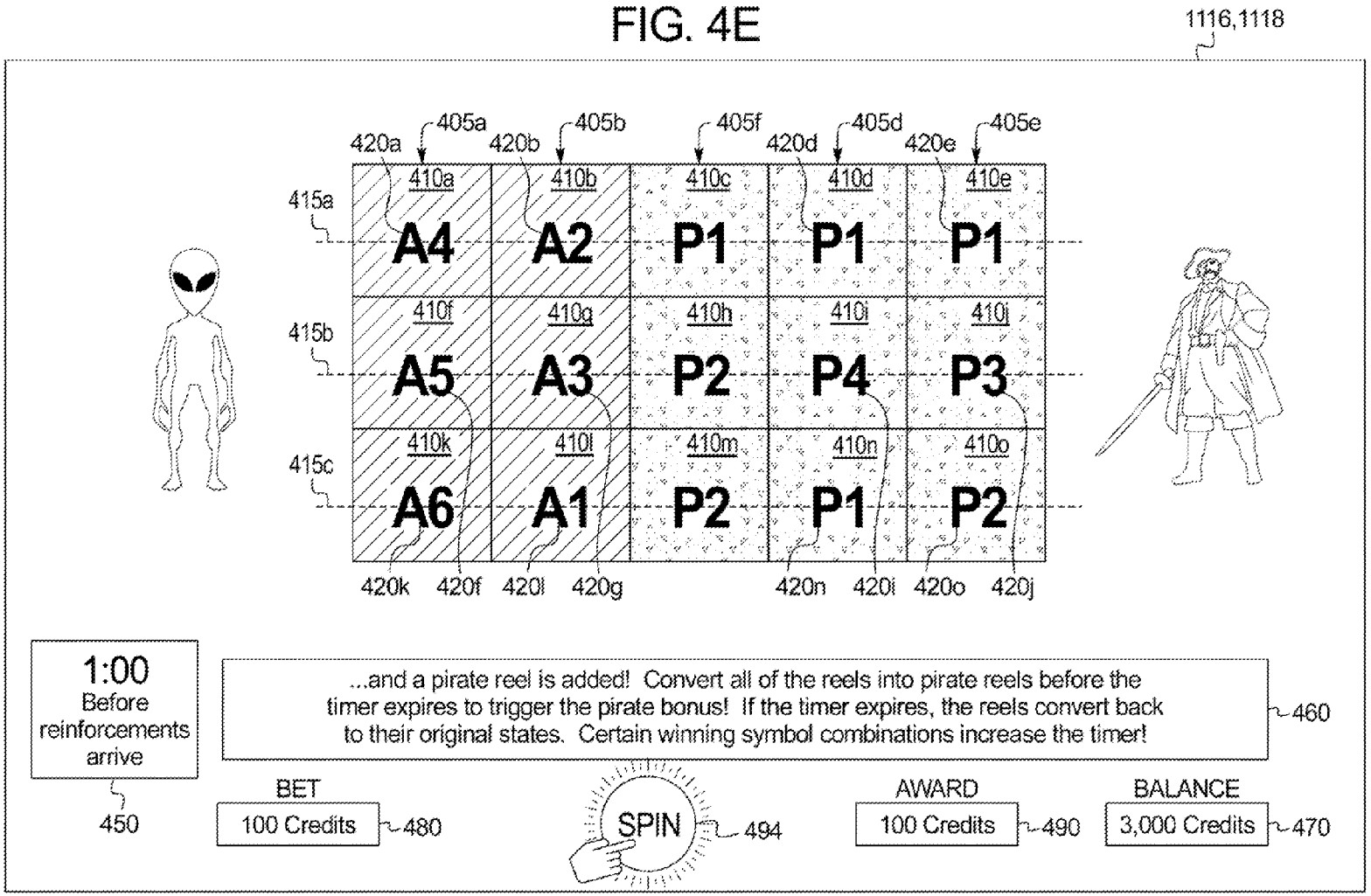

As illustrated in FIG. 4D, in this instance the leftmost reel that has the pirate theme is the reel 405*d*, and the reel that is adjacent to the reel 405*d* is the reel 405*c* (which has the neutral theme). Accordingly, the gaming system removes the reel 405*c*. The gaming system displays the following message in the message box 460: "THE NEUTRAL REEL IS REMOVED . . . " As illustrated in FIG. 4E, the gaming system replaces the removed reel 405*c* with reel 405*f*, which has the pirate theme, such that the reel 405*f* is associated with and configured to display symbols at the symbol display areas 410*c*, 410*h*, and 410*m*. The gaming system also displays the pirate timer 450. The gaming system displays the following message in the message box 460: " . . . AND A PIRATE REEL IS ADDED IN ITS PLACE! CONVERT ALL OF THE REELS INTO PIRATE REELS BEFORE THE TIMER EXPIRES TO TRIGGER THE PIRATE BONUS! IF THE TIMER EXPIRES, THE REELS CONVERT BACK TO THEIR ORIGINAL STATES! CERTAIN WINNING SYMBOL COMBINATIONS INCREASE THE TIMER!"

Figure 4F:
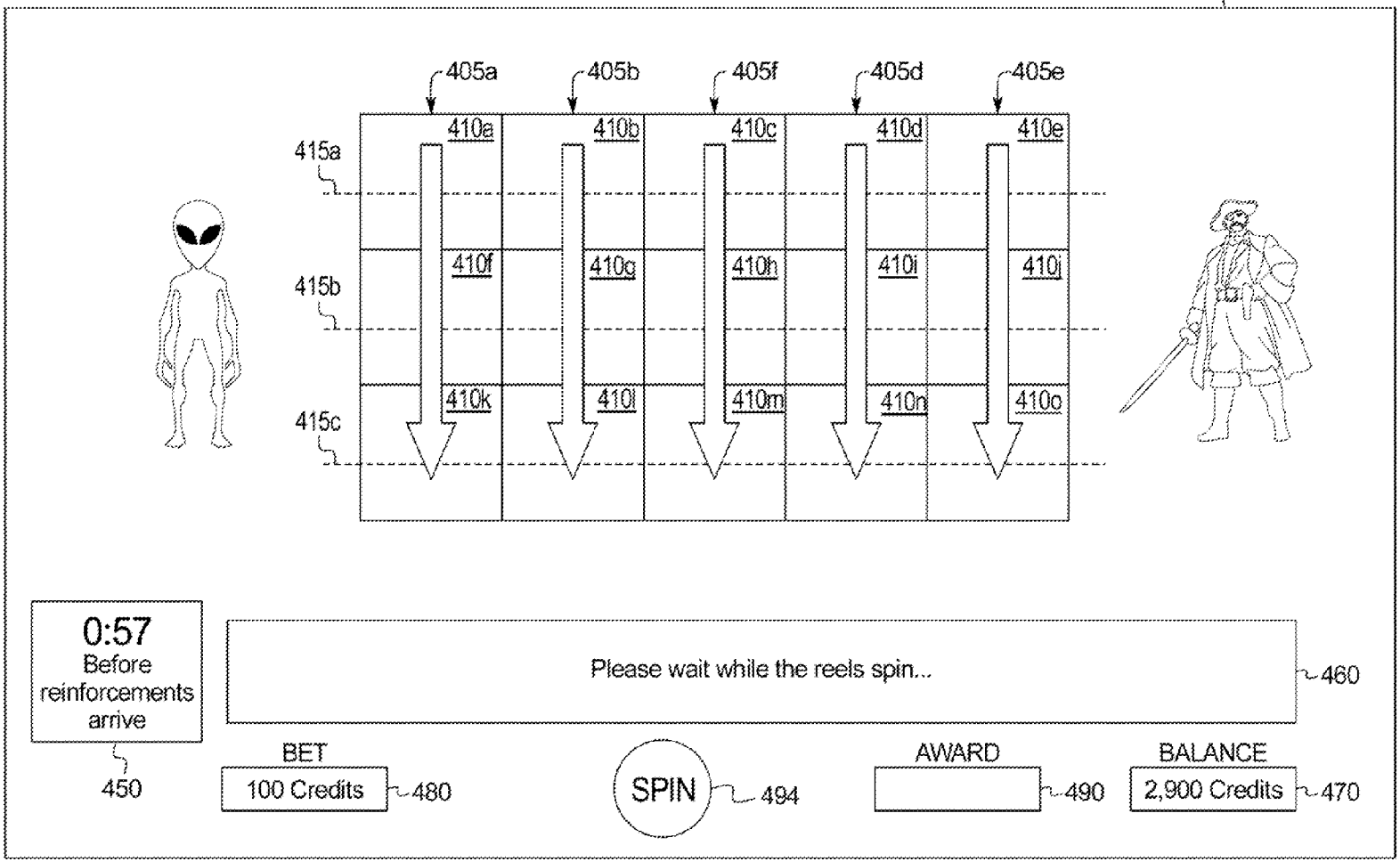

As also illustrated in FIG. 4E, the gaming system receives another actuation of the Spin button 494 from the player. Accordingly, the gaming system initiates another play of the game and spins the reels 405*a*, 405*b*, 405*c*, 405*d*, and 405*e*. As illustrated in FIG. 4F, the gaming system reduces the player's credit balance by the 100 credit wager (as shown in the credit meter 470) and displays the reels 405*a*, 405*b*, 405*c*, 405*d*, and 405*e* spinning. At this point, fifty-seven seconds of the designated period remain. The gaming system displays the following message in the message box 460: "PLEASE WAIT WHILE THE REELS SPIN . . . "

Figure 4G:
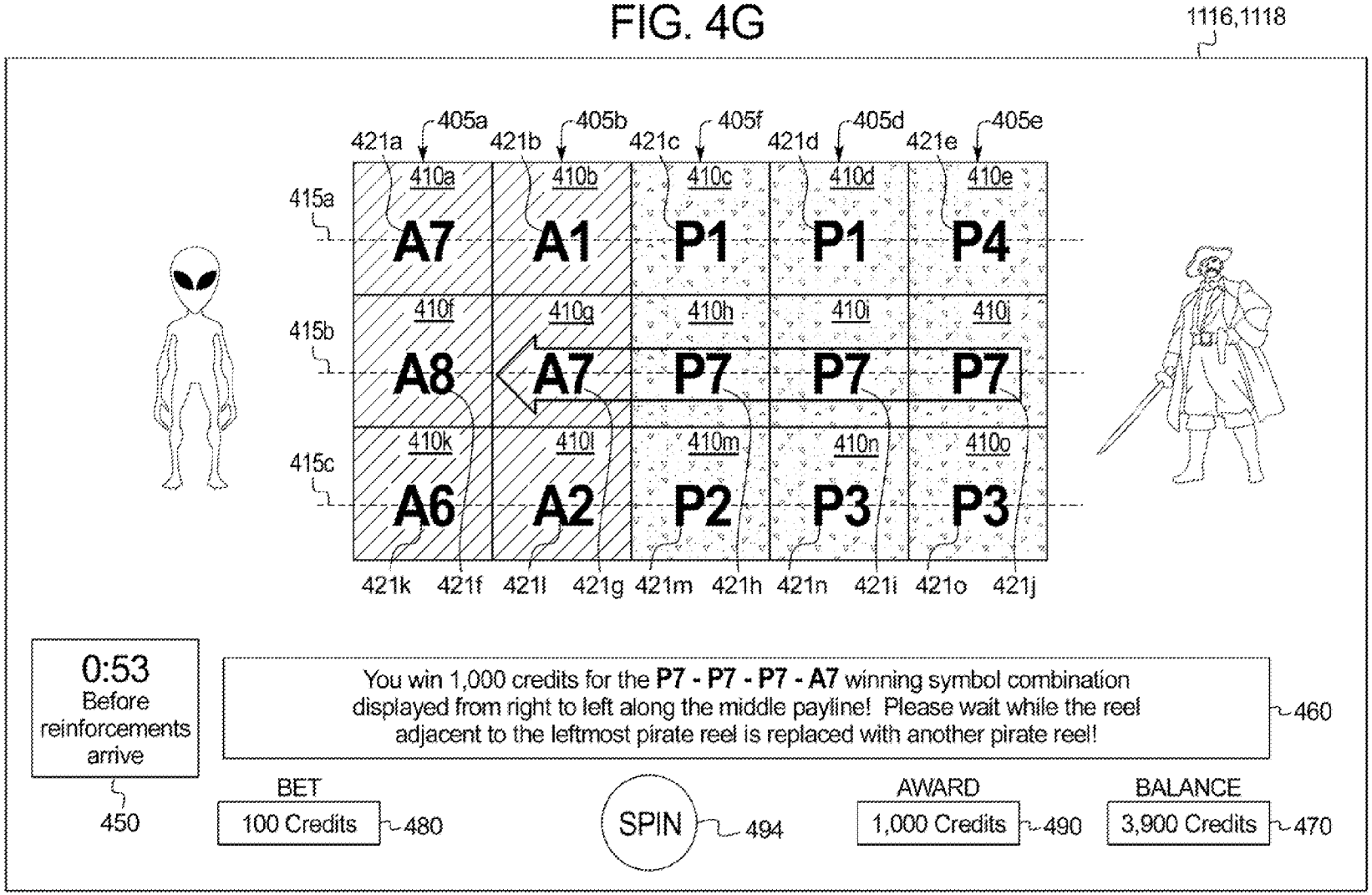

As illustrated in FIG. 4G, the gaming system stops the reels 405*a*, 405*b*, 405*c*, 405*d*, and 405*e* such that: (a) A7 symbol 421*a* is displayed at the symbol display area 410*a*, (b) A1 symbol 421*b* is displayed at the symbol display area 410*b*, (c) P1 symbol 421*c* is displayed at the symbol display area 410*c*, (d) P1 symbol 421*d* is displayed at the symbol display area 410*d*, (e) P4 symbol 421*e* is displayed at the symbol display area 410*e*, (f) A8 symbol 421*f* is displayed at the symbol display area 410*f*, (g) A7 symbol 421*g* is displayed at the symbol display area 410*g*, (h) P7 symbol 421*h* is displayed at the symbol display area 410*h*, (i) P7 symbol 421*i* is displayed at the symbol display area 410*i*, (j) P7 symbol 421*j* is displayed at the symbol display area 410*j*, (k) A6 symbol 421*k* is displayed at the symbol display area 410*k*, (l) A2 symbol 421*l* is displayed at the symbol display area 410*l*, (m) P2 symbol 421*m* is displayed at the symbol display area 410*m*, (n) P3 symbol 421*n* is displayed at the symbol display area 410*n*, and (o) P3 symbol 421*o* is displayed at the symbol display area 410*o*.

As noted above, the gaming system determines any awards associated with the play of the game based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P7 421*j*, P7 421*i*, P7 421*h*, and A7 421*g* displayed from right to left along the payline 415*b* form one of the winning symbol combinations. The gaming system determines an award of 1.000 credits associated with the displayed P7-P7-P7-A7 winning symbol combination, displays the 1,000 credit award in the award meter 490, and updates the player's credit balance to reflect the 1,000 credit award.

The gaming system determines that neither the alien timer activation event nor the pirate timer activation event occurs because the pirate timer is already active. Additionally, because the pirate timer is already active, the gaming system does not determine whether the first reel set modification event occurred in association with the play of the game.

Because the pirate timer is active, the gaming system determines whether the second reel set modification event occurred in association with the play of the game, as described above. Here, the gaming system determines that the second reel set modification event occurred in association with the play of the game because the sum of awards (1,000 credits) associated with any winning combinations of symbols displayed from right to left along any wagered-on paylines (the P7-P7-P7-A7 winning symbol combination) is greater than the sum of awards (0 credits) associated with any winning combinations of symbols displayed from left to right along any wagered-on paylines (no winning symbol combinations).

As noted above, upon an occurrence of the second reel set modification event in this example embodiment, the gaming system modifies the set of reels by removing the reel that is adjacent to the leftmost reel having the pirate theme and replacing it with another reel that has the pirate theme. Thus, the modified set of reels includes one more reel having the pirate theme than it did before being modified. At this point, fifty-three seconds of the designated period remain. The gaming system displays the following message in the message box 460: "YOU WIN 1,000 CREDITS FOR THE P7-P7-P7-A7 WINNING SYMBOL COMBINATION DISPLAYED FROM RIGHT TO LEFT ALONG THE MIDDLE PAYLINE! PLEASE WAIT WHILE THE REEL ADJACENT TO THE LEFTMOST PIRATE REEL IS REPLACED WITH ANOTHER PIRATE REEL!"

Figure 4H:
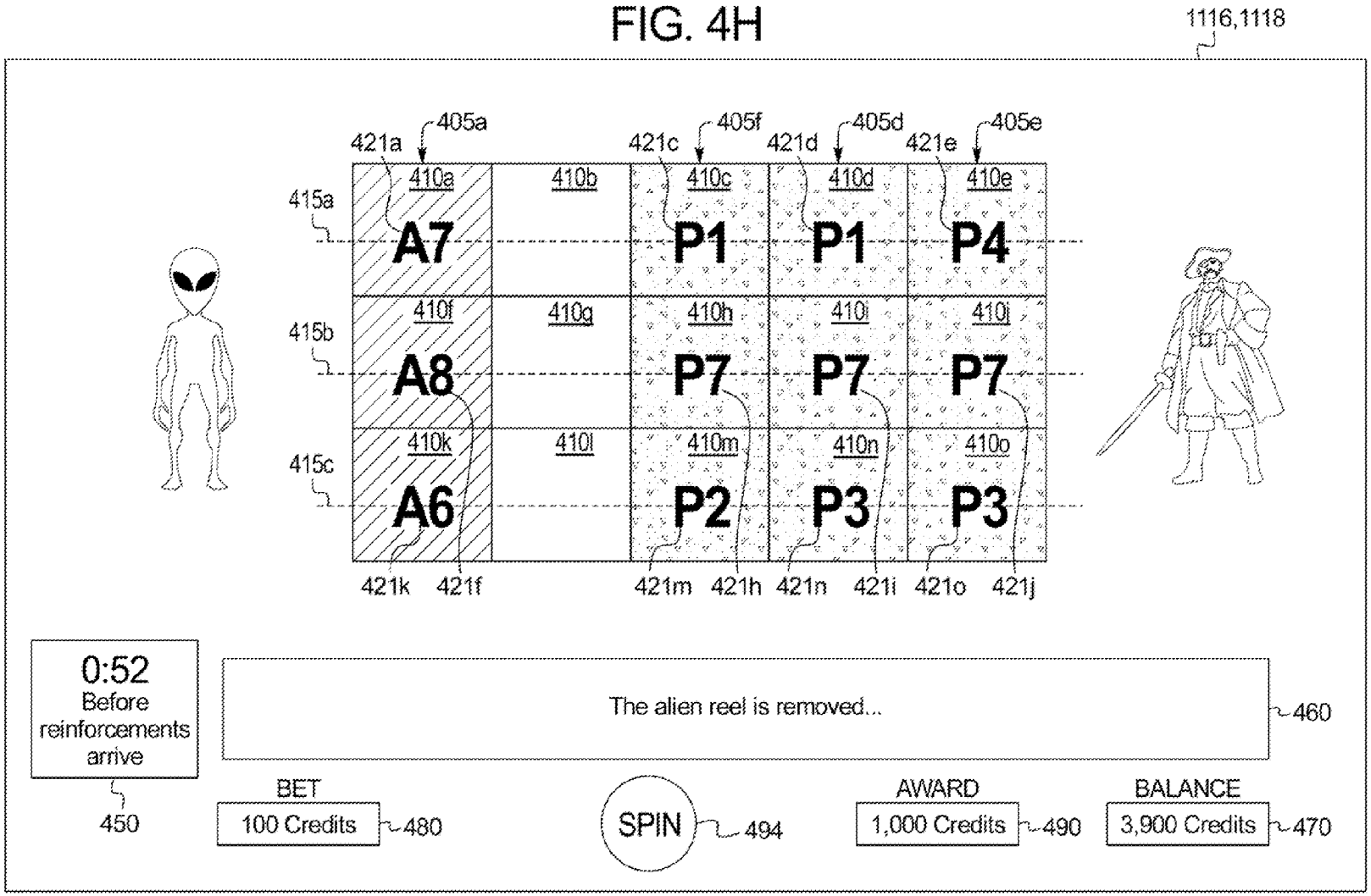
Figure 4I:
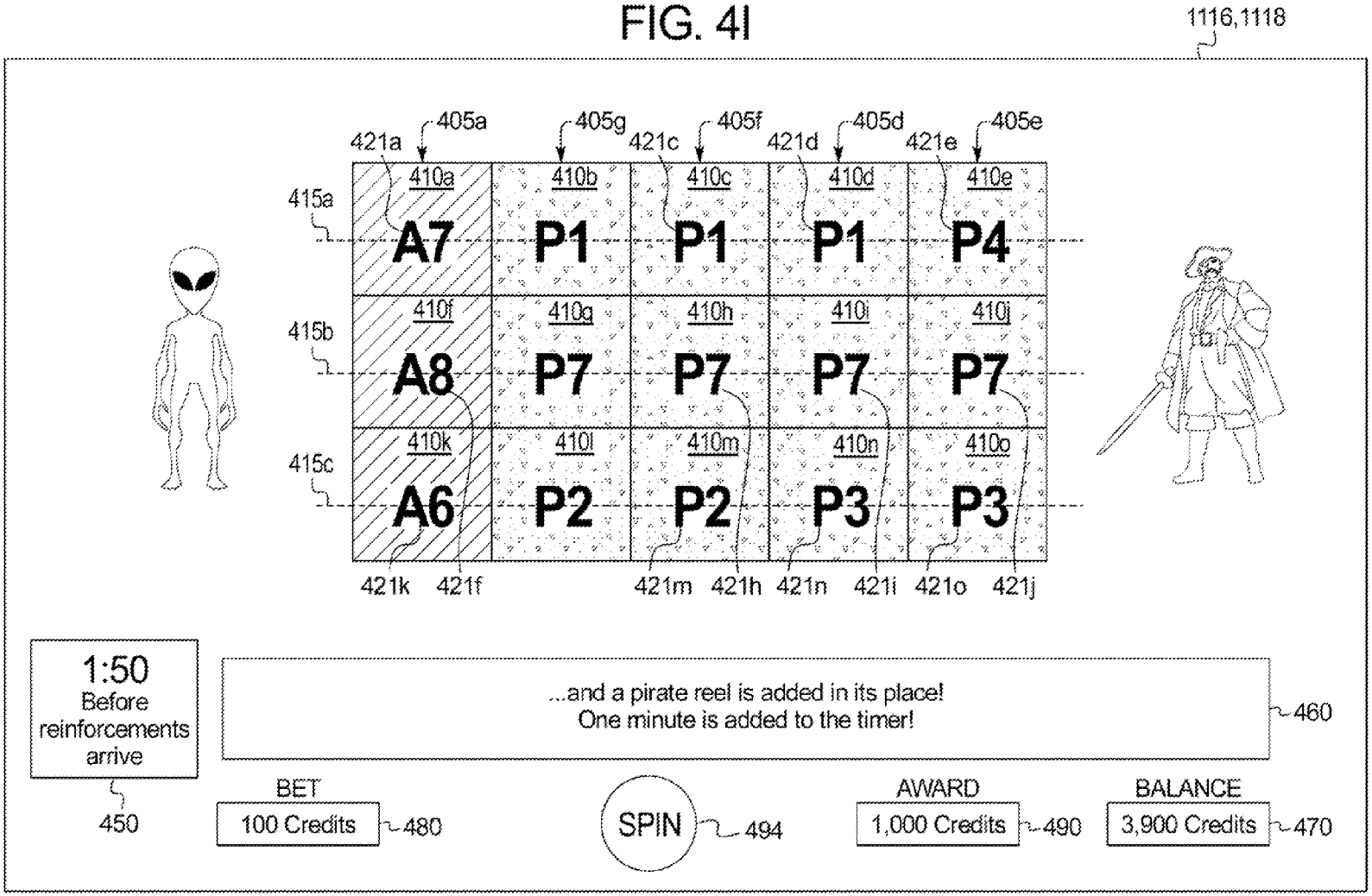

As illustrated in FIG. 4H, in this instance the leftmost reel that has the pirate theme is the reel 405*f*, and the reel that is adjacent to the reel 405*f* is the reel 405*b* (which has the alien theme). Accordingly, the gaming system removes the reel 405*b*. At this point, fifty-two seconds of the designated period remain. The gaming system displays the following message in the message box 460: "THE ALIEN REEL IS REMOVED . . . " As illustrated in FIG. 4I, the gaming system replaces the removed reel 405*b* with reel 405*g*, which has the pirate theme, such that the reel 405*g* is associated with and configured to display symbols at the symbol display areas 410*b*, 410*g*, and 410*l*. The gaming system determines that the timer increase event occurred because the second reel set modification event occurred and, therefore, adds one minute to the designated period. At this point, one minute and fifty seconds of the designated period remain. The gaming system displays the following message in the message box 460: " . . . AND A PIRATE REEL IS ADDED IN ITS PLACE! ONE MINUTE IS ADDED TO THE TIMER!"

In other embodiments, while the alien timer is active, the gaming system does not disable the second reel set modification event. In other words, in these embodiments, when the alien timer is active for a play of the game, the gaming system determines whether the second reel set modification event occurred for that play of the game. It should thus be appreciated that, in these embodiments, when the alien timer is active, the gaming system enables the reel set to be modified by: (a) replacing reels associated with the neutral theme or the pirate theme with reels associated with the alien theme, and (b) replacing any reels associated with the neutral theme or the alien theme with reels associated with the pirate theme.

In other embodiments, while the pirate timer is active, the gaming system does not disable the first reel set modification event. In other words, in these embodiments, when the pirate timer is active for a play of the game, the gaming system determines whether the first reel set modification event occurred for that play of the game. It should thus be appreciated that, in these embodiments, when the pirate timer is active, the gaming system enables the reel set to be modified by: (a) replacing reels associated with the neutral theme or the alien theme with reels associated with the pirate theme, and (b) replacing any reels associated with the neutral theme or the pirate theme with reels associated with the alien theme.

In other embodiments, when the designated period expires and the alien timer is active, the gaming system deactivates the alien timer and replaces at least one reel associated with the alien theme with a reel associated with the pirate theme instead of resetting the set of reels to the initial set.

In other embodiments, when the designated period expires and the pirate timer is active, the gaming system deactivates the pirate timer and replaces at least one reel associated with the pirate theme with a reel associated with the alien theme instead of resetting the set of reels to the initial set.

In certain embodiments, the gaming system employs the modifier described below in addition to the timer(s). In one such embodiment, the gaming system resets the modifier to its initial value (described below) upon expiration of the designated period.

Battling Symbol Generators Game with Symbol Generator Replacement and Modifier FIGS. 5A, 5B, 5C, 5D, 5E, 5F, 5G, 5H, and 5I illustrate screen shots of one example embodiment of the gaming system of the present disclosure providing a plurality of plays of another example embodiment of the battling reels game of the present disclosure. In this example embodiment, the battling reels game is a free spin bonus game. The gaming system displays a plurality of symbol display areas 510*a*, 510*b*, 510*c*, 510*d*, 510*e*, 510*f*, 510*g*, 510*h*, 510*i*, 510*j*, 510*k*, 510*l*, 510*m*, 510*n*, and 510*o* arranged in a 3×5 grid or matrix. The gaming system displays a plurality of paylines, each of which is associated with a different plurality of the symbol display areas. In this example embodiment: (a) payline 515*a* is associated with symbol display areas 510*a*, 510*b*, 510*c*, 510*d*, and 510*e*; (b) payline 515*b* is associated with symbol display areas 510*f*, 510*g*, 510*h*, 510*i*, and 510*j*; and (c) payline 515*c* is associated with symbol display areas 510*k*, 510*l*, 510*m*, 510*n*, and 510*o*.

The gaming system also displays: (a) a message box 560 (described above); (b) a plurality of meters including: (i) a credit meter 570 (described above), (ii) a free spins remaining meter 580 that displays the quantity of remaining free spins, and (iii) an award meter 590 (described above); and (c) a multiplier display 550 that displays the current value of the multiplier (described below).

In this example embodiment, the game is associated with a plurality of symbols and a plurality of reels (i.e., symbol generators in this example embodiment). Here: (a) each of the plurality of reels is associated with two or more of the plurality of symbols; (b) each reel is associated with one of a plurality of different themes (i.e., characteristics in this example embodiment) and includes a background associated with that theme; and (c) at least three of the reels are associated with different themes. In this example embodiment, the themes (and their associated backgrounds) include: (a) a first alien theme (associated with a hatched background), (b) a second pirate theme (associated with a dotted background), and (c) a third neutral theme (associated with a blank background). Additionally, in this example embodiment, for each reel, one or more of the symbols associated with that reel also have the theme of that reel. For instance, one or more of the symbols associated with a reel having the alien theme also have the alien theme.

In this example embodiment, for each free spin, the gaming system employs a set of the plurality of reels including two or more of, but fewer than all of, the plurality of reels. Here, the gaming system initially selects and employs an initial set of the reels including reels 505*a*, 505*b*, 505*c*, 505*d*, and 505*e* for the game. The gaming system displays the reels 505*a*, 505*b*, 505*c*, 505*d*, and 505*e* from left to right in association with the plurality of symbol display areas such that each reel is configured to display symbols at one or more of the symbol display areas. More specifically, the gaming system displays: (a) the reel 505*a* in association with the symbol display areas 510*a*, 510*f*, and 510*k*; (b) the reel 505*b* in association with the symbol display areas, 510*b*, 510*g*, and 510*l*; (c) the reel 505*c* in association with the symbol display areas 510*c*, 510*h*, and 510*m*; (d) the reel 505*d* in association with the symbol display areas 510*d*, 510*i*, and 510*n*; and (e) the reel 505*e* in association with the symbol display areas 510*e*, 510*j*, and 510*o*.

In this example embodiment, the gaming system determines any awards associated with a free spin based on the symbols displayed at the symbol display areas by determining: (a) whether any winning combinations of the symbols included in a paytable (not shown) associated with the game are displayed from left to right along any wagered-on paylines, and (b) whether any winning combinations of the symbols are displayed from right to left along any wagered-on paylines.

In this example embodiment, with respect to the initial set of reels: (a) the leftmost reels 505*a* and 505*b* of the initial set each have the alien theme and, therefore, each display the hatched background associated with the alien theme; (b) the middle reel 505*c* of the initial set has the neutral theme and, therefore, displays the blank background associated with the neutral theme; and (c) the rightmost reels 505*d* and 505*e* of the initial set each have the pirate theme and, therefore, each display the dotted background associated with the pirate theme. During game play, the gaming system: (a) removes and replaces one or more reels having the neutral or pirate themes with one or more reels having the alien theme upon an occurrence of a first reel set modification event, and (b) removes and replaces one or more reels having the neutral or alien themes with one or more reels having the pirate theme upon an occurrence of a second different reel set modification event.

More specifically, in this example embodiment, the gaming system determines that the first reel set modification event occurs in association with a free spin when: (a) a sum of any awards associated with any winning combinations of symbols displayed from left to right along any wagered-on paylines is greater than a sum of any awards associated with any winning combinations of symbols displayed from right to left along any wagered-on paylines, and (b) at least one of the reels of the set does not have the alien theme. The gaming system determines that the second reel set modification event occurs in association with a free spin when: (a) a sum of any awards associated with any winning combinations of symbols displayed from right to left along any wagered-on paylines is greater than a sum of any awards associated with any winning combinations of symbols displayed from left to right along any wagered-on paylines, and (b) at least one of the reels of the set does not have the pirate theme.

In this example embodiment, upon an occurrence of the first reel set modification event, the gaming system modifies the set of reels by removing the reel that is adjacent to the rightmost reel associated with the alien theme and replacing it with another reel that is associated with the alien theme such that the modified set of reels includes one more reel associated with the alien theme than it did before being modified. Similarly, upon an occurrence of the second reel set modification event, the gaming system modifies the set of reels by removing the reel that is adjacent to the leftmost reel associated with the pirate theme and replacing it with another reel that is associated with the pirate theme such that the modified set of reels includes one more reel associated with the pirate theme than it did before being modified.

The free spin bonus game is associated with a modifier, which is a multiplier in this example embodiment. Additionally, upon initiation of the free spin bonus game in this example embodiment, the gaming system assigns the player either the alien theme or the pirate theme. If the player is assigned the alien theme, the gaming system: (a) increases a value of the multiplier whenever the gaming system replaces a reel associated with the neutral theme or the pirate theme with a reel associated with the alien theme, and (b) decreases the value of the multiplier whenever the gaming system replaces a reel associated with the alien theme with a reel associated with the pirate theme or the neutral theme. Similarly, if the player is assigned the pirate theme, the gaming system: (a) increases a value of the multiplier whenever the gaming system replaces a reel associated with the neutral theme or the alien theme with a reel associated with the pirate theme, and (b) decreases the value of the multiplier whenever the gaming system replaces a reel associated with the pirate theme with a reel associated with the alien theme or the neutral theme.

In this example embodiment, for each free spin, the gaming system uses the multiplier to modify any awards determined for that free spin. In other embodiments, the gaming system employs the multiplier to modify a sum of any awards determined for the free spin bonus game.

Figure 5A:
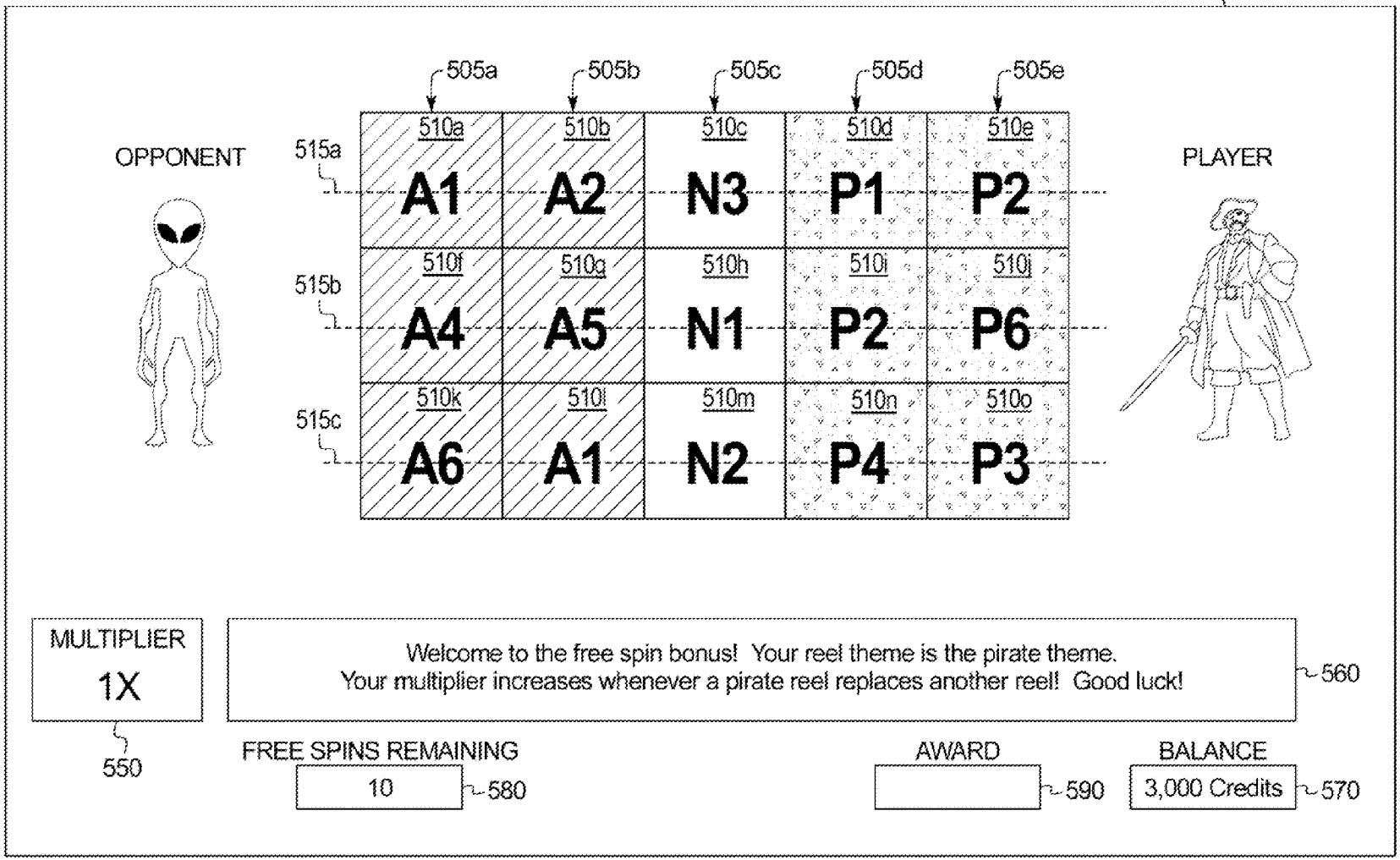
FIGS. 5A, 5B, 5C, 5D, 5E, 5F, 5G, 5H, and 5I illustrate screen shots of another example embodiment of the gaming system of the present disclosure providing a plurality of free plays of another example embodiment of the game of the present disclosure.
Figure 5B:
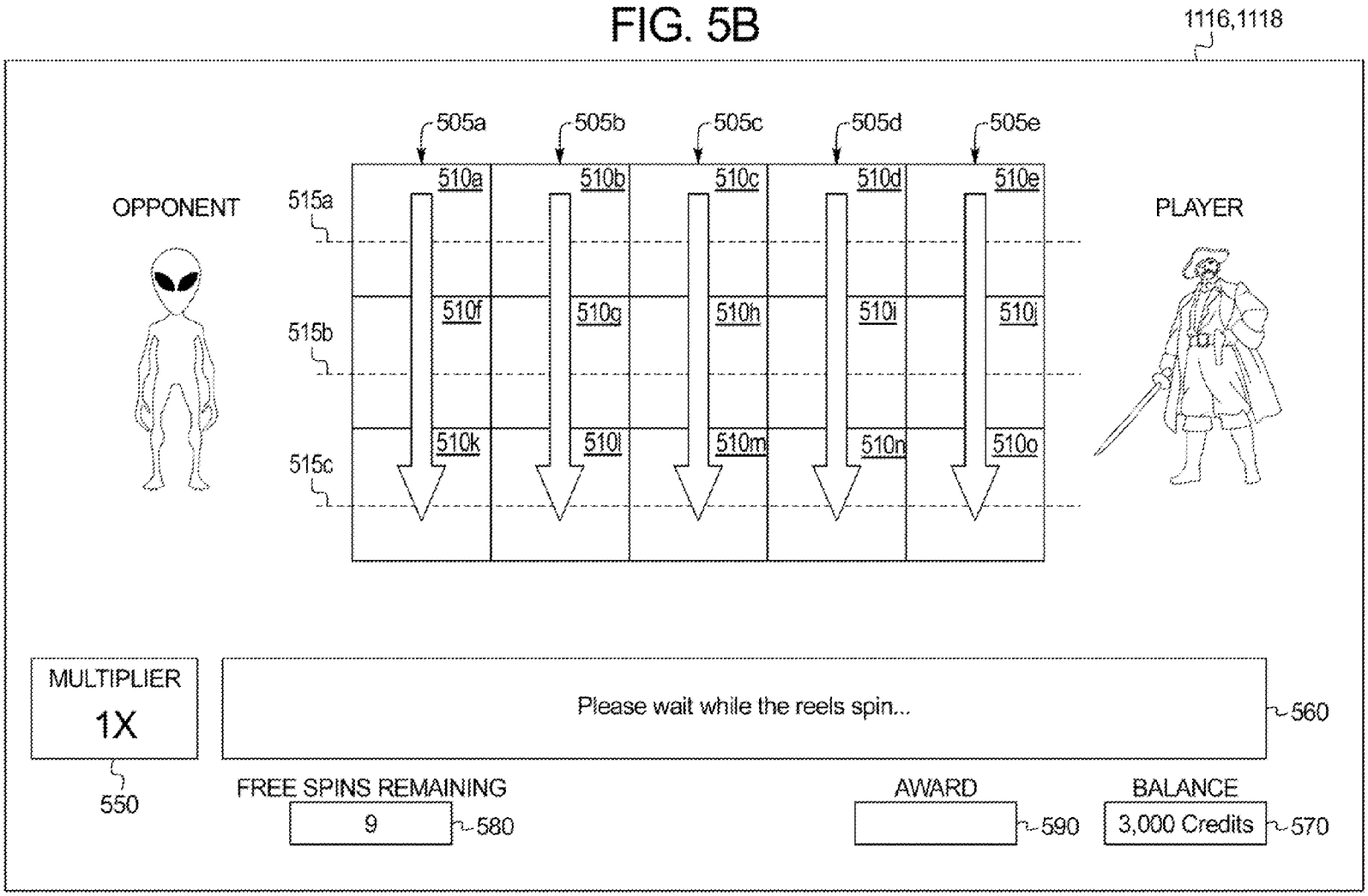

Turning to FIG. 5A, upon initiation of the free spin bonus game, the gaming system assigns the player the pirate theme and provides the player with ten free spins of the reels (as shown in the free spins remaining meter 580). The gaming system displays the following message in the message box 560: "WELCOME TO THE FREE SPIN BONUS! YOUR REEL THEME IS THE PIRATE THEME. YOUR MULTIPLIER INCREASES WHENEVER A PIRATE REEL REPLACES ANOTHER REEL! GOOD LUCK!" As illustrated in FIG. 5B, the gaming system initiates one of the free spins; reduces the number of remaining free spins by one (as shown in the free spins remaining meter 580); and displays the reels 505*a*, 505*b*, 505*c*, 505*d*, and 505*e* spinning. The gaming system displays the following message in the message box 560: "PLEASE WAIT WHILE THE REELS SPIN . . . "

Figure 5C:
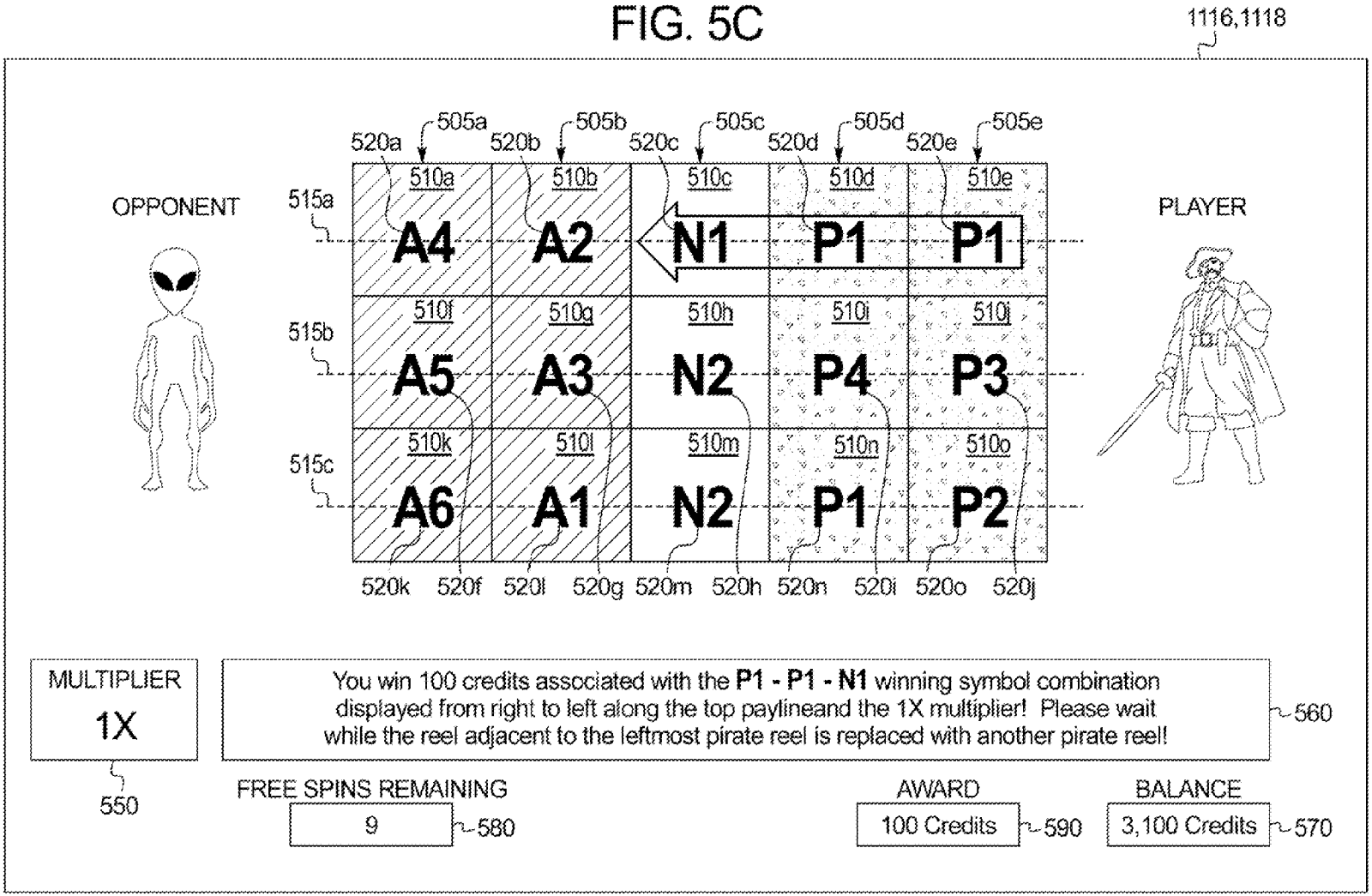

As illustrated in FIG. 5C, the gaming system stops the reels 505*a*, 505*b*, 505*c*, 505*d*, and 505*e* such that: (a) A4 symbol 520*a* is displayed at the symbol display area 510*a*, (b) A2 symbol 520*b* is displayed at the symbol display area 510*b*, (c) N1 symbol 520*c* is displayed at the symbol display area 510*c*, (d) P1 symbol 520*d* is displayed at the symbol display area 510*d*, (e) P1 symbol 520*e* is displayed at the symbol display area 510*e*, (f) A5 symbol 520*f* is displayed at the symbol display area 510*f*, (g) A3 symbol 520*g* is displayed at the symbol display area 510*g*, (h) N2 symbol 520*h* is displayed at the symbol display area 510*h*, (i) P4 symbol 520*i* is displayed at the symbol display area 510*i*, (j) P3 symbol 520*j* is displayed at the symbol display area 510*j*, (k) A6 symbol 520*k* is displayed at the symbol display area 510*k*, (l) A1 symbol 520*l* is displayed at the symbol display area 510*l*, (m) N2 symbol 520*m* is displayed at the symbol display area 510*m*, (n) P1 symbol 520*n* is displayed at the symbol display area 510*n*, and (o) P2 symbol 520*o* is displayed at the symbol display area 510*o*.

As noted above, the gaming system determines any awards associated with the free spin based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P1 520*e*, P1 520*d*, and N1 520*c* displayed from right to left along the payline 515*a* form one of the winning symbol combinations. The gaming system determines an award of 100 credits associated with the displayed P1-P1-N1 winning symbol combination, displays the 100 credit award in the award meter 590, and updates the player's credit balance to reflect the 100 credit award.

The gaming system determines whether the first reel set modification event occurred in association with the free spin, as described above. Here, the gaming system determines that the first reel set modification event did not occur in association with the free spin because the sum of awards (0 credits) associated with any winning combinations of symbols displayed from left to right along any wagered-on paylines (no winning symbol combinations) is not greater than the sum of awards (100 credits) associated with any winning combinations of symbols displayed from right to left along any wagered-on paylines (the P1-P1-N1 winning symbol combination).

The gaming system determines whether the second reel set modification event occurred in association with the free spin, as described above. Here, the gaming system determines that the second reel set modification event occurred in association with the free spin because: (a) the sum of awards (100 credits) associated with any winning combinations of symbols displayed from right to left along any wagered-on paylines (the P1-P1-N1 winning symbol combination) is greater than the sum of awards (0 credits) associated with any winning combinations of symbols displayed from left to right along any wagered-on paylines (no winning symbol combinations); and (b) the reels 205*a*, 205*b*, and 205*c* are not associated with the pirate theme.

As noted above, upon an occurrence of the second reel set modification event in this example embodiment, the gaming system modifies the set of reels by removing the reel that is adjacent to the leftmost reel having the pirate theme and replacing it with another reel that has the pirate theme. Thus, the modified set of reels includes one more reel having the pirate theme than it did before being modified. The gaming system displays the following message in the message box 260: "YOU WIN 100 CREDITS ASSOCIATED WITH THE P1-P1-N1 WINNING SYMBOL COMBINATION DISPLAYED FROM RIGHT TO LEFT ALONG THE TOP PAYLINE AND THE 1× MULTIPLIER! PLEASE WAIT WHILE THE REEL ADJACENT TO THE LEFTMOST PIRATE REEL IS REPLACED WITH ANOTHER PIRATE REEL!"

Figure 5D:
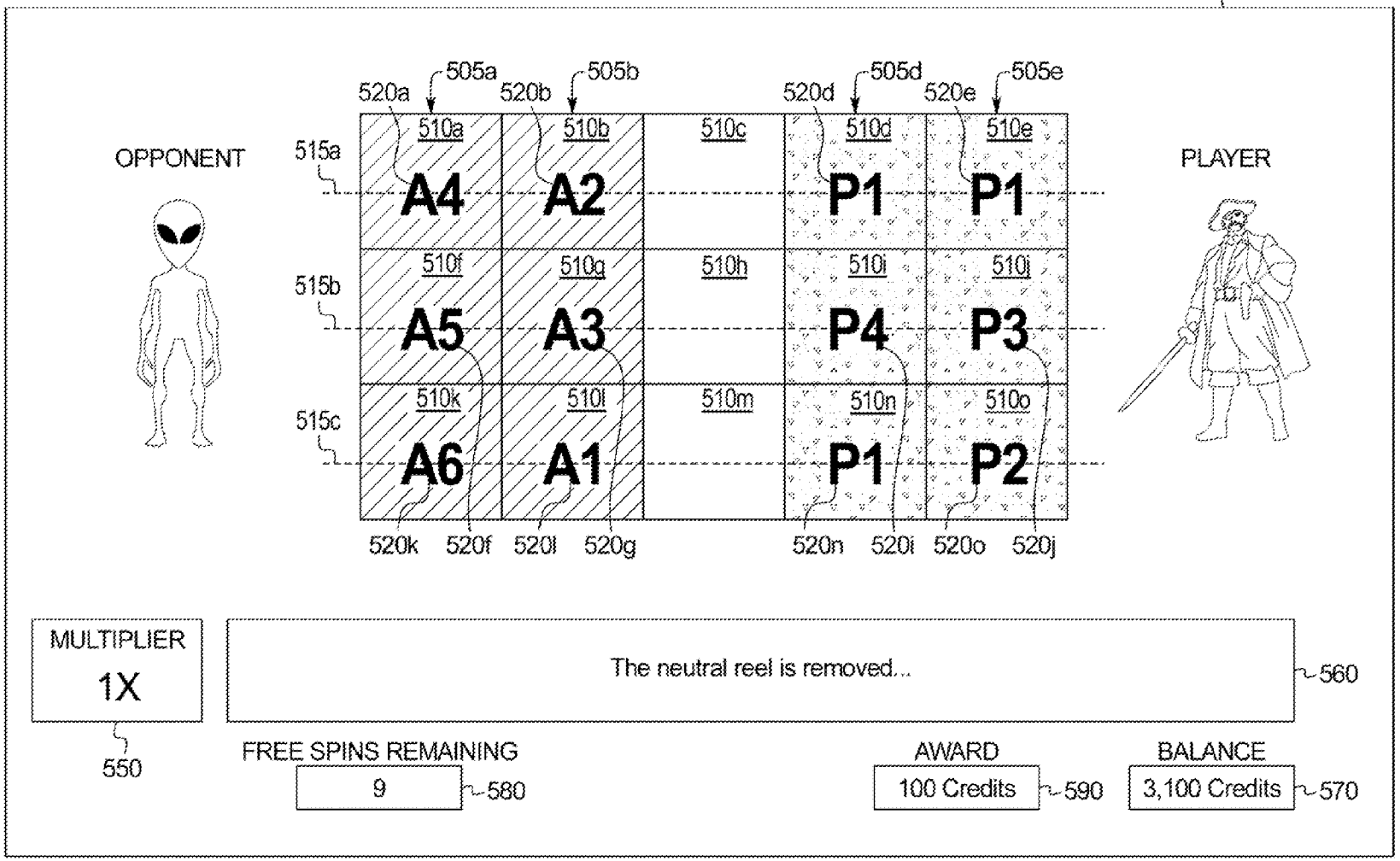
Figure 5E:
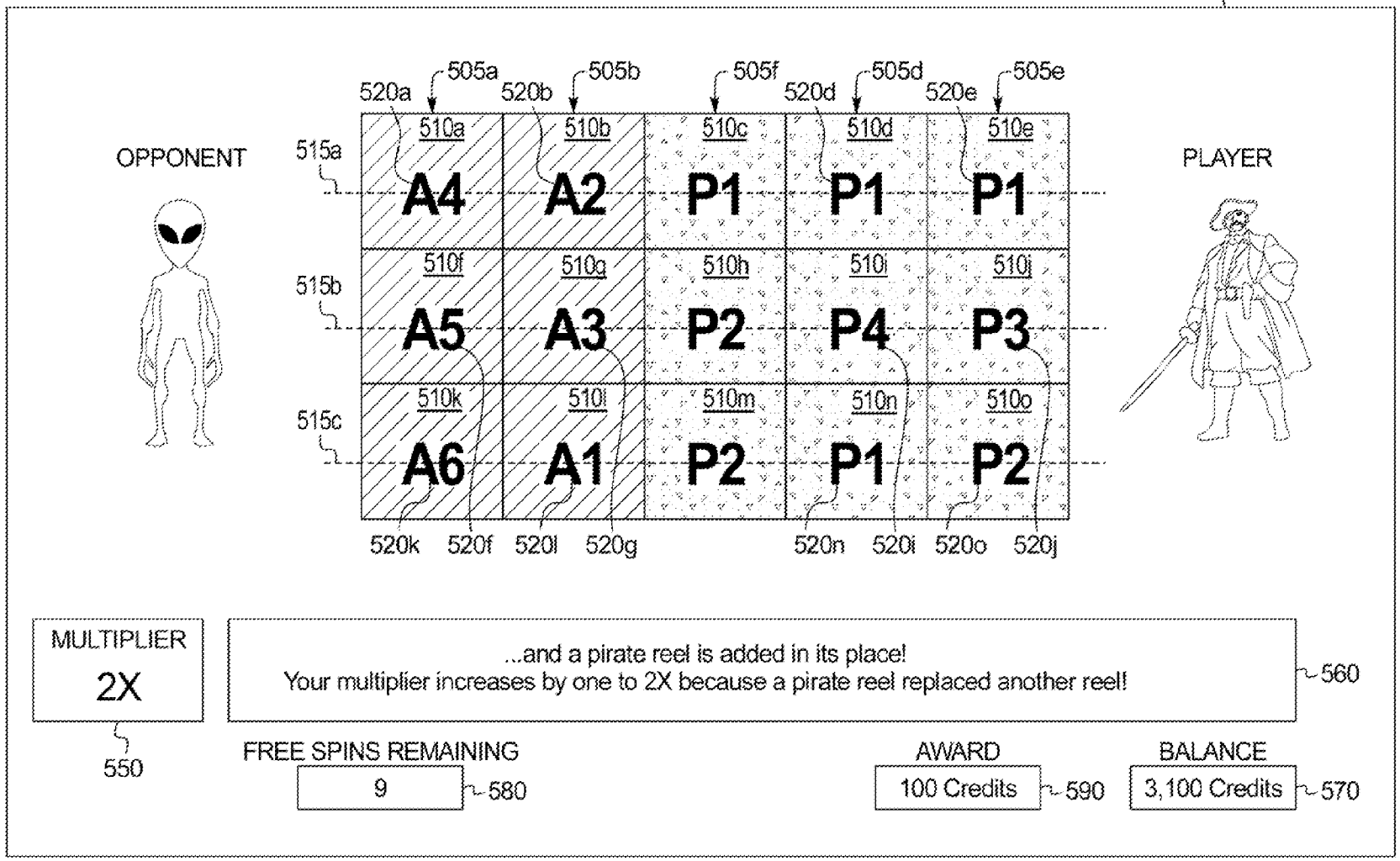

As illustrated in FIG. 5D, in this instance the leftmost reel that has the pirate theme is the reel 505*d*, and the reel that is adjacent to the reel 505*d* is the reel 505*c* (which has the neutral theme). Accordingly, the gaming system removes the reel 505*c*. The gaming system displays the following message in the message box 560: "THE NEUTRAL REEL IS REMOVED . . . " As illustrated in FIG. 5E, the gaming system replaces the removed reel 505*c* with reel 505*f*, which has the pirate theme, such that the reel 505*f* is associated with and configured to display symbols at the symbol display areas 510*c*, 510*h*, and 510*m*. Since the gaming system replaced a reel having the neutral theme with a reel having the pirate theme, the gaming system increases the value of the multiplier by one to 2×, as shown in the multiplier display 550. The gaming system displays the following message in the message box 560: ". . . AND A PIRATE REEL IS ADDED IN ITS PLACE! YOUR MULTIPLIER INCREASES BY ONE TO 2× BECAUSE A PIRATE REEL REPLACED ANOTHER REEL!"

Figure 5F:
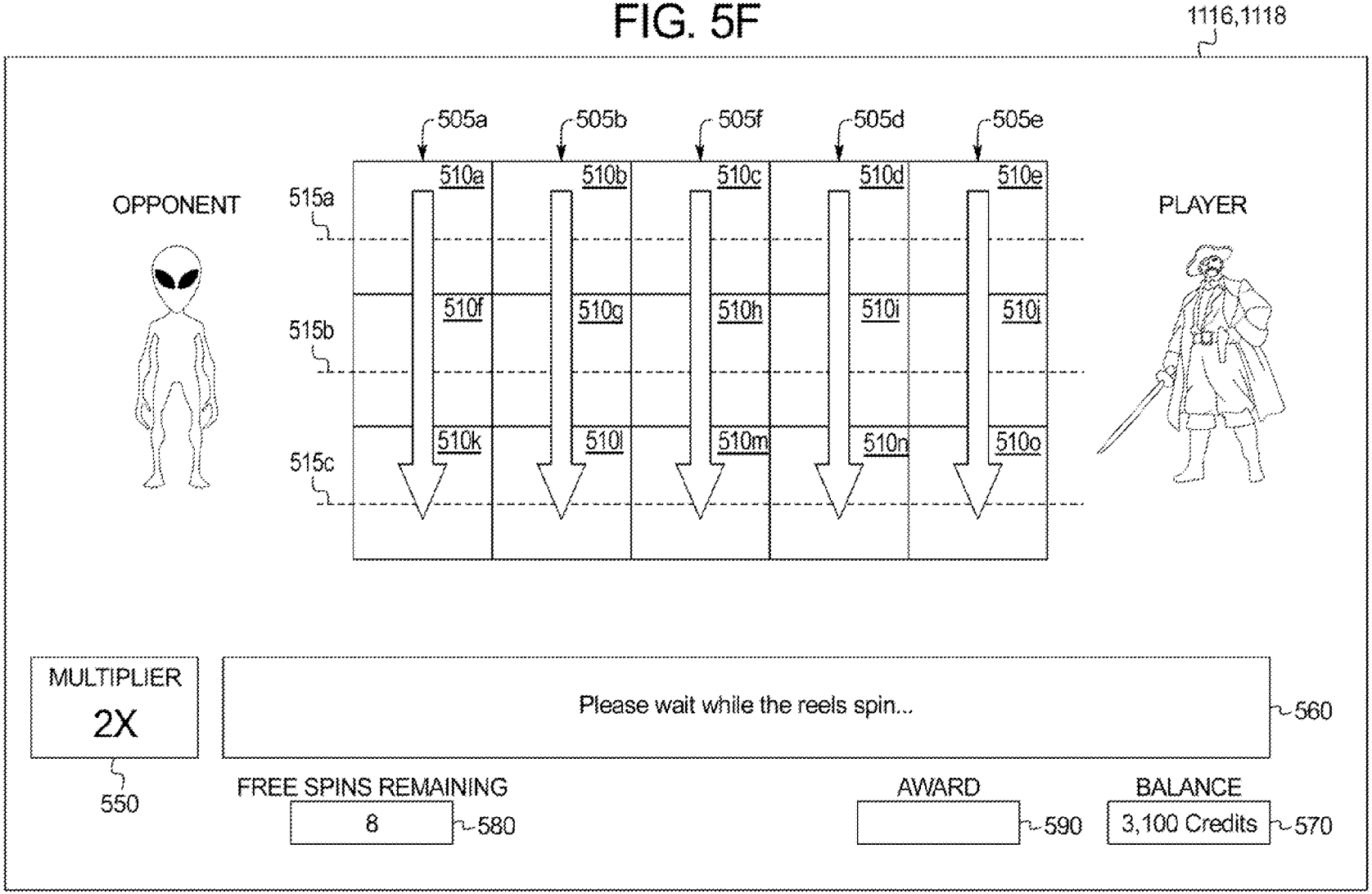

As also illustrated in FIG. 5F, the gaming system initiates another one of the free spins; reduces the number of remaining free spins by one (as shown in the free spins remaining meter 580); and displays the reels 505*a*, 505*b*, 505*c*, 505*d*, and 505*e* spinning. The gaming system displays the following message in the message box 560: "PLEASE WAIT WHILE THE REELS SPIN . . . "

Figure 5G:
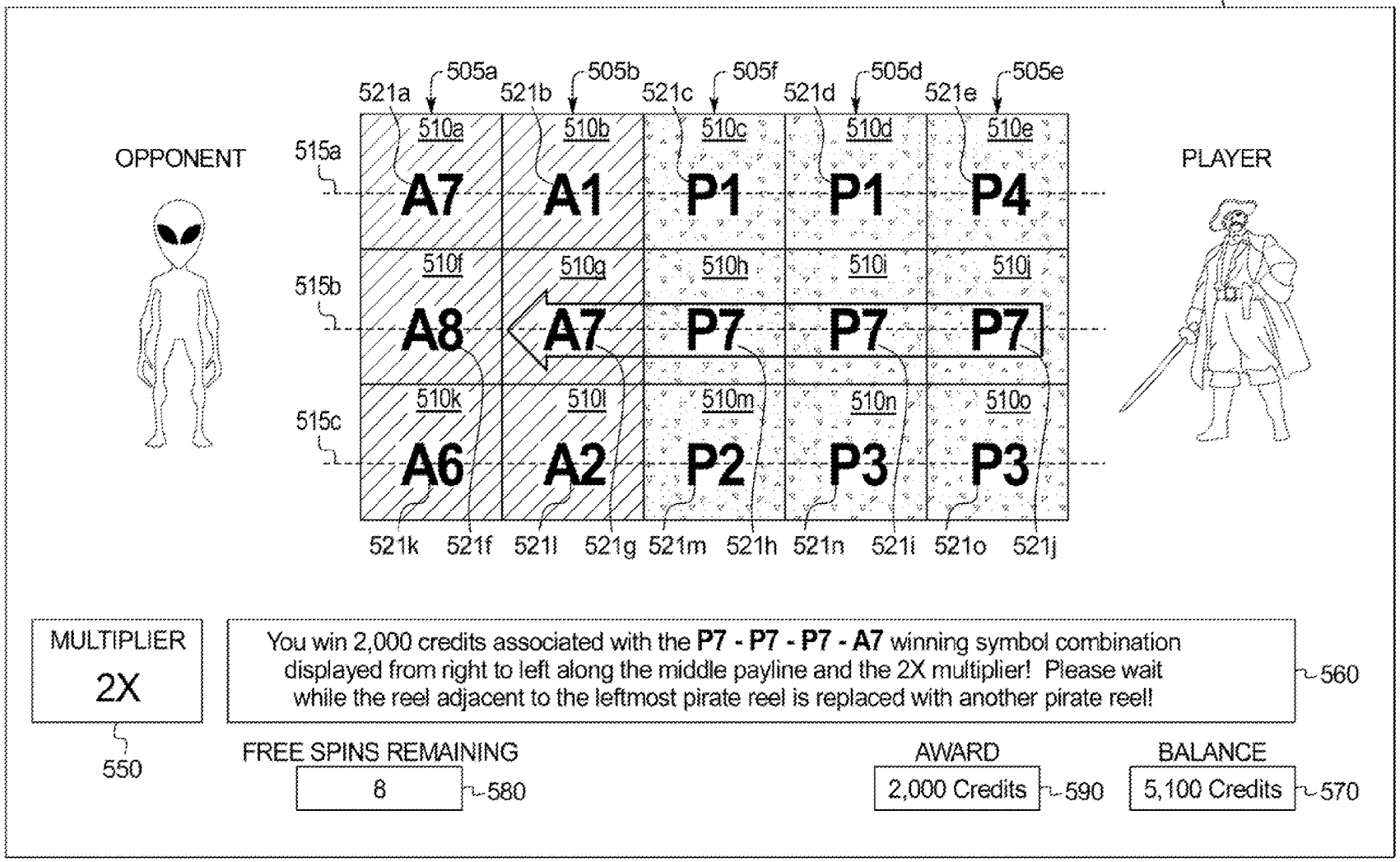

As illustrated in FIG. 5G, the gaming system stops the reels 505*a*, 505*b*, 505*c*, 505*d*, and 505*e* such that: (a) A7 symbol 521*a* is displayed at the symbol display area 510*a*, (b) A1 symbol 521*b* is displayed at the symbol display area 510*b*, (c) P1 symbol 521*c* is displayed at the symbol display area 510*c*, (d) P1 symbol 521*d* is displayed at the symbol display area 510*d*, (e) P4 symbol 521*e* is displayed at the symbol display area 510*e*, (f) A8 symbol 521*f* is displayed at the symbol display area 510*f*, (g) A7 symbol 521*g* is displayed at the symbol display area 510*g*, (h) P7 symbol 521*h* is displayed at the symbol display area 510*h*, (i) P7 symbol 521*i* is displayed at the symbol display area 510*i*, (j) P7 symbol 521*j* is displayed at the symbol display area 510*j*, (k) A6 symbol 521*k* is displayed at the symbol display area 510*k*, (l) A2 symbol 521*l* is displayed at the symbol display area 510*l*, (m) P2 symbol 521*m* is displayed at the symbol display area 510*m*, (n) P3 symbol 521*n* is displayed at the symbol display area 510*n*, and (o) P3 symbol 521*o* is displayed at the symbol display area 510*o*.

As noted above, the gaming system determines any awards associated with the free spin based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P7 521*j*, P7 521*i*, P7 521*h*, and A7 521*g* displayed from right to left along the payline 515*b* form one of the winning symbol combinations. The gaming system determines an award of 1,000 credits associated with the displayed P7-P7-P7-A7 winning symbol combination and modifies the 1,000 credit award by the 2× multiplier, which results in a total award of 2,000 credits. The gaming system displays the total award of 2,000 credits in the award meter 590, and updates the player's credit balance to reflect the total award of 2,000 credits.

The gaming system determines whether the first reel set modification event occurred in association with the free spin, as described above. Here, the gaming system determines that the first reel set modification event did not occur in association with the free spin because the sum of awards (0 credits) associated with any winning combinations of symbols displayed from left to right along any wagered-on paylines (no winning symbol combinations) is not greater than the sum of awards (1,000 credits) associated with any winning combinations of symbols displayed from right to left along any wagered-on paylines (the P7-P7-P7-A7 winning symbol combination).

The gaming system determines whether the second reel set modification event occurred in association with the free spin, as described above. Here, the gaming system determines that the second reel set modification event occurred in association with the free spin because: (a) the sum of awards (1,000 credits) associated with any winning combinations of symbols displayed from right to left along any wagered-on paylines (the P7-P7-P7-A7 winning symbol combination) is greater than the sum of awards (0 credits) associated with any winning combinations of symbols displayed from left to right along any wagered-on paylines (no winning symbol combinations); and (b) the reels 205*a* and 205*b* are not associated with the pirate theme.

As noted above, upon an occurrence of the second reel set modification event in this example embodiment, the gaming system modifies the set of reels by removing the reel that is adjacent to the leftmost reel having the pirate theme and replacing it with another reel that has the pirate theme. Thus, the modified set of reels includes one more reel having the pirate theme than it did before being modified. The gaming system displays the following message in the message box 260: "YOU WIN 2,000 CREDITS ASSOCIATED WITH THE P7-P7-A7 WINNING SYMBOL COMBINATION DISPLAYED FROM RIGHT TO LEFT ALONG THE MIDDLE PAYLINE AND THE 2× MULTIPLIER! PLEASE WAIT WHILE THE REEL ADJACENT TO THE LEFTMOST PIRATE REEL IS REPLACED WITH ANOTHER PIRATE REEL!"

Figure 5H:
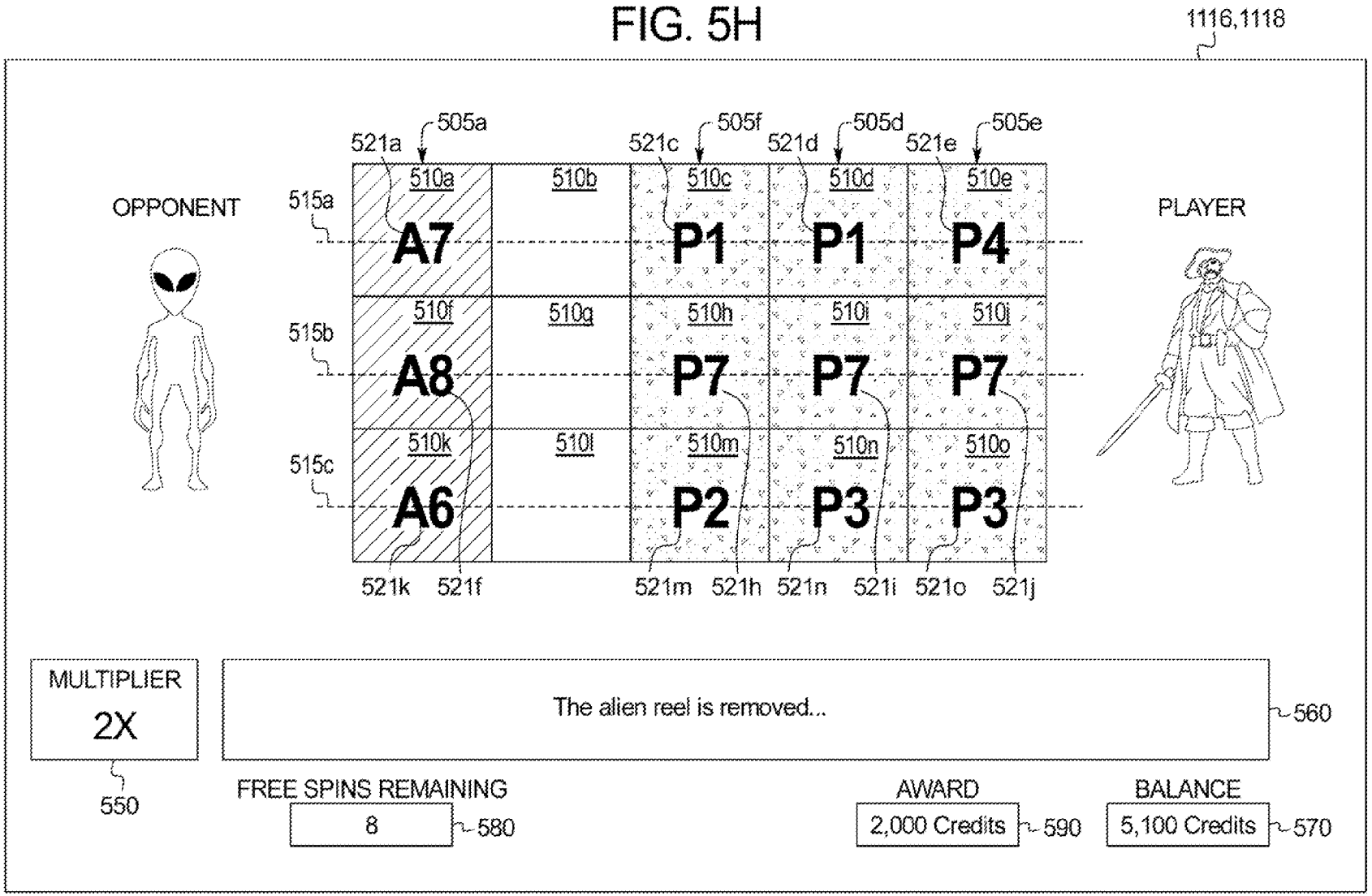
Figure 5I:
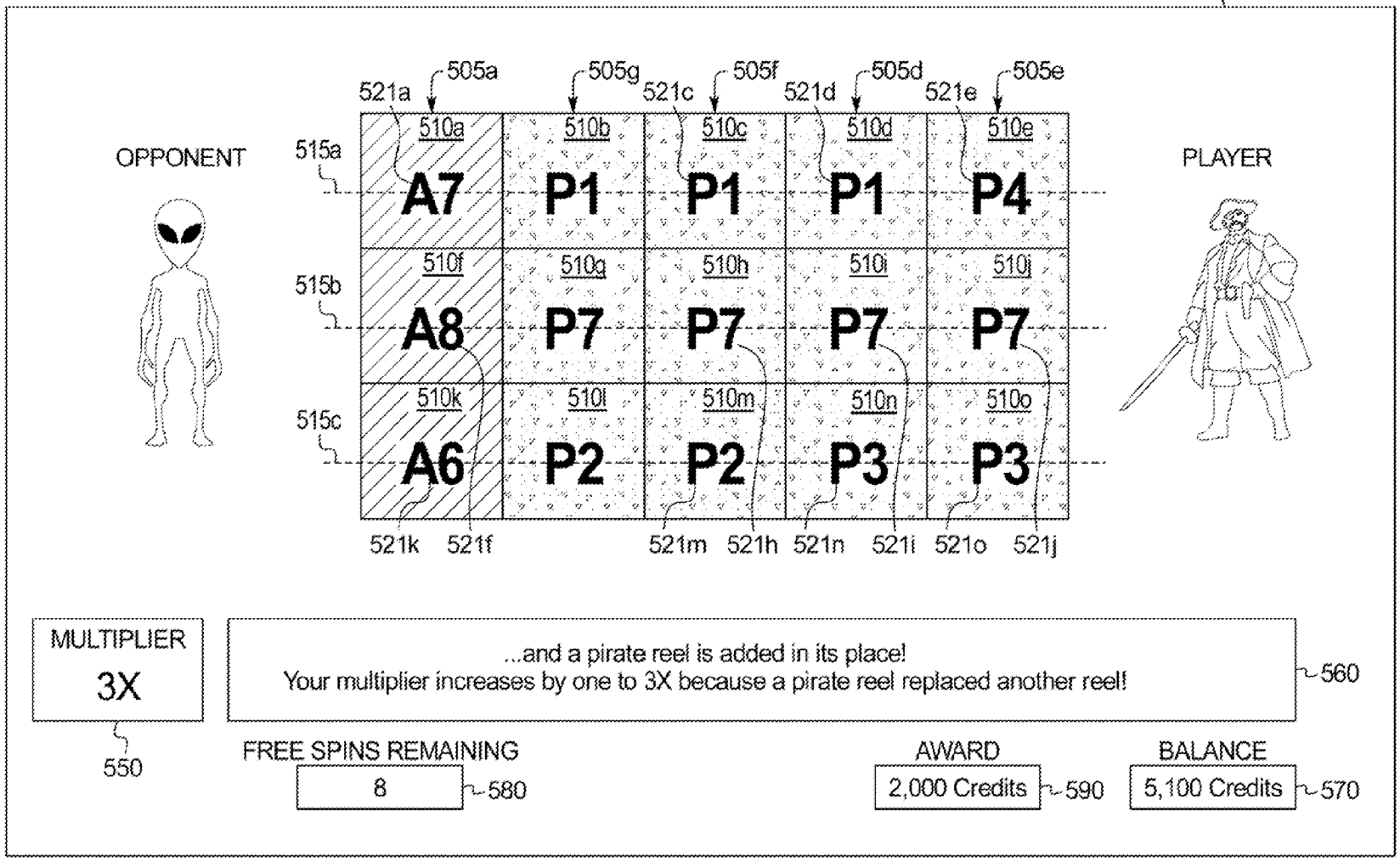

As illustrated in FIG. 5H, in this instance the leftmost reel that has the pirate theme is the reel 505*f*, and the reel that is adjacent to the reel 505*f* is the reel 505*b* (which has the alien theme). Accordingly, the gaming system removes the reel 505*b*. The gaming system displays the following message in the message box 560: "THE ALIEN REEL IS REMOVED . . . . " As illustrated in FIG. 5I, the gaming system replaces the removed reel 505*b* with reel 505*g*, which has the pirate theme, such that the reel 505*g* is associated with and configured to display symbols at the symbol display areas 510*b*, 510*g*, and 510*l*. Since the gaming system replaced a reel having the alien theme with a reel having the pirate theme, the gaming system increases the value of the multiplier by one to 3×, as shown in the multiplier display 550. The gaming system displays the following message in the message box 560: ". . . AND A PIRATE REEL IS ADDED IN ITS PLACE! YOUR MULTIPLIER INCREASES BY ONE TO 3× BECAUSE A PIRATE REEL REPLACED ANOTHER REEL!"

Other Embodiments

While the symbol generators are typically referred to herein as reels, it should be appreciated that the symbol generators may be any suitable symbol generators, such (but not limited to) as wheels, dice, or playing cards.

Figure 6A:
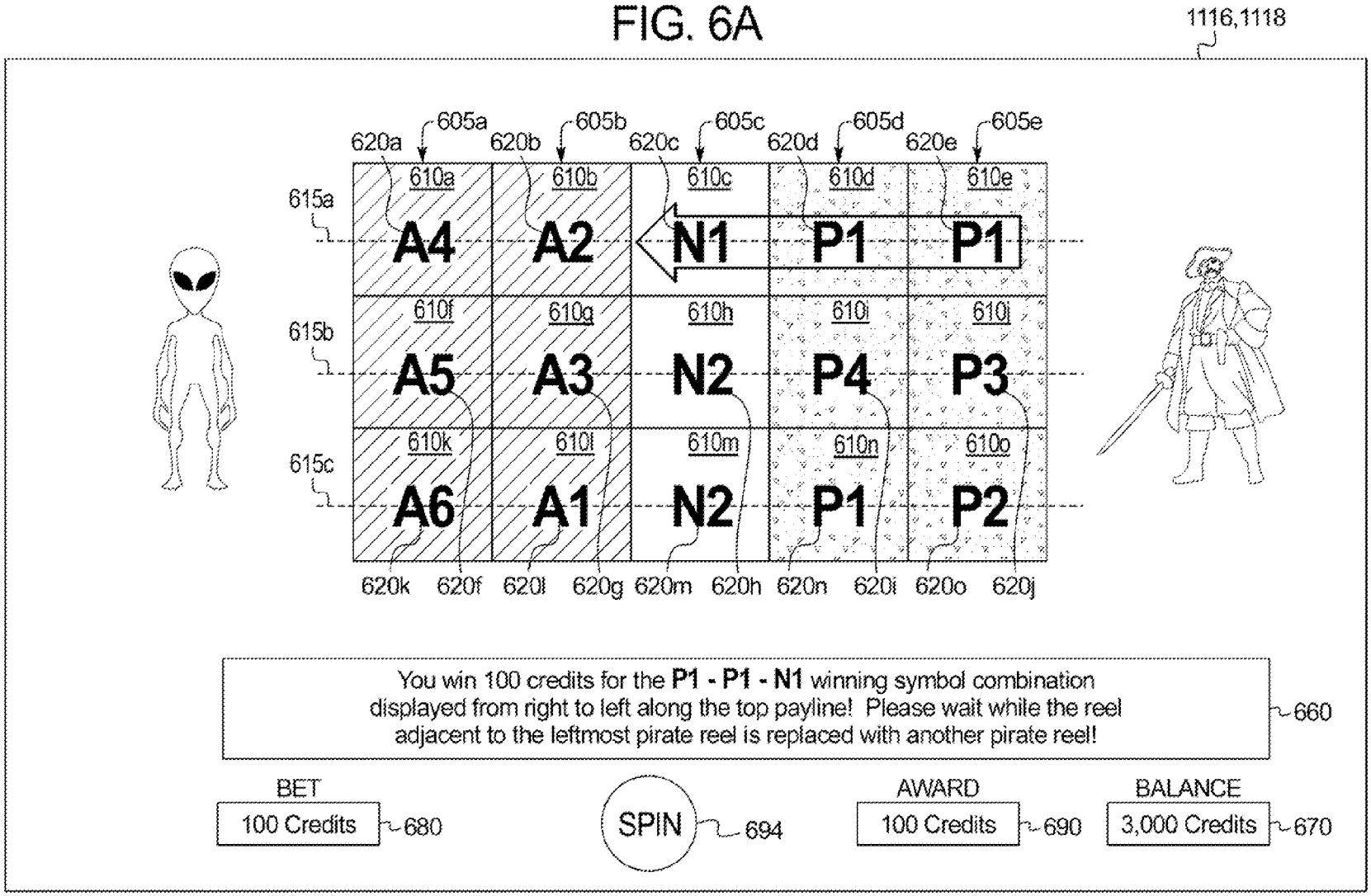
FIGS. 6A and 6B illustrate screen shots of another example embodiment of the gaming system of the present disclosure providing a play of another example embodiment of the game of the present disclosure.
Figure 6B:
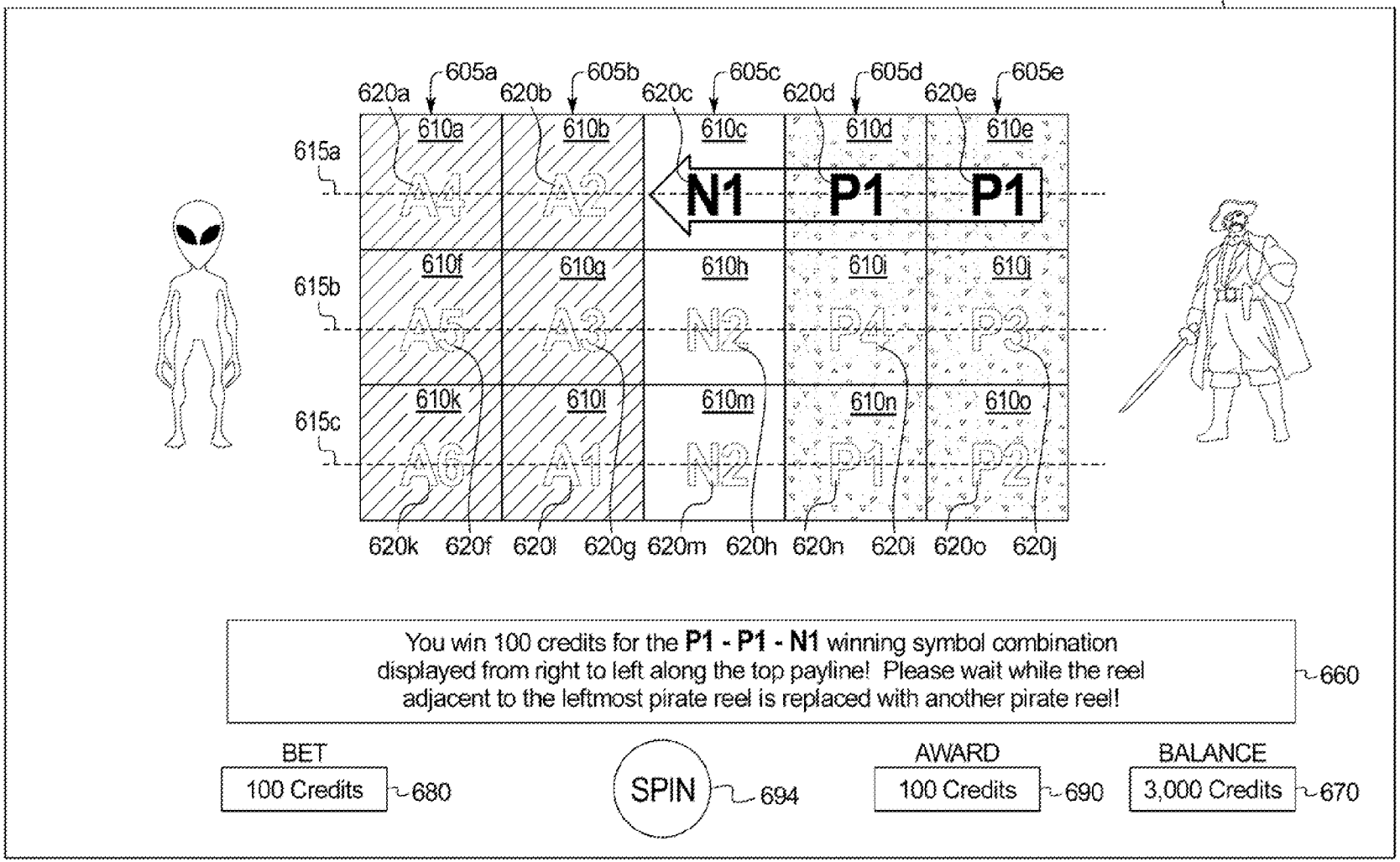

In various embodiments, the gaming system employs a fading symbols feature to emphasize which of the symbols displayed at the symbol display areas (if any) form winning symbol combinations. FIGS. 6A and 6B illustrate screen shots of the gaming system of the present disclosure providing one such example embodiment. As illustrated in FIG. 6A, the gaming system displays: (a) A4 symbol 620*a* at the symbol display area 610*a*, (b) A2 symbol 620*b* at the symbol display area 610*b*, (c) N1 symbol 620*c* at the symbol display area 610*c*, (d) P1 symbol 620*d* at the symbol display area 610*d*, (e) P1 symbol 620*e* at the symbol display area 610*e*, (f) A5 symbol 620*f* at the symbol display area 610*f*, (g) A3 symbol 620*g* at the symbol display area 610*g*, (h) N2 symbol 620*h* at the symbol display area 610*h*, (i) P4 symbol 620*i* at the symbol display area 610*i*, (j) P3 symbol 620*j* at the symbol display area 610*j*, (k) A6 symbol 620*k* at the symbol display area 610*k*, (l) A1 symbol 620*l* at the symbol display area 610*l*, (m) N2 symbol 620*m* at the symbol display area 610*m*, (n) P1 symbol 620*n* at the symbol display area 610*n*, and (o) P2 symbol 620*o* at the symbol display area 610*o*.

The gaming system determines any awards based on the symbols displayed at the symbol display areas by determining: (a) whether any winning combinations of the symbols included in the paytable associated with the game are displayed from left to right along any of the paylines, and (b) whether any winning combinations of the symbols are displayed from right to left along any of the paylines. Here, the gaming system determines that the symbols P1 620*e*, P1 620*d*, and N1 620*c* displayed from right to left along the payline 615*a* form one of the winning symbol combinations. The gaming system determines an award of 100 credits associated with the displayed P1-P1-N1 winning symbol combination, displays the 100 credit award in the award meter 290, and updates the player's credit balance to reflect the 100 credit award. As illustrated in FIG. 6B, the gaming system fades, removes, or otherwise deemphasizes the symbols that are not part of the displayed winning symbol combination (i.e., the symbols other than the symbols 620*e*, 620*d*, and 620*c*) to facilitate the player recognizing the winning symbol combination.

In the embodiments described above with respect to FIGS. 2A to 2I, 3A to 3I, 4A to 4I, and 5A to 5I, the initial set of reels includes two reels associated with a first characteristic, one reel associated with a second different characteristic, and two reels associated with a third different characteristic. It should be appreciated that, in other embodiments, the initial set of reels may include any suitable reels associated with any suitable characteristics. For instance, in one example embodiment, the initial set of reels includes one reel associated with a first characteristic, three reels associated with a second different characteristic, and one reel associated with a third different characteristic. In another example embodiment, each of the reels of the initial set of reels is associated with a same one of the characteristics.

In certain embodiments in which a reel set modification event occurs based at least in part on the display of one or more winning symbol combinations, the quantity of reels removed from the set and the quantity of reels added to the set are determined based on the particular winning symbol combination(s) that caused the reel set modification event to occur. In one example embodiment, the occurrence of a first winning symbol combination causes the gaming system to remove a first quantity of the reels and add a first quantity of reels, and the occurrence of a second different winning symbol combination causes the gaming system to remove a second different quantity of the reels and add a second different quantity of the reels. In one instance, the first winning symbol combination is rarer than the second winning symbol combination and the first quantity is greater than the second quantity.

In various embodiments, the gaming system prompts the player to perform an action, such as to actuate a button, while the gaming system removes one or more reels from the set, repositions one or reels of the set, and/or adds one or more reels to the set. The gaming system affects the displayed animation of such removal, repositioning, and/or adding based on the input received from the player. For instance, the faster the player actuates the button, the faster the gaming system shifts the reels, and vice-versa.

It should be appreciated that the reel set modification events may be any suitable events. For instance in one embodiment, the reel set modification event occurs when a designated quantity of at least one trigger symbol is generated and displayed for a play of the game. In another embodiment, the reel set modification event occurs when the player collects a designated quantity of at least two trigger symbols in the same play of the game or over a plurality of different plays of the game. In another embodiment, the reel set modification event occurs when a play of the game is completed. In other words, in this embodiment, the gaming system removes and adds at least one reel after each play of the game. In another embodiment, the gaming system enables the player to choose the reel set modification event. For instance, upon initiation of the a play of the game, the gaming system enables the player to select one of a plurality of different events, and employs the selected event as the reel set modification event. In another embodiment, the reel set modification event is a mystery event that occurs randomly at the start of a play of the game. In another embodiment, the reel set modification event occurs when one of at least one designated outcome (such as a designated winning outcome) is generated and displayed for a play of the game. It should be appreciated that the gaming system may employ any suitable combination of a plurality of different reel set modification events, at least two of which may have different results (e.g., when a first reel set modification event occurs, the gaming system removes a single reel and adds a single reel, and when a second different reel set modification event occurs, the gaming system removes two reels and adds two reels).

In certain embodiments, the plurality of reels includes reels associated with either a first characteristic or a second different characteristic. In one example embodiment, the game is associated with a first reel set modification event. If the first reel set modification event occurs, the gaming system modifies the set of reels such that the set of reels includes at least one more reel associated with the first characteristic than it did before the modification. In this example embodiment, the gaming system is not configured to modify the set of reels such that the set of reels includes at least one more reel associated with the second characteristic than it did before the modification.

In certain embodiments, instead of (or in addition to) displaying the changing characteristic(s) of the symbol generator(s) upon the occurrences of the symbol generator modification event(s) during game play, the gaming system maintains counts of the occurrence(s) of the symbol generator modification event(s). In such embodiments, the bonus triggering event occurs when one of the counts reaches a designated quantity or when a difference between two of the counts reaches a designated quantity.

For instance, in an embodiment in which the gaming system employs first and second symbol generator modification events, the gaming system: (a) triggers the first bonus when the count associated with the first symbol generator modification event is a designated quantity higher than the count associated with the second symbol generator modification event, and (b) triggers the second bonus when the count associated with the second symbol generator modification event is a designated quantity higher than the count associated with the first symbol generator modification event. In another embodiment in which the gaming system employs first and second symbol generator modification events, the gaming system: (a) triggers the first bonus when the count associated with the first symbol generator modification event reaches a designated quantity (regardless of the count associated with the second symbol generator modification event), and (b) triggers the second bonus when the count associated with the second symbol generator modification event reaches a designated quantity (regardless of the count associated with the first symbol generator modification event). In an example embodiment in which the gaming system employs a single symbol generator modification event, the gaming system triggers the bonus when the count reaches a designated quantity.

In various embodiments, when the reel set modification event associated with a particular characteristic occurs and all of the reels of the set are associated with that characteristic, the gaming system modifies at least one of the reels in the set such that the at least one reel: (a) includes a higher concentration of high value symbols (such as major symbols, Wild symbols, and/or Bonus symbols) than low value symbols; (b) includes only high value symbols; (c) includes at least one multiplier Wild symbol; (d) includes at least one modifier (such as a multiplier); (e) includes a stack of a plurality of instances of a Wild symbol arranged adjacent to one another; (f) includes a stack of a plurality of instances of a multiplier Wild symbol arranged adjacent to one another (g) includes at least one free play retrigger symbol that, if generated and displayed for a play of the game, causes the gaming system to provide at least one free play of the game; (h) includes one or more trigger that, when generated and displayed for a play of the game, cause the reel set modification event to occur; (i) includes one or more split symbols (such as double symbols, triple symbols, or quadruple symbols); (j) includes a stack of a plurality of instances of a symbol arranged adjacent to one another; (k) includes one or more bonus trigger symbols that, if generated and displayed for a play of the game, cause the gaming system to provide one or more bonus features (such as bonus games); (l) includes one or more accumulative symbols that the player may accumulate and subsequently redeem to convert certain symbols (such as low value symbols) into designated symbols (such as Wild symbols); (m) includes one or more scatter symbols that, if generated and displayed for a play of the slot game, cause the gaming system to provide a scatter award; (n) includes one or more symbols not associated with at least one of the reels and that are included in one or more new winning symbol combinations; (o) includes one or more symbols that, if generated and displayed during a play of the slot game, cause the gaming system to re-spin one or more of the reels; (p) includes a vertical or a horizontal tumbling reels feature; (q) includes a locked wilds feature in which at least one Wild symbol is guaranteed to be generated and displayed at a specific symbol display areas associated with that reel following the spin; (r) includes a changing symbol stack feature in which the symbols that are stacked change as the reels shift and/or spin; (s) includes a wild reel feature that causes the reel to, when stopped, display all Wild symbols a certain percentage of the time, wherein the percentage is less than 100%; and/or (t) includes a symbol that triggers a progressive jackpot if that symbol is generated and displayed on one of the reels and, in certain embodiments, is part of a displayed winning symbol combination.

In certain embodiments, the gaming system enables a player to place a side bet associated with a particular play of the game that is associated with one of the characteristics. If the gaming system modifies the set of reels in association with that play of the game such that the set of reels includes more reels associated with the wagered-on characteristic, the gaming system provides the player an award associated with the side bet. If not, the player forfeits the side bet.

In further embodiments, the gaming system enables a player to place a side bet associated with a particular characteristic. If the set of reels is modified such that a designated quantity of the reels (such as all of the reels) are each associated with the wagered-on characteristic before the set of reels is modified such that the designated quantity of the reels are each associated with a characteristic other than the wagered-on characteristic, the gaming system provides the player an award associated with the side bet. If not, the player forfeits the side bet.

It should be appreciated that the plurality of reels may include any suitable quantity of reels, and that the quantity of reels included in the plurality of reels may be determined in any suitable manner(s) or based on any suitable factor(s). In one example embodiment, the quantity of reels in the set is determined based on a wager placed by the player on the play of the primary wagering game that triggered the free spin bonus such that the higher the wager, the higher the quantity of reels. It should also be appreciated that which reels are included in the set may be determined in any suitable manner. In one example, the gaming system employs a predetermined plurality of reels or one of a plurality of predetermined pluralities of reels. In another example, the gaming system dynamically generates which reels to include in the plurality of reels either before play of the game or as reels are removed.

In various embodiments, upon the occurrence of a reel set modification event, the gaming system: (a) removes a designated quantity of the reels from the set and adds the same designated quantity of reels to the set (e.g., removes one reel and adds one reel, removes two reels and adds two reels, removes three reels and adds three reels, removes four reels and adds four reels, or removes five reels and adds five reels); (b) removes a randomly determined quantity of the reels from the set and adds that same randomly determined quantity of reels to the set; (c) removes a quantity of the reels from the set determined based on the reel set modification event and adds that same determined quantity of reels to the set; (d) removes and adds different quantities of the reels (e.g., removes one reel and adds two reels); (e) replaces the current set of the reels with another different predetermined set of the reels; (f) updates certain background elements to signify the removal of and the addition of reels (for example, displays a protagonist character attacking an antagonist character when one or more reels associated with the protagonist character replace one or more reels associated with the antagonist character crystals); and/or (g) adds at least one reel to the set without removing any of the reels from the set (e.g., a five reel slot game becomes a six reel slot game after the occurrence of the reel set modification event).

In certain embodiments, the battling symbol generators game is associated with a plurality of different symbol generators and a plurality of different symbols. In these embodiments: (a) each of the symbols is associated with one of a plurality of different characteristics; (b) each of the symbol generators is associated with two or more of the symbols; and (c) initially, for each of the symbol generators, the symbols associated with that symbol generator are each associated with a same one of the characteristics.

In one example embodiment, initially, a first quantity of the symbols associated with a set of two or more of the plurality of symbol generators are associated with a first characteristic and a second quantity of the symbols of the set of the symbol generators are associated with a second different characteristic. In operation of this example embodiment, for a play of the game, for each symbol generator of the set, the gaming system displays that symbol generator in association with one or more of a plurality of symbol display areas. For each symbol generator of the set, the gaming system displays at least one of the symbols associated with that symbol generator at each of the one or more symbol display areas with which that symbol generator is associated. The gaming system determines any awards associated with the displayed symbols and displays any determined awards.

The gaming system determines whether a first symbol modification event occurred in association with the play of the game. If the gaming system determines that the first symbol modification event occurred in association with the play of the game, the gaming system modifies at least one of symbols of at least one of the symbol generators of the set such that a third quantity of the symbols associated with the set are each associated with the first characteristic, wherein the third quantity is greater than the first quantity.

The gaming system determines whether a second different symbol modification event occurred in association with the play of the game. If the gaming system determines that the second symbol modification event occurred in association with the play of the game, the gaming system modifies at least one of symbols of at least one of the symbol generators of the set such that a fourth quantity of the symbols associated with the set are each associated with the second characteristic, wherein the fourth quantity is greater than the second quantity.

In an embodiment in which the first symbol modification event occurs when a winning symbol combination is displayed from left to right along a wagered-on payline and in which the second symbol modification event occurs when a winning symbol combination is displayed from right to left along a wagered-on payline: (a) upon an occurrence of the first symbol modification event, the gaming system modifies the symbols included in the displayed winning symbol combination (if necessary) such that each of the symbols included in the displayed winning symbol combination are associated with the first characteristic; and (b) upon an occurrence of the second symbol modification event, the gaming system modifies the symbols included in the displayed winning symbol combination (if necessary) such that each of the symbols included in the displayed winning symbol combination are associated with the second characteristic. It should thus be appreciated that, in this embodiment, the gaming system does not modify any symbols (displayed or not displayed) that are not included in a displayed winning symbol combination.

In another embodiment in which the first symbol modification event occurs when a winning symbol combination is displayed from left to right along a wagered-on payline and in which the second symbol modification event occurs when a winning symbol combination is displayed from right to left along a wagered-on payline: (a) upon an occurrence of the first symbol modification event, the gaming system modifies the displayed symbols associated with a particular symbol generator (if necessary) such that the displayed symbols associated with that symbol generator are each associated with the first characteristic; and (b) upon an occurrence of the second symbol modification event, the gaming system modifies the displayed symbols associated with a particular symbol generator (if necessary) such that the displayed symbols associated with that symbol generator are each associated with the second characteristic. It should thus be appreciated that, in this embodiment, the gaming system does not modify any of the symbols associated with that symbol generator that are not displayed.

In various embodiments employing the symbol modification event(s), a bonus triggering event occurs when: (a) the symbols displayed at the symbol display areas are each associated with the same characteristic (e.g., all of the generated and displayed symbols are associated with an alien characteristic); (b) the symbols included in any displayed winning symbol combinations are each associated with the same characteristic (e.g., all of the symbols included in a winning symbol combination displayed from left to right along a wagered-on payline are associated with the alien characteristic); and/or (c) the symbols associated with a particular symbol generator (or a particular plurality of symbol generators) are each associated with the same characteristic (e.g., all of the symbols associated with a particular symbol generator are associated with the alien characteristic).

It should be appreciated that the gaming system may provide one or more of the following instead of or in addition to a play of a bonus game when one of the bonus triggering events occurs: (1) monetary credits or currency; (2) non-monetary credits or currency; (3) a modifier such as a multiplier used to modify one or more awards; (4) one or more free plays of a game; (5) one or more lottery based awards (such as one or more lottery or drawing tickets); (6) a wager match for one or more plays of the a wagering game; (7) an increase in an average expected payback percentage of a bonus game and/or an average expected payback percentage of a primary wagering game for one or more plays; (8) one or more comps (such as a free dinner or a free night's stay at a hotel); (9) one or more bonus or promotional credits usable for online play; (10) one or more player tracking points; (11) a multiplier for player tracking points or credits; 12) an increase in a membership or player tracking level; (13) one or more coupons or promotions usable within a gaming establishment and/or outside of the gaming establishment (e.g., a 20% off coupon for use at a retail store or a promotional code providing a deposit match for use in association with an online casino); (14) an access code usable to unlock content on the Internet; (15) a progressive jackpot or other progressive award; (16) a high value product or service (such as a car); and (17) a low value product or service (such as a teddy bear).

It should be appreciated that any of the alternative embodiments described herein may be employed with any of the example embodiments described herein.

It should be appreciated that:

(a) the type of symbol generators;
(b) the particular symbol generators in the plurality of symbol generators;
(c) the quantity of symbol generators in the plurality of symbol generators;
(d) the particular characteristics;
(e) the quantity of characteristics;
(f) which characteristics the symbol generators are associated with;
(g) the quantity of symbol display areas;
(h) the arrangement of the symbol display areas;
(i) which particular symbol display areas are associated with the symbol generators;
(j) the quantity of symbol display areas associated with the symbol generators;
(k) the particular symbols;
(l) the symbols associated with the symbol generators;
(m) the winning symbol combinations;
(n) the awards associated with the winning symbol combinations;
(o) the symbol generator modification events;
(p) the manner in which the gaming system modifies the set of symbol generators upon the occurrence of the symbol generator modification event;
(q) the quantity of symbol generators replaced upon the occurrence of the symbol generator modification event;
(r) the quantity of symbol generators repositioned upon the occurrence of the symbol generator modification event;
(s) the quantity of symbol generators added upon the occurrence of the symbol generator modification event;
(t) the particular of symbol generators replaced upon the occurrence of the symbol generator modification event;
(u) the particular of symbol generators repositioned upon the occurrence of the symbol generator modification event;
(v) the particular of symbol generators added upon the occurrence of the symbol generator modification event;
(w) the bonus triggering event;
(x) the quantity of paylines;
(y) the symbol display areas with which the paylines are associated;
(z) the reels included in the initial set of reels;
(aa) the different bonuses;
(bb) the timer activation events;
(cc) the timer increase event;
(dd) how the gaming system extends the designated period upon the occurrence of the timer increase event;
(ee) the initial value of the modifier;
(ff) the designated period;
(gg) how much the gaming system increases the value of the modifier;
(hh) how the gaming system determines which characteristic to assign to the player;
(ii) the quantity of free spins;
(jj) when the gaming system increases the modifier;
(kk) in embodiments in which the gaming system employs a single reel modification event, the determination of how to modify the set of symbol generators; and/or
(ll) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 7A:
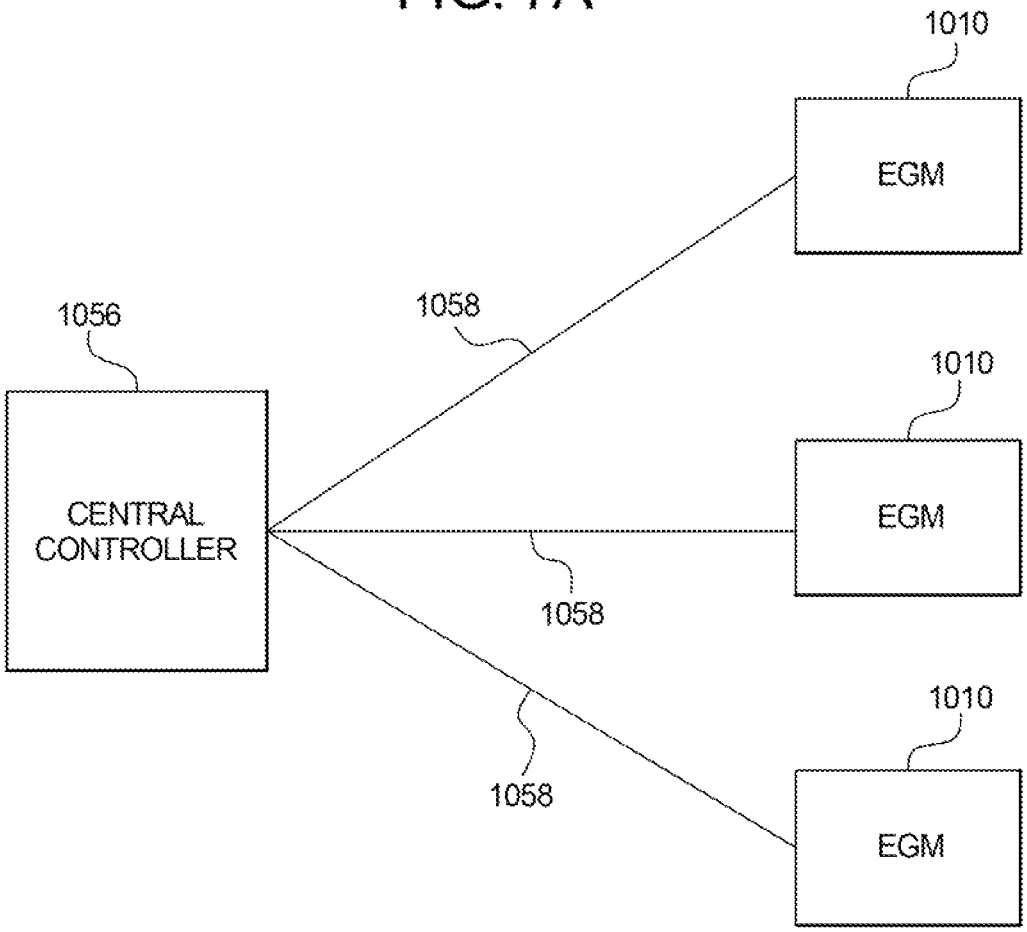
FIG. 7A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 7A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 7B:
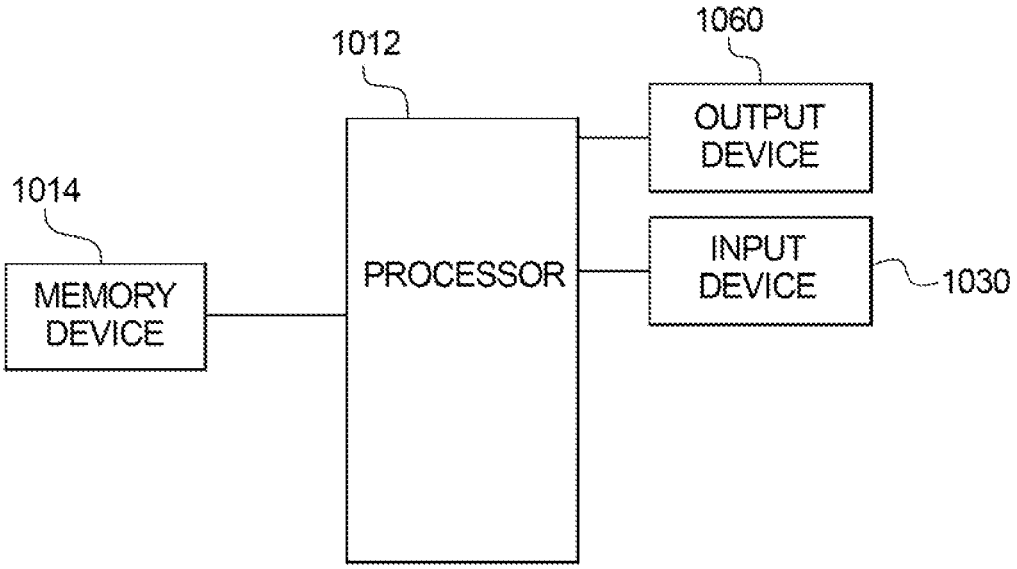
FIG. 7B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 7B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 7B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 8A:
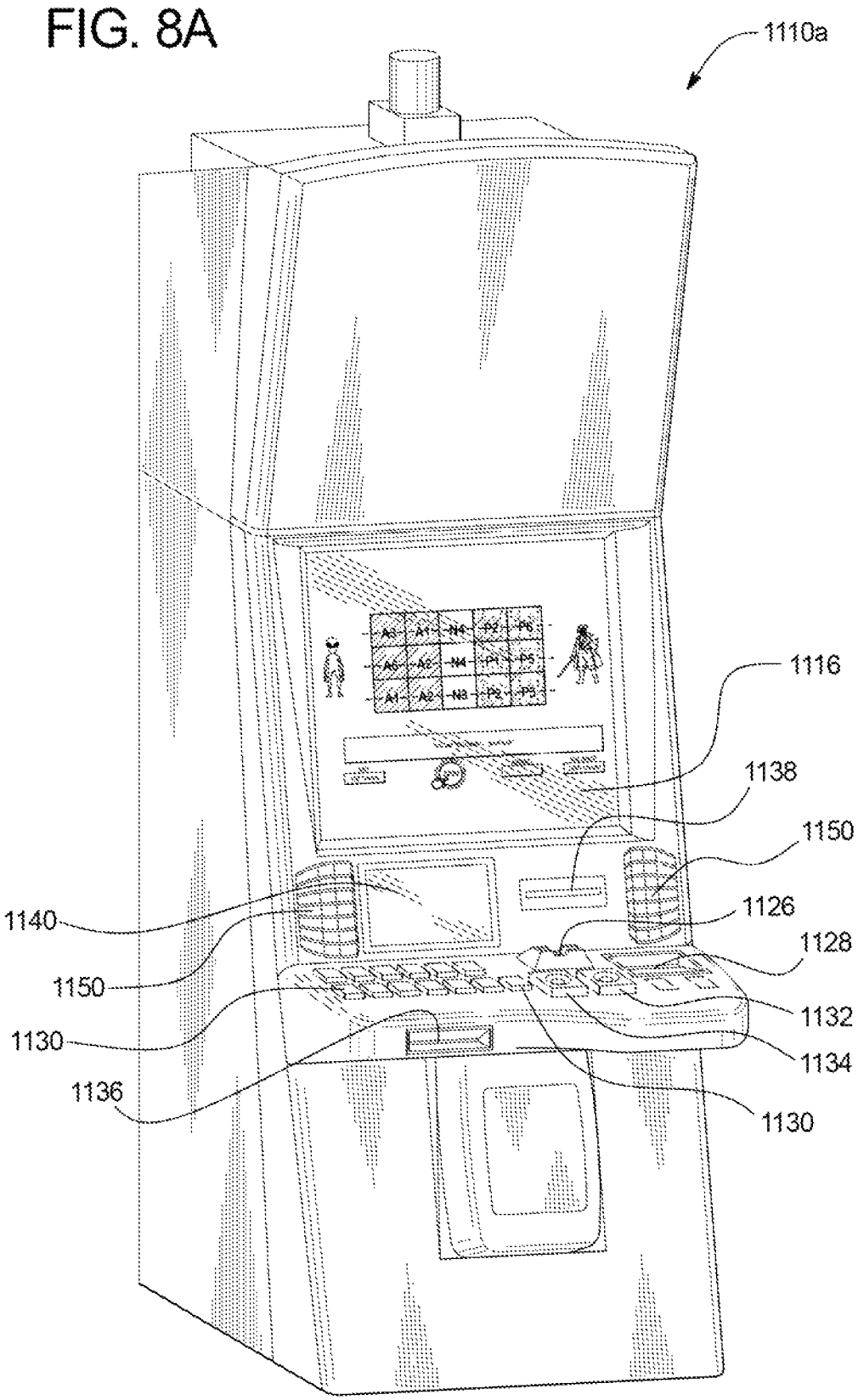
FIGS. 8A and 8B are perspective views of example alternative embodiments of the gaming system of the present disclosure.
Figure 8B:
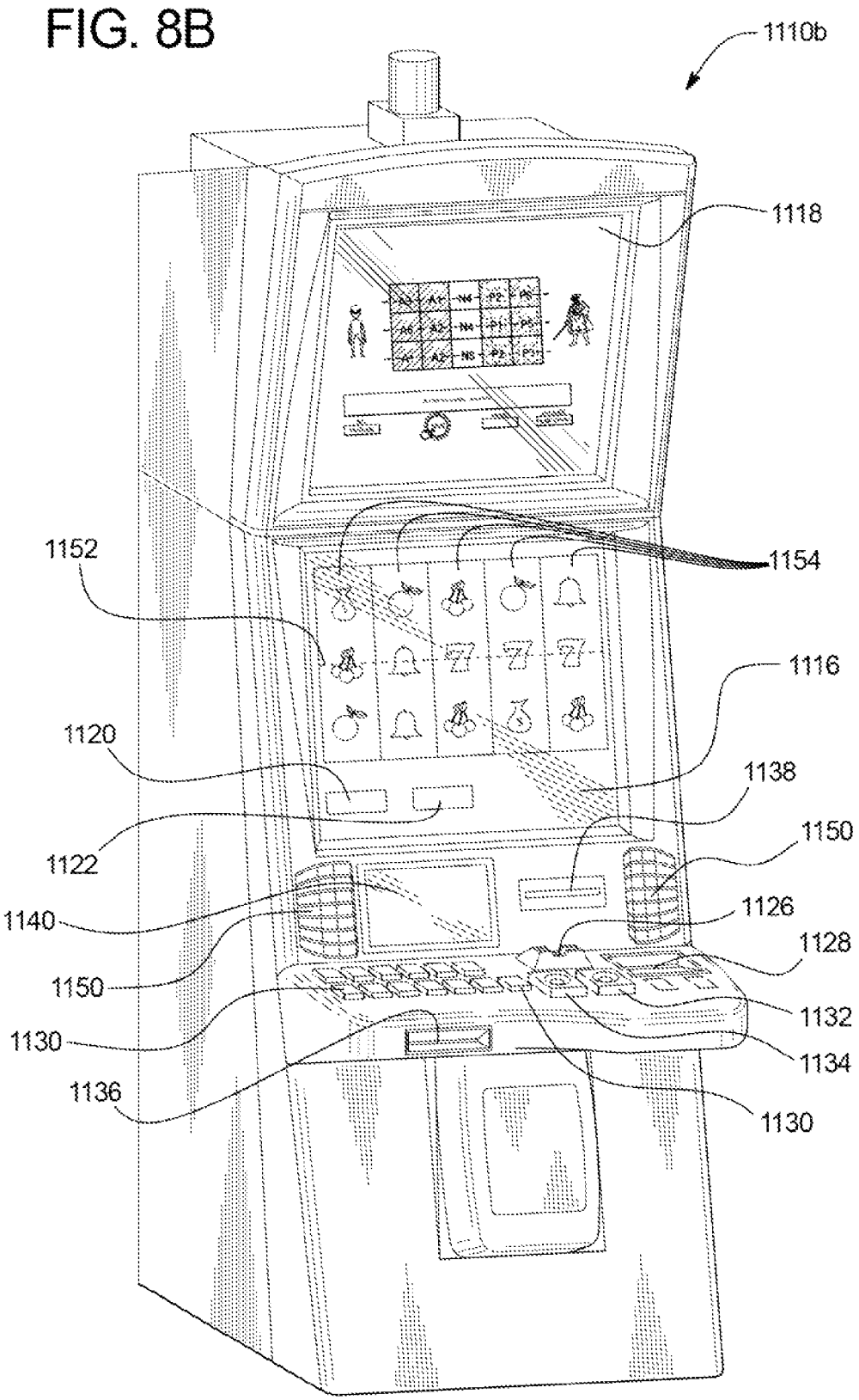

In various embodiments, the EGM includes one or more input devices. The input devices may include any suitable device that enables an input signal to be produced and received by the at least one processor of the EGM. The example EGM illustrated in FIG. 7B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 8A and 8B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 8A and 8B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 8A and 8B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 8A and 8B each include a card reader 1138. The card reader is configured to read a player identification card inserted into the card reader.

In various embodiments, the EGM includes one or more output devices. The example EGM illustrated in FIG. 7B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 8A includes a central display device 1116, a player tracking display 1140, a credit display 1120, and a bet display 1122. The example EGM illustrated in FIG. 8B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 8A and 8B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 8A and 8B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 8A and 8B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 8A and 8B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versae.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 8B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing and including an acceptor;

at least one display device supported by the housing;

at least one processor; and at least one memory device that stores a plurality of instructions which, when executed by the at least one processor, cause the at least one processor to operate with the plurality of input devices and the at least one display device to:

(a) establish a credit balance based at least in part on a monetary value associated with a physical item after the acceptor receives the physical item:

(b) place a wager on a play of a game following receipt of an actuation of a wager button, the credit balance decreasable by the wager, said play of the game associated with a set of a plurality of symbol generators each including a plurality of symbols, wherein: (i) a first quantity of the symbol generators of said set are each associated with a first characteristic, and (ii) a second quantity of the symbol generators of said set are each associated with a second different characteristic, the first quantity and the second quantity being at least one;

(c) for said play of the game, randomly determine a plurality of the symbols of the set of the plurality of symbol generators, display the randomly-determined symbols at a plurality of symbol display positions, and determine any awards based on the randomly-determined symbols, the credit balance increasable by any determined awards;

(d) if a first symbol generator set modification event occurs in association with said play of the game, modify said set of symbol generators such that a third quantity of the symbol generators of said set are each associated with the first characteristic, said third quantity being greater than said first quantity;

(e) if a second different symbol generator set modification event occurs in association with said play of the game, modify said set of symbol generators such that a fourth quantity of the symbol generators of said set are each associated with the second characteristic, said fourth quantity being greater than said second quantity; and (f) initiate a payout associated with a credit balance following receipt of an actuation of a cashout button.

2. The gaming system of claim 1, wherein the plurality of instructions, when executed by the at least one processor, cause the at least one processor to: (a) provide a bonus associated with the first characteristic if a first bonus triggering event occurs, and (b) provide a bonus associated with the second characteristic if a second different bonus triggering event occurs.

3. The gaming system of claim 2, wherein: (a) the first bonus triggering event occurs when a designated quantity of the symbol generators of said set are each associated with the first characteristic, and (b) the second bonus triggering event occurs when the designated quantity of the symbol generators of said set are each associated with the second characteristic.

4. The gaming system of claim 3, wherein the designated quantity of the symbol generators of said set includes all of the symbol generators of said set.

5. The gaming system of claim 2, wherein the plurality of instructions, when executed by the at least one processor, cause the at least one processor to operate with the at least one display device to reset the set of symbol generators to an initial set of symbol generators upon the occurrence of one of the first bonus triggering event and the second bonus triggering event.

6. The gaming system of claim 1, wherein the first symbol generator set modification event and the second symbol generator set modification event occur based, at least in part, on any winning symbol combinations displayed for said play of the game.

7. A method of operating a gaming system, said method comprising:

(a) receiving, by an acceptor, a physical item associated with a monetary value;

(b) causing at least one processor to execute a plurality of instructions stored in at least one memory device to establish a credit balance based at least in part on the monetary value associated with the received physical item;

(c) receiving an actuation of a wager button;

(d) causing the at least one processor to execute the plurality of instructions to place a wager on a play of a game in response to receipt of the actuation of the wager button, the credit balance decreasable by the wager, said play of the game associated with a set of a plurality of symbol generators each including a plurality of symbols, wherein: (i) a first quantity of the symbol generators of said set are each associated with a first characteristic, and (ii) a second quantity of the symbol generators of said set are each associated with a second different characteristic, the first quantity and the second quantity being at least one;

(e) for said play of the game, causing the at least one processor to execute the plurality of instructions to randomly determine a plurality of the symbols of the set of the plurality of symbol generators, operate with at least one display device to display the randomly-determined symbols at a plurality of symbol display positions, and determine any awards based on the randomly-determined symbols, the credit balance increasable by any determined awards (f) if a first symbol generator set modification event occurs in association with said play of the game, causing the at least one processor to execute the plurality of instructions to modify said set of symbol generators such that a third quantity of the symbol generators of said set are each associated with the first characteristic, said third quantity being greater than said first quantity;

(g) if a second different symbol generator set modification event occurs in association with said play of the game, causing the at least one processor to execute the plurality of instructions to modify said set of symbol generators such that a fourth quantity of the symbol generators of said set are each associated with the second characteristic, said fourth quantity being greater than said second quantity (h) receiving an actuation of a cashout button; and (i) causing the at least one processor to execute the plurality of instructions to initiate a payout associated with the credit balance in response to receipt of the actuation of the cashout button.

8. The method of claim 7, which includes: (a) providing a bonus associated with the first characteristic if a first bonus triggering event occurs, and (b) providing a bonus associated with the second characteristic if a second different bonus triggering event occurs.

9. The method of claim 8, wherein: (a) the first bonus triggering event occurs when a designated quantity of the symbol generators of said set are each associated with the first characteristic, and (b) the second bonus triggering event occurs when the designated quantity of the symbol generators of said set are each associated with the second characteristic.

10. The method of claim 9, wherein the designated quantity of the symbol generators of said set includes all of the symbol generators of said set.

11. The method of claim 8, which includes causing the at least one processor to execute the plurality of instructions to operate with the at least one display device to reset the set of symbol generators to an initial set of symbol generators upon the occurrence of one of the first bonus triggering event and the second bonus triggering event.

12. The method of claim 7, wherein the first symbol generator set modification event and the second symbol generator set modification event occur based, at least in part, on any winning symbol combinations displayed for said play of the game.

13. The method of claim 7, which is provided through a data network.

14. The method of claim 13, wherein the data network is an internet.

15. A gaming system comprising:

a housing;

a plurality of input devices supported by the housing and including an acceptor;

at least one display device supported by the housing;

at least one processor; and at least one memory device that stores a plurality of instructions which, when executed by the at least one processor, cause the at least one processor to operate with the plurality of input devices and the at least one display device to:

(a) establish a credit balance based at least in part on a monetary value associated with a physical item after the acceptor receives the physical item;

(b) place a wager on a play of a game following receipt of an actuation of a wager button, the credit balance decreasable by the wager, said play of the game associated with a set of a plurality of symbol generators each including a plurality of symbols, wherein: (i) a first quantity of the symbol generators of said set are each associated with a first characteristic, and (ii) a second quantity of the symbol generators of said set are each associated with a second different characteristic, the first quantity and the second quantity being at least one;

(c) for said play of the game, randomly determine a plurality of the symbols of the set of the plurality of symbol generators, display the randomly-determined symbols at a plurality of symbol display positions, and determine any awards based on the randomly-determined symbols, the credit balance increasable by any determined awards;

(d) if a symbol generator set modification event occurs in association with said play of the game, modify said set of symbol generators such that one of:

(i) a third quantity of the symbol generators of said set are each associated with the first characteristic, said third quantity being greater than said first quantity; and (ii) a fourth quantity of the symbol generators of said set are each associated with the second characteristic, said fourth quantity being greater than said second quantity; and (e) initiate a payout associated with the credit balance following receipt of an actuation of a cashout button.

16. The gaming system of claim 15, wherein the plurality of instructions, when executed by the at least one processor, cause the at least one processor to: (a) provide a bonus associated with the first characteristic if a first bonus triggering event occurs, and (b) provide a bonus associated with the second characteristic if a second different bonus triggering event occurs.

17. The gaming system of claim 16, wherein: (a) the first bonus triggering event occurs when a designated quantity of the symbol generators of said set are each associated with the first characteristic, and (b) the second bonus triggering event occurs when the designated quantity of the symbol generators of said set are each associated with the second characteristic.

18. The gaming system of claim 17, wherein the designated quantity of the symbol generators of said set includes all of the symbol generators of said set.

19. The gaming system of claim 16, wherein the plurality of instructions, when executed by the at least one processor, cause the at least one processor to operate with the at least, one display device to reset the set of symbol generators to an initial set of symbol generators upon the occurrence of one of the first bonus triggering event and the second bonus triggering event.

20. The gaming system of claim 15, wherein the symbol generator set modification event occurs based, at least in part, on any winning symbol combinations displayed for said play of the game.

21. A method of operating a gaming system, said method comprising:

(a) receiving, by an acceptor, a physical item associated with a monetary value;

(b) causing at least one processor to execute a plurality of instructions stored in at least one memory device to establish a credit balance based at least in part on the monetary value associated with the received physical item;

(c) receiving an actuation of a wager button;

(d) causing the at least one processor to execute the plurality of instructions to place a wager on a play of a game in response to receipt of the actuation of the wager button, the credit balance decreasable by the wager, said play of the game associated with a set of a plurality of symbol generators each including a plurality of symbols, wherein: (i) a first quantity of the symbol generators of said set are each associated with a first characteristic, and (ii) a second quantity of the symbol generators of said set are each associated with a second different characteristic, the first quantity and the second quantity being at least one;

(e) for said play of the game, causing the at least one processor to execute the plurality of instructions to randomly determine a plurality of the symbols of the set of the plurality of symbol generators, operate with at least one display device to display the randomly-determined symbols at a plurality of symbol display positions, and determine any awards based on the randomly-determined symbols, the credit balance increasable by any determined awards;

(f) if a symbol generator set modification event occurs in association with said play of the game, causing the at least one processor to execute the plurality of instructions to modify said set of symbol generators such that one of:

(i) a third quantity of the symbol generators of said set are each associated with the first characteristic, said third quantity being greater than said first quantity; and (ii) a fourth quantity of the symbol generators of said set are each associated with the second characteristic, said fourth quantity being greater than said second quantity;

(g) receiving an actuation of a cashout button; and (h) causing the at least one processor to execute the plurality of instructions to initiate a payout associated with the credit balance in response to receipt of the actuation of the cashout button.

22. The method of claim 21, which includes: (a) providing a bonus associated with the first characteristic if a first bonus triggering event occurs, and (b) providing a bonus associated with the second characteristic if a second different bonus triggering event occurs.

23. The method of claim 22, wherein: (a) the first bonus triggering event occurs when a designated quantity of the symbol generators of said set are each associated with the first characteristic, and (b) the second bonus triggering event occurs when the designated quantity of the symbol generators of said set are each associated with the second characteristic.

24. The method of claim 23, wherein the designated quantity of the symbol generators of said set includes all of the symbol generators of said set.

25. The method of claim 22, which includes causing the at least one processor to execute the plurality of instructions to operate with the at least one display device to reset the set of symbol generators to an initial set of symbol generators upon the occurrence of one of the first bonus triggering event and the second bonus triggering event.

26. The method of claim 21, wherein the symbol generator set modification event occurs based, at least in part, on any winning symbol combinations displayed for said play of the game.

27. The method of claim 21, which is provided through a data network.

28. The method of claim 27, wherein the data network is an internet.

* * * * *